US007585163B2

(12) United States Patent
Nishikawa et al.

(10) Patent No.: US 7,585,163 B2
(45) Date of Patent: Sep. 8, 2009

(54) COMPRESSION SYSTEM, MULTICYLINDER ROTARY COMPRESSOR, AND REFRIGERATION APPARATUS USING THE SAME

(75) Inventors: Takahiro Nishikawa, Ota (JP); Hirotsugu Ogasawara, Ota (JP); Akihiro Suda, Gunma-ken (JP); Masayuki Hara, Gunma-ken (JP); Hiroyuki Sawabe, Ota (JP); Hiroyuki Yoshida, Gunma-ken (JP); Akira Hashimoto, Ota (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 0 days.

(21) Appl. No.: 12/081,340

(22) Filed: Apr. 15, 2008

(65) Prior Publication Data

US 2008/0199325 A1 Aug. 21, 2008

Related U.S. Application Data

(62) Division of application No. 11/174,476, filed on Jul. 6, 2005, now Pat. No. 7,524,174.

(30) Foreign Application Priority Data

| | | | |
|---|---|---|---|
| Jul. 8, 2004 | (JP) | ..... | 2004-201601 |
| Jul. 8, 2004 | (JP) | ..... | 2004-201915 |
| Jul. 9, 2004 | (JP) | ..... | 2004-202994 |
| Jul. 9, 2004 | (JP) | ..... | 2004-203001 |
| Aug. 12, 2004 | (JP) | ..... | 2004-235419 |

(51) Int. Cl.
*F03C 2/00* (2006.01)

(52) U.S. Cl. ..... 418/60; 418/23; 418/24; 418/11

(58) Field of Classification Search ..... 418/15, 418/16, 22, 23, 24, 60, 62, 63, 65, 106, 223, 418/224, 248, 249, 263, 11
See application file for complete search history.

(56) References Cited

U.S. PATENT DOCUMENTS 5,170,636 A * 12/1992 Hitosugi ..... 62/175

(Continued)

FOREIGN PATENT DOCUMENTS

| | | |
|---|---|---|
| EP | 1 577 557 A2 | 9/2005 |
| JP | 5-99172 | 4/1993 |
| JP | 10259787 A * | 9/1998 |

OTHER PUBLICATIONS

Extended European Search Report dated Mar. 29, 1006 (2 pages).

(Continued)

*Primary Examiner*—Thomas E Denion
*Assistant Examiner*—Mary A Davis
(74) *Attorney, Agent, or Firm*—Kratz, Quintos & Hanson, LLP

(57) ABSTRACT

An object is to avoid generation of a collision sound of a second vane of a compression system comprising a multicylinder rotary compressor being configured to be used by switching of a first operation mode in which both rotary compression elements perform a compression work and a the second operation mode in which the only first rotary compression element substantially performs the compression work. When the second operation mode is switched to the first operation mode, discharge-side pressures of both the rotary compression elements are applied as a back pressure of the second vane, and thereafter an intermediate pressure is applied which is between suction-side and discharge-side pressures of both the rotary compression elements. When the first operation mode is switched to the second operation mode, a valve device interrupts flowing of a refrigerant into a second cylinder, and thereafter suction-side pressures of both the rotary compression elements are applied as the back pressure of the second vane.

1 Claim, 19 Drawing Sheets

U.S. PATENT DOCUMENTS

| | | | | |
|---|---|---|---|---|
| 7,399,170 | B2 * | 7/2008 | Aya et al. | 418/60 |
| 7,438,541 | B2 * | 10/2008 | Aya et al. | 418/60 |
| 2004/0009083 | A1 * | 1/2004 | Kim et al. | 418/23 |
| 2005/0214137 | A1 * | 9/2005 | Sakaniwa et al. | 417/410.3 |
| 2008/0175736 | A1 * | 7/2008 | Choi et al. | 418/23 |

OTHER PUBLICATIONS

European Search Report dated Nov. 29, 2005; 6 pages.

Patent Abstracts of Japan, vol. 18, No. 016; JP 05-256286, Oct. 5, 1993, Toshiba Corp., 1 page.

Patent Abstracts of Japan, vol. 1998, No. 14; JP 10-259787, Sep. 29, 1998, Toshiba Corp., 1 page.

Patent Abstracts of Japan, vol. 011, No. 213; JP 62-029788, Feb. 7, 1987, Mitsubishi Electric Corp., 1 page.

Patent Abstracts of Japan, vol. 013, No. 591; JP 01-247786, Oct. 3, 1989, Toshiba Corp., 1 page.

* cited by examiner

SECOND OPERATION MODE → FIRST OPERATION MODE

FIRST OPERATION MODE → SECOND OPERATION MODE

SECOND OPERATION MODE → FIRST OPERATION MODE

FIRST OPERATION MODE
(TWO-CYLINDER OPERATION)

SECOND OPERATION MODE
(ONE-CYLINDER OPERATION)

COMPRESSION SYSTEM, MULTICYLINDER ROTARY COMPRESSOR, AND REFRIGERATION APPARATUS USING THE SAME

CROSS REFERENCE TO RELATED APPLICATIONS

This application is a Divisional of prior application Ser. No. 11/174,476 filed on Jul. 6, 2005, now U.S. Pat. No. 7,524,174 the entire contents of which are incorporated herein by reference.

BACKGROUND OF THE INVENTION

The present invention relates to a compression system, a multicylinder rotary compressor constituting the system, and a refrigeration apparatus using the compressor.

This type of compression system has heretofore comprised a multicylinder rotary compressor, a control device which controls an operation of the multicylinder rotary compressor and the like. Examples of this multicylinder rotary compressor includes a two-cylinder rotary compressor comprising first and second rotary compression elements. The compressor includes a driving element and first and second rotary compression elements driven by a rotation shaft of the driving element, and these elements are housed in a sealed container. The first and second rotary compression elements comprise: first and second cylinders; first and second rollers which are fitted into eccentric portions formed in the rotation shaft and which eccentrically rotate in the respective cylinders, respectively; and first and second vanes which abut on the first and second cylinders to partition the insides of the respective cylinders into low-pressure and high-pressure chamber sides. The first and second vanes are constantly urged toward the first and second rollers by the spring members.

Moreover, when the driving element is driven by the control device, a low-pressure refrigerant gas is sucked from a suction passage on the low-pressure chamber sides of the respective cylinders of the first and second rotary compression elements. The gas is compressed by operations of each roller and vane to constitute a high-temperature/pressure refrigerant gas, and discharged from the high-pressure chamber side of each cylinder to a discharge muffling chamber via a discharge port. Thereafter, the gas is discharged into the sealed container, and discharged to the outside (see, e.g., Japanese Patent Application Laid-Open No. 5-99172).

In the compression system comprising this multicylinder rotary compressor, in a case where a compression operation is performed by both the first and second cylinders in a small capacity region at a light load time or a low-speed rotation time, the refrigerant gas has to be sucked and compressed for displacement volumes of both the cylinders. Therefore, a rotation number of the driving element is lowered by a corresponding number by the control device to operate the element. However, when the rotation number drops excessively, a problem occurs that efficiency of the driving element drops and leak loss increases to lower the operation efficiency remarkably.

Therefore, in view of this problem, a compression system has been developed in which a one-cylinder operation and a two-cylinder operation are switchable in accordance with the capacity. That is, either spring member is eliminated from the spring members which urge the first and second vanes of the multicylinder rotary compressor toward the first and second rollers. For example, the spring member is eliminated which urges the second vane toward the second roller. A refrigerant pressure is applied as a back pressure of the second vane on discharge sides of both the rotary compression elements by the control device at the two-cylinder operation. Accordingly, the second vane is urged on a second-roller side to perform a compression work.

On the other hand, when the two-cylinder operation is switched to the one-cylinder operation, a refrigerant pressure is applied as the back pressure of the second vane on suction sides of both the rotary compression elements by the control device. Since this suction pressure is a low pressure, the second vane cannot be urged on the second-roller side. Therefore, the compression work is not substantially performed by the second rotary compression element, and the compression work of the refrigerant is performed only by the first rotary compression element.

When the one-cylinder operation is performed in a small capacity region in this manner, an amount of the refrigerant gas to be compressed can be reduced, and the rotation number can be raised by the amount. Consequently, the operation efficiency of the driving element is improved, and the leak loss can be reduced.

Here, in the second rotary compression element in which any spring member is not disposed during the two-cylinder operation as described above, as to the discharge-side pressures of both the rotary compression elements which urge the second roller, pressure fluctuations are large, a follow-up property of the vane is deteriorated by the pressure fluctuation, and a collision sound is generated between the second roller and the second vane. Therefore, the applicant has tried the application of an intermediate pressure between the suction-side and discharge-side pressures of both the rotary compression elements as the back pressure of the second roller.

However, when the above-described intermediate pressure is applied as the back pressure of the second vane, and the one-cylinder operation is switched to the two-cylinder operation, much time is required for allowing the second vane to follow up the second roller, the second vane collides with the second roller during the follow-up, and a disadvantage has occurred that a collision sound is generated.

On the other hand, since equal suction-side pressures are applied to the pressure in a second cylinder and the back pressure of the second vane at the time of the one-cylinder operation, the second vane does not easily retreat from the second cylinder during the switching from the two-cylinder operation to the one-cylinder operation. There has a problem that the second vane collides with the second roller and the collision sound is generated even during the switching.

On the other hand, pressure pulsation is caused on the back-pressure side of the vane (side opposite to the roller) by the urging operation of the vane with respect to the roller at the time of the operation of the multicylinder rotary compressor. However, in the second vane in which any spring member is not disposed, the pressure pulsation causes a problem that the follow-up property of the second vane is deteriorated, the vane collides with the second roller, and the collision sound is generated.

Furthermore, as to the discharge-side pressures of both the rotary compression elements, which are applied as the back pressure of the second vane, the pressure fluctuation is large, accordingly the follow-up property is deteriorated in the second vane in which any spring member is not disposed, and the collision sound is generated between the second roller and the second vane.

Moreover, the second roller is brought into an idling state in the second rotary compression element during the one-cylinder operation. At this time, the equal suction-side pressures are applied to the pressure in the second cylinder and the back pressure of the second vane. Therefore, the second vane protrudes into the second cylinder by the function of the balance between both spaces. Even in this case, there has been a problem that the second vane collides with the second roller, and the collision sound is generated.

SUMMARY OF THE INVENTION

The present invention has been developed to solve the problems of the conventional technique, and an object thereof is to avoid generation of a collision sound of a second vane at the time of switching of an operation mode in a compression system comprising a multicylinder rotary compressor in which an only first vane is urged toward a first roller by a spring member. The compressor is usable by switching of a first operation mode in which both rotary compression elements perform a compression work and a second operation mode in which an only first rotary compression element substantially performs a compression work.

According to the present invention, there is provided a compression system comprising: a multicylinder rotary compressor in which a sealed container stores a driving element and first and second rotary compression elements driven by a rotation shaft of the driving element, the first and second rotary compression elements comprising: first and second cylinders; first and second rollers which are fitted into eccentric portions formed in the rotation shaft and which eccentrically rotate in the respective cylinders; and first and second vanes which abut on the first and second rollers to partition the inside of each cylinder into low and high-pressure chamber sides, the only first vane being urged toward the first roller by a spring member, the compressor being configured to be used by switching of a first operation mode in which both the rotary compression elements perform a compression work and a second operation mode in which the only first rotary compression element substantially performs the compression work, wherein discharge-side pressures of both the rotary compression elements are applied as a back pressure of the second vane, and thereafter an intermediate pressure is applied which is between suction-side pressures and the discharge-side pressures of both the rotary compression elements, when the second operation mode is switched to the first operation mode.

Moreover, according to the present invention, there is provided a compression system comprising: a multicylinder rotary compressor in which a sealed container stores a driving element and first and second rotary compression elements driven by a rotation shaft of the driving element, the first and second rotary compression elements comprising: first and second cylinders; first and second rollers which are fitted into eccentric portions formed in the rotation shaft and which eccentrically rotate in the respective cylinders; and first and second vanes which abut on the first and second rollers to partition the inside of each cylinder into low and high-pressure chamber sides, the only first vane being urged toward the first roller by a spring member, the compressor being configured to be used by switching of a first operation mode in which both the rotary compression elements perform a compression work and a second operation mode in which the only first rotary compression element substantially performs the compression work, the system further comprising: a valve device for controlling circulation of a refrigerant into the second cylinder, wherein the valve device interrupts flowing of the refrigerant into the second cylinder, and thereafter suction-side pressures of both the rotary compression elements are applied as a back pressure of the second vane, when the first operation mode is switched to the second operation mode.

Furthermore, according to the present invention, there is provided a compression system comprising: a multicylinder rotary compressor in which a sealed container stores a driving element and first and second rotary compression elements driven by a rotation shaft of the driving element, the first and second rotary compression elements comprising: first and second cylinders; first and second rollers which are fitted into eccentric portions formed in the rotation shaft and which eccentrically rotate in the respective cylinders; and first and second vanes which abut on the first and second rollers to partition the inside of each cylinder into low and high-pressure chamber sides, the only first vane being urged toward the first roller by a spring member, the compressor being configured to be used by switching of a first operation mode in which both the rotary compression elements perform a compression work and a second operation mode in which the only first rotary compression element substantially performs the compression work, the system further comprising: a valve device for controlling circulation of a refrigerant into the second cylinder, wherein the valve device allows the refrigerant to flow into the second cylinder, and an intermediate pressure is applied as a back pressure of the second vane in the first operation mode, the intermediate pressure being between suction-side and discharge-side pressures of both the rotary compression elements, the valve device stops the flowing of the refrigerant into the second cylinder, and the suction-side pressures of both the rotary compression elements are applied as the back pressure of the second vane in the second operation mode, the discharge-side pressures of both the rotary compression elements are applied as the back pressure of the second vane, and thereafter the intermediate pressure is applied which is between the suction-side and discharge-side pressures of both the rotary compression elements to switch the second operation mode to the first operation mode, and the valve device interrupts the flowing of the refrigerant into the second cylinder, and the suction-side pressures of both the rotary compression elements are applied as the back pressure of the second vane to switch the first operation mode to the second operation mode.

Additionally, in the compression system of the present invention, in the above-described respective inventions, the driving element of the multicylinder rotary compressor is rotated at a low speed, and a compression ratio of the first rotary compression element or both the rotary compression elements is set to 3.0 or less at the mode switching time.

According to the present invention, when the second operation mode is switched to the first operation mode, the discharge-side pressures of both the rotary compression elements are applied as the back pressure of the second vane, and thereafter the intermediate pressure is applied which is between the suction-side and discharge-side pressures of both the rotary compression elements. Therefore, the second vane is configured to move toward the second roller in an early stage by the discharge-side pressures of both the rotary compression elements. Consequently, a follow-up property of the second vane is improved, operation efficiency is improved, and generation of a collision sound of the second vane can be avoided at the switching time from the second operation mode to the first operation mode.

Moreover, after applying to the second vane the discharge-side pressures of both the rotary compression elements, and allowing the second vane to follow up the second roller, the intermediate pressure is applied which is between the suction-side and discharge-side pressures of both the rotary compression elements. Accordingly, a pressure fluctuation is remarkably reduced as compared with a case where the discharge-side pressures of both the rotary compression elements are applied to the back pressure of the second vane. Therefore, after the switching of the operation mode, the follow-up property of the second vane is improved, and the compression efficiency of the second rotary compression element is improved in the multicylinder rotary compressor. Moreover, it is possible to avoid generation of a collision sound between the second roller and the second vane in the first operation mode.

Furthermore, when the first operation mode is switched to the second operation mode, the valve device interrupts the flowing of the refrigerant into the second cylinder, and thereafter the suction-side pressures of both the rotary compression elements are applied as the back pressure of the second vane. Therefore, the pressure in the second cylinder can be set to be higher than the back pressure of the second vane. Accordingly, the second vane of the multicylinder rotary compressor is pushed on a side opposite to the second roller by the pressure in the second cylinder. Since the second vane does not come into the second cylinder, it is possible to avoid beforehand a disadvantage that the second vane collides with the second roller to generate the collision sound.

Moreover, as described above, the compressor is usable by the switching of the first operation mode in which the first and second rotary compression elements perform the compression work and the second operation mode in which the only first rotary compression element substantially performs the compression work. In this case, performance and reliability of the multicylinder rotary compressor are enhanced, and the performance of the compression system can be remarkably enhanced.

Especially when the mode is switched, the driving element of the multicylinder rotary compressor is rotated at a low speed, the compression ratio of the first rotary compression element or both the rotary compression elements is set to 3.0 or less, and then the pressure fluctuation can be suppressed at the operation mode switching time.

Moreover, according to the present invention, there is provided a refrigeration apparatus comprising: a refrigerant circuit using the compression system according to the above-described inventions.

According to the present invention, since the refrigerant circuit of the refrigeration apparatus is constituted using the compression system of each of the above-described inventions, the operation efficiency of the whole refrigeration apparatus can be improved.

Furthermore, an object of the present invention is to avoid generation of a collision sound of a second vane at a starting time in a compression system comprising a multicylinder rotary compressor which urges an only first vane toward a first roller by a spring member.

That is, according to the present invention, there is provided a compression system comprising: a multicylinder rotary compressor in which a sealed container stores a driving element and first and second rotary compression elements driven by a rotation shaft of the driving element, the first and second rotary compression elements comprising: first and second cylinders; first and second rollers which are fitted into eccentric portions formed in the rotation shaft and which eccentrically rotate in the respective cylinders; and first and second vanes which abut on the first and second rollers to partition the inside of each cylinder into low and high-pressure chamber sides, the only first vane being urged toward the first roller by a spring member, wherein the multicylinder rotary compressor is started in a state in which suction-side pressures of both the rotary compression elements are applied as a back pressure of the second vane, when the compressor is started, discharge-side pressures of both the rotary compression elements are applied as the back pressure of the second vane after the starting, and thereafter the back pressure of the second vane is set to be an intermediate pressure between the suction-side and discharge-side pressures of both the rotary compression elements.

Moreover, in the compression system of the present invention, in the above-described invention, the multicylinder rotary compressor is configured to be used by switching of a first operation mode in which both the rotary compression elements perform a compression work and a second operation mode in which the only first rotary compression element substantially performs a compression work.

According to the present invention, when the multicylinder rotary compressor is started, the compressor is started in a state in which the suction-side pressures of both the rotary compression elements are applied as the back pressure of the second vane, and accordingly the compression work is not substantially performed by the second rotary compression element.

Moreover, after the compressor is started, the discharge-side pressures of both the rotary compression elements are applied as the back pressure of the second vane. Accordingly, the second vane is urged toward the second roller, and the compression work is started in the second rotary compression element.

Furthermore, after applying the discharge-side pressures of both the rotary compression elements as the back pressure of the second vane, the back pressure of the second vane is set to the intermediate pressure between the suction-side and discharge-side pressures of both the rotary compression elements. Consequently, the pressure fluctuation is reduced as compared with a case where the discharge-side pressures of both the rotary compression elements are applied to the back pressure of the second vane. Therefore, in the multicylinder rotary compressor at a usual operation time after the starting, the follow-up property of the second vane is improved, the compression efficiency of the second rotary compression element is improved, and it is possible to avoid beforehand the generation of the collision sound between the second roller and the second vane.

Especially, the multicylinder rotary compressor is usable by the switching of the first operation mode in which the first and second rotary compression elements perform the compression work and the second operation mode in which the only first rotary compression element substantially performs the compression work. The performance and reliability of the compressor are enhanced, and the performance of the compression system can be remarkably enhanced.

Moreover, according to the present invention, there is provided a refrigeration apparatus comprising a refrigerant circuit using the compression system according to the above-described inventions.

According to the present invention, since the refrigerant circuit of the refrigeration apparatus is constituted using the compression system of each of the above-described inventions, the operation efficiency of the whole refrigeration apparatus can be improved.

Furthermore, an object of the present invention is to improve a follow-up property of a second vane and avoid generation of a collision sound of the second vane in a multicylinder rotary compressor which urges an only first vane toward a first roller by a spring member and a compression system comprising the multicylinder rotary compressor.

That is, according to the present invention, there is provided a multicylinder rotary compressor in which a sealed container stores a driving element and first and second rotary compression elements driven by a rotation shaft of the driving element, the first and second rotary compression elements comprising: first and second cylinders; first and second rollers which are fitted into eccentric portions formed in the rotation shaft and which eccentrically rotate in the respective cylinders; and first and second vanes which abut on the first and second rollers to partition the inside of each cylinder into low and high-pressure chamber sides, the only first vane being urged toward the first roller by a spring member, the compressor further comprising: a back-pressure chamber for applying a back pressure to the second vane to urge the second vane toward the second roller, the back-pressure chamber being constituted as a muffler chamber having a predetermined space volume.

In the present invention, since the back-pressure chamber constitutes the muffler chamber having a predetermined space volume, pressure pulsation generated by the urging operation of the second vane is reduced by the space volume, and it is possible to reduce pressure fluctuations of the discharge-side pressures of both the rotary compression elements, which are applied as the back pressure of the second vane.

Consequently, the follow-up property of the second vane is improved, the compression efficiency of the second rotary compression element is improved, and it is possible to avoid the generation of the collision sound between the second roller and the second vane as much as possible.

Furthermore, as described above, the multicylinder rotary compressor is usable by the switching of the first operation mode in which the first and second rotary compression elements perform the compression work and the second operation mode in which the only first rotary compression element substantially performs the compression work. The performance and reliability of the compressor can be enhanced.

Moreover, according to the present invention, there is provided a multicylinder rotary compressor in which a sealed container stores a driving element and first and second rotary compression elements driven by a rotation shaft of the driving element, the first and second rotary compression elements comprising: first and second cylinders; first and second rollers which are fitted into eccentric portions formed in the rotation shaft and which eccentrically rotate in the respective cylinders; and first and second vanes which abut on the first and second rollers to partition the inside of each cylinder into low and high-pressure chamber sides, the only first vane being urged toward the first roller by a spring member, the compressor further comprising: a back-pressure passage for applying a back pressure to the second vane, wherein a sectional area of the back-pressure passage is set to be not less than an average value of a surface area of the second vane exposed into the second cylinder.

In this invention, when the sectional area of the passage for the back pressure is set to be not less than the average value of the surface area of the second vane exposed into the second cylinder, a sufficient passage for the back pressure can be sufficiently secured. Pressure pulsation is reduced which is generated by an urging operation of the second vane, and pressure fluctuation of a refrigerant can be reduced. The refrigerant is applied as the back pressure of the second vane.

Consequently, a follow-up property of the second vane is improved, a compression efficiency of the second rotary compression element is improved, and it is possible to avoid generation of a collision sound between the second roller and the second vane as much as possible.

As described above, performance and reliability of the multicylinder rotary compressor can be enhanced. In the compressor, the only first vane is urged toward the first roller by the spring member.

Moreover, according to the present invention, there is provided a multicylinder rotary compressor in which a sealed container stores a driving element and first and second rotary compression elements driven by a rotation shaft of the driving element, the first and second rotary compression elements comprising: first and second cylinders; first and second rollers which are fitted into eccentric portions formed in the rotation shaft and which eccentrically rotate in the respective cylinders; and first and second vanes which abut on the first and second rollers to partition the inside of each cylinder into low and high-pressure chamber sides, the first vane being urged toward the first roller by a spring member, the compressor being configured to be used by switching of a first operation mode in which both the rotary compression elements perform the compression work and a second operation mode in which the only first rotary compression element substantially performs the compression work, the compressor further comprising: urging means for urging the second vane toward the second roller, wherein an urging force of the urging means is set to be not more than that in a case where a suction-side pressure of both the rotary compression elements or the first rotary compression element is applied as a back pressure of the second vane.

Furthermore, in the multicylinder rotary compressor of the present invention, in the above-described invention, the compressor further comprising: a valve device for controlling circulation of a refrigerant into the second cylinder, wherein the valve device allows the refrigerant to flow into the second cylinder, and an intermediate pressure is applied as a back pressure of the second vane, the intermediate pressure being between suction-side and discharge-side pressures of both the rotary compression elements, or the discharge-side pressures of both the rotary compression elements are applied in the first operation mode, and the valve device interrupts the flowing of the refrigerant into the second cylinder, and the suction-side pressures of both the rotary compression elements are applied as the back pressure of the second vane in the second operation mode.

Moreover, according to the present invention, there is provided a compression system comprising: a multicylinder rotary compressor in which a sealed container stores a driving element and first and second rotary compression elements driven by a rotation shaft of the driving element, the first and second rotary compression elements comprising: first and second cylinders; first and second rollers which are fitted into eccentric portions formed in the rotation shaft and which eccentrically rotate in the respective cylinders; and first and second vanes which abut on the first and second rollers to partition the inside of each cylinder into low and high-pressure chamber sides, the first vane being urged toward the first roller by a spring member, the compressor being configured to be used by switching of a first operation mode in which both the rotary compression elements perform a compression work and a second operation mode in which the only first rotary compression element substantially performs the compression work, the system further comprising: a valve device for controlling circulation of a refrigerant into the second cylinder; and urging means for urging the second vane toward the second roller, wherein an urging force of the urging means is set to be not more than that in a case where a suction-side pressure of both the rotary compression elements or the first rotary compression element is applied as a back pressure of the second vane, the valve device allows the refrigerant to flow into the second cylinder, and an intermediate pressure is applied as the back pressure of the second vane, the intermediate pressure being between suction-side and discharge-side pressures of both the rotary compression elements, or the discharge-side pressures of both the rotary compression elements are applied in the first operation mode, and the valve device interrupts the flowing of the refrigerant into the second cylinder, and the suction-side pressures of both the rotary compression elements are applied as the back pressure of the second vane in the second operation mode.

Furthermore, according to the present invention, there is provided a multicylinder rotary compressor in which a sealed container stores a driving element and first and second rotary compression elements driven by a rotation shaft of the driving element, the first and second rotary compression elements comprising: first and second cylinders; first and second rollers which are fitted into eccentric portions formed in the rotation shaft and which eccentrically rotate in the respective cylinders; and first and second vanes which abut on the first and second rollers to partition the inside of each cylinder into low and high-pressure chamber sides, the first vane being urged toward the first roller by a spring member, the compressor being configured to be used by switching of a first operation mode in which both the rotary compression elements perform a compression work and a second operation mode in which the only first rotary compression element substantially performs the compression work, the compressor further comprising: a weak spring for a tensile load on a side of the second vane opposite to a second roller side, wherein a tensile force of this weak spring is set to be not more than an urging force in a case where a suction-side pressure of both the rotary compression elements or the first rotary compression element is applied as a back pressure of the second vane.

According to this invention, for example, the urging means comprising the weak spring or the like can improve a follow-up property of the second vane in the first operation mode. Especially, in the first operation mode, the valve device allows the refrigerant to flow into the second cylinder, and the intermediate pressure is applied as the back pressure of the second vane, the intermediate pressure being between the suction-side and discharge-side pressures of both the rotary compression elements, or the discharge-side pressures of both the rotary compression elements are applied. In this case, the follow-up property of the second vane deteriorates by pressure pulsation of the intermediate pressure or the discharge-side pressure. This disadvantage can be avoided by the urging means beforehand.

Moreover, the urging force of the urging means is set to be not more than that in a case where the suction-side pressure of both the rotary compression elements or the first rotary compression element is applied as the back pressure of the second vane. In the second operation mode, the valve device interrupts the flowing of the refrigerant into the second cylinder, and the suction-side pressures of both the rotary compression elements are applied as the back pressure of the second vane. Consequently, by the pressure in the second cylinder, the urging force for urging the second vane on a back-pressure side can be set to be larger than the suction-side pressure for urging the second vane toward the second roller, and the urging force of the urging means.

Consequently, even when the urging means is disposed for urging the second vane toward the second roller, or an urging member is disposed in the second operation mode, the second vane of the multicylinder rotary compressor does not come into the second cylinder by the pressure in the second cylinder. Therefore, it is possible to avoid beforehand a disadvantage that the second vane collides with the second roller to generate a collision sound.

Furthermore, as described above, the multicylinder rotary compressor is configured to be used by the switching of the first operation mode in which the first and second rotary compression elements perform the compression work and the second operation mode in which the only first rotary compression element substantially performs the compression work. Performance and reliability of the compressor are enhanced, and performance of the compression system can be remarkably enhanced.

Additionally, the second vane does not come into the second cylinder by the tensile force of the weak spring in the second operation mode by the weak spring for the tensile load. Therefore, it is possible to avoid beforehand the disadvantage that the second vane collides with the second roller to generate the collision sound.

DETAILED DESCRIPTION OF THE PREFERRED EMBODIMENT

Embodiments of the present invention will be described hereinafter in detail.

Embodiment 1

Figure 1:
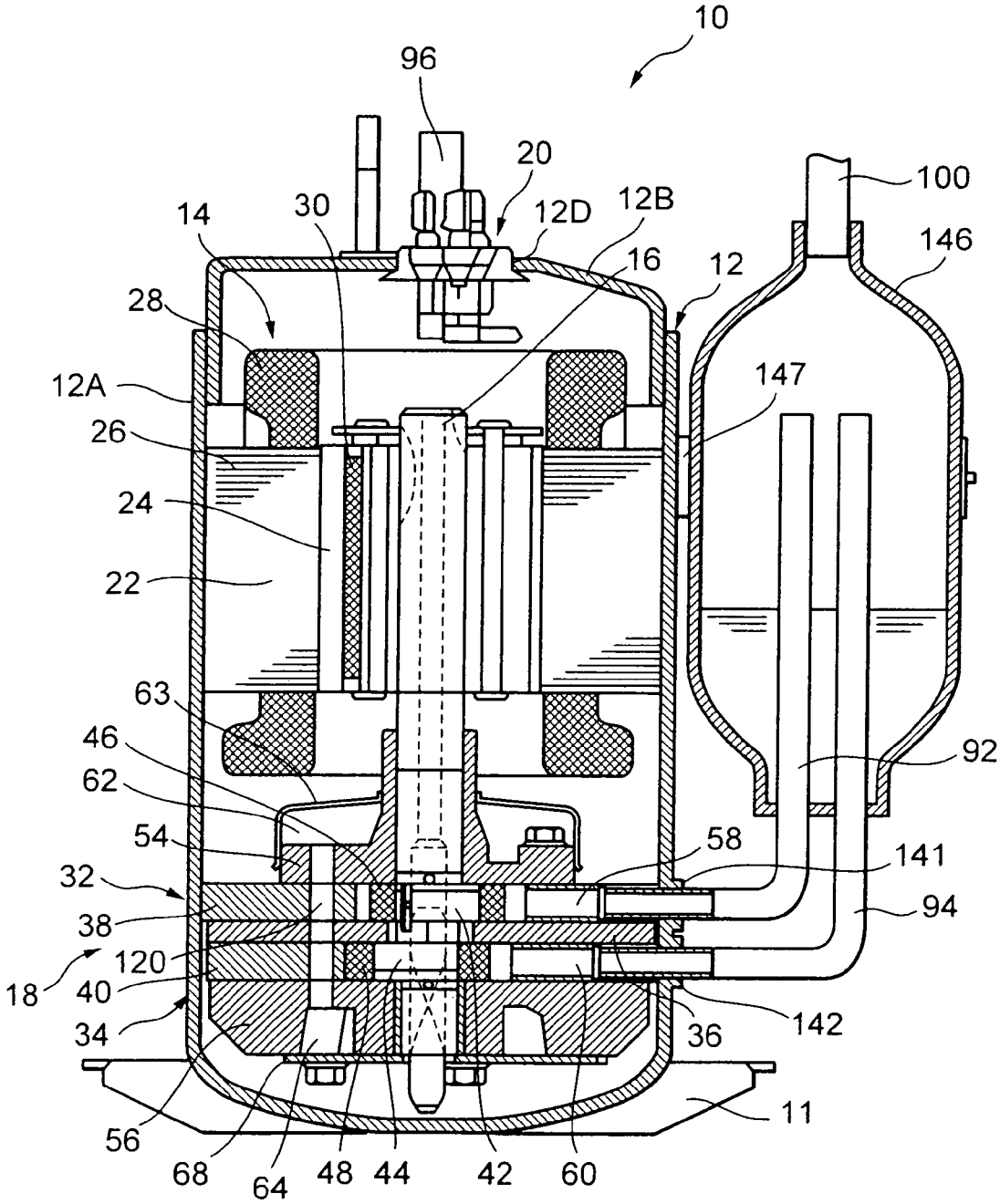
FIG. 1 is a vertically sectional side view of a multicylinder rotary compressor of a compression system according to an embodiment of the present invention.
Figure 2:
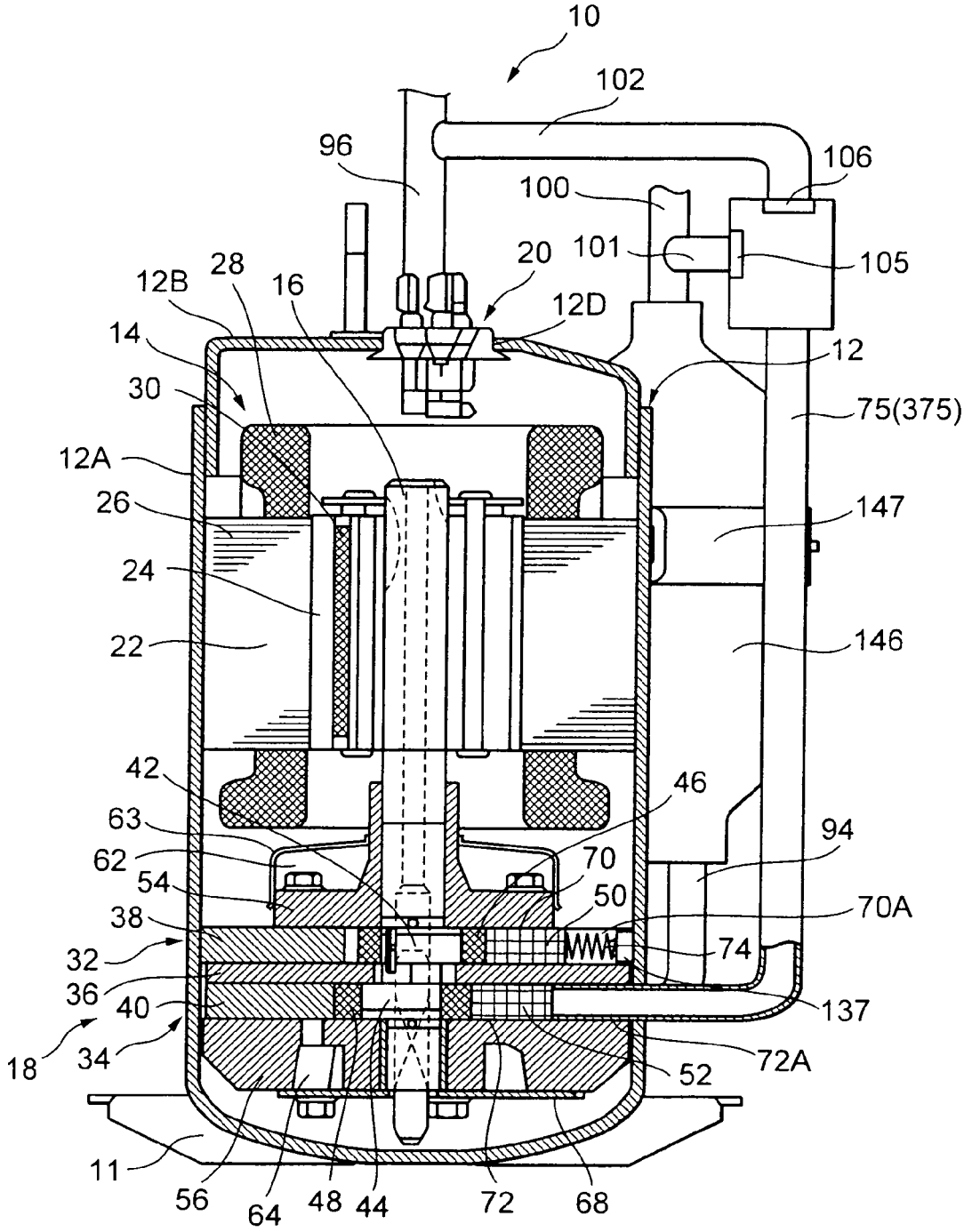
FIG. 2 is another vertically sectional side view of the multicylinder rotary compressor of FIG. 1.

FIG. 1 is a vertically sectional side view of an inner high pressure type rotary compressor 10 comprising first and second rotary compression elements according to an embodiment of a multicylinder rotary compressor of a compression system CS of the present invention, and FIG. 2 is a vertically sectional side view (showing a section different from that of FIG. 1) of the rotary compressor 10 of FIG. 1. It is to be noted that the compression system CS of the present embodiment constitutes a part of a refrigerant circuit of an air conditioner which is a refrigeration apparatus for conditioning air in a room.

In each figure, the rotary compressor 10 of the embodiment is an inner high pressure type rotary compressor. In a vertically cylindrical sealed container 12 formed of a steel plate, elements are stored: an electromotive element 14 which is a driving element disposed in an upper part of an inner space of this sealed container 12; and a rotary compression mechanism section 18 which is disposed under the electromotive element 14 and which is constituted of first and second rotary compression elements 32, 34 driven by a rotation shaft 16 of the electromotive element 14.

A bottom part of the sealed container 12 is an oil reservoir, and the container comprises a container main body 12A which houses the electromotive element 14 and the rotary compression mechanism section 18; and a substantially bowl-shaped end cap (lid body) 12B which closes an upper opening of the container main body 12A. A circular attaching hole 12D is formed in the upper surface of the end cap 12B, and a terminal (wiring is omitted) 20 for supplying a power to the electromotive element 14 is attached to this attaching hole 12D.

Moreover, a refrigerant discharge tube 96 described later is attached to the end cap 12B, and one end of the refrigerant introducing tube 96 communicates with the inside of the sealed container 12. Moreover, an attaching base 11 is disposed in a bottom part of the sealed container 12.

The electromotive element 14 comprises: a stator 22 annularly welded/fixed along an inner peripheral surface of an upper space of the sealed container 12; and a rotor 24 inserted/disposed with a slight interval inside the stator 22. This rotor 24 is fixed to the rotation shaft 16 which passes through a center and extends in a vertical direction.

The stator 22 has: a laminated member 26 in which donut-shaped electromagnetic steel plates are stacked; and a stator coil 28 which is wound around a tooth portion of the laminated member 26 by a direct winding (concentrated winding) system. The rotor 24 is also formed by a laminate member 30 of electromagnetic steel plates in the same manner as in the stator 22.

An intermediate partition plate 36 is held between the first and second rotary compression elements 32, 34. That is, the first and second rotary compression elements 32, 34 comprise: the intermediate partition plate 36; first and second cylinders 38, 40 disposed on/under the intermediate partition plate 36; first and second rollers 46, 48 which are fitted into upper and lower eccentric portions 42, 44 disposed in the rotation shaft 16 with a phase difference of 180 degrees in the first and second cylinders 38, 40 and which eccentrically rotate in the respective cylinders 38, 40, respectively; first and second vanes 50, 52 which abut on the first and second rollers 46, 48 to partition the insides of the respective cylinders 38, 40 into low-pressure and high-pressure chamber sides; and upper and lower support members 54, 56 which close an upper opening face of the first cylinder 38 and a lower opening face of the second cylinder 40 and which also function as bearings of the rotation shaft 16.

The first and second cylinders 38, 40 are provided with suction passages 58, 60 which communicate with the insides of the first and second cylinders 38, 40, and the suction passages 58, 60 are connected to refrigerant introducing tubes 92, 94 described later.

Moreover, a discharge muffling chamber 62 is disposed on the upper support member 54, and a refrigerant gas compressed by the first rotary compression element 32 is discharged to the discharge muffling chamber 62. This discharge muffling chamber 62 is formed in a substantially bowl-shaped cup member 63 having in its center a hole for passing through the rotation shaft 16 and the upper support member 54 which also functions as the bearing of the rotation shaft 16. The member covers an electromotive element 14 side (upper side) of the upper support member 54. Moreover, the electromotive element 14 is disposed above the cup member 63 with a predetermined interval from the cup member 63.

A discharge muffling chamber 64 is disposed in the lower support member 56. The chamber is formed by closing of a depressed portion formed in a lower part of the lower support member 56 by a cover which is a wall. That is, the discharge muffling chamber 64 is closed by a lower cover 68 which defines the discharge muffling chamber 64.

A guide groove 70 is formed in the first cylinder 38, and the above-described first vane 50 is stored in the groove. A housing section 70A is formed outside the guide groove 70, that is, in a back surface of the first vane 50, and the section houses a spring 74 which is a spring member. The spring 74 abuts on a back-surface end portion of the first vane 50 to urge the first vane 50 constantly on the side of the first roller 46. A discharge-side pressure (high-pressure) described later is also introduced, for example, from the sealed container 12 into the housing section 70A, and is applied as the back pressure of the first vane 50. Moreover, the housing section 70A opens on the sides of the guide groove 70 and sealed container 12 (container main body 12A), a plug 137 formed of a metal is disposed on the sealed container 12 side of the spring 74 housed in the housing section 70A, and the plug prevents the spring 74 from coming off.

Moreover, a guide groove 72 is formed in the second cylinder 40 to house the second vane 52, and a back-pressure chamber 72A is formed outside the guide groove 72, that is, on a back-surface side of the second vane 52. The back-pressure chamber 72A opens on the sides of the guide groove 72 and the sealed container 12, an opening on the sealed container 12 side communicates with a pipe 75 described later, and the opening is sealed together with the inside of the sealed container 12.

On the side surface of the container main body 12A of the sealed container 12, sleeves 141 and 142 are welded/fixed to positions corresponding to the suction passages 58, 60 of the first and second cylinders 38, 40. These sleeves 141 and 142 are vertically adjacent to each other.

Moreover, one end of the refrigerant introducing tube 92 for introducing a refrigerant gas into the first cylinder 38 is inserted/connected into the sleeve 141, and one end of the refrigerant introducing tube 92 communicates with the suction passage 58 of the upper cylinder 38. The other end of the refrigerant introducing tube 92 opens in an accumulator 146.

One end of the refrigerant introducing tube 94 for introducing the refrigerant gas into the second cylinder 40 is Inserted/connected into the sleeve 142, and one end of the refrigerant introducing tube 94 communicates with the suction passage 60 of the second cylinder 40. The other end of the refrigerant introducing tube 94 opens in the accumulator 146 in the same manner as in the refrigerant introducing tube 92.

The accumulator 146 is a tank which separates a gas/liquid of a sucked refrigerant, and is attached to the upper side surface of the container main body 12A of the sealed container 12 via a bracket 147. Moreover, the refrigerant introducing tubes 92, 94 are inserted into the accumulator 146 from its bottom portion, and other end openings are positioned in an upper part of the accumulator 146. One end of a refrigerant pipe 100 is inserted into the upper part of the accumulator 146.

It is to be noted that the discharge muffling chamber 64 communicates with the discharge muffling chamber 62 via the upper and lower support members 54, 56, the first and second cylinders 38, 40, or a communication path 120 extending through the intermediate partition plate 36 in an axial center direction (vertical direction). Moreover, the refrigerant gas is compressed by the second rotary compression element 34, and discharged to the discharge muffling chamber 64, and this gas having high-temperature/pressure is then discharged to the discharge muffling chamber 62 via the communication path 120. The gas flows with respect to a high-temperature/pressure refrigerant gas compressed by the first rotary compression element 32.

Moreover, the discharge muffling chamber 62 communicates with the inside of the sealed container 12 via a hole (not shown) which extends through the cup member 63. Through this hole, the high-pressure refrigerant gas is discharged into the sealed container 12. The gas has been compressed by the first and second rotary compression elements 32 and 34, and discharged to the discharge muffling chamber 62.

Here, a refrigerant pipe 101 is connected to a middle portion of the refrigerant pipe 100, and the pipe is connected to the pipe 75 via an electromagnetic valve 105. A refrigerant pipe 102 also communicates with/is connected to a middle portion of the refrigerant discharge tube 96, and the pipe is connected to the pipe 75 via an electromagnetic valve 106 in the same manner as in the refrigerant pipe 101. These electromagnetic valves 105, 106 are controlled in such a manner as to open/close by a controller 210 described later. That is, when the controller 210 opens the valve device 105, and closes the valve device 106, the refrigerant pipe 101 communicates with the pipe 75. Accordingly, after flowing through the refrigerant pipe 100 into the accumulator 146, a part of the refrigerant on a suction side of both the rotary compression elements 32, 34 enters the refrigerant pipe 101, and flows into the back-pressure chamber 72A from the pipe 75. Accordingly, suction-side pressures of both the rotary compression elements 32, 34 are applied as a back pressure of the second vane 52.

Moreover, when the controller 210 closes the valve device 105, and opens the valve device 106, the refrigerant discharge tube 96 communicates with the pipe 75. Accordingly, after being discharged from the sealed container 12 and passed through the refrigerant discharge tube 96, a part of the refrigerant on a discharge side of both the rotary compression elements 32, 34 flows into the back-pressure chamber 72A from the pipe 75 via the refrigerant pipe 102. Accordingly, discharge-side pressures of both the rotary compression elements 32, 34 are applied as the back pressure of the second vane 52.

Here, the controller 210 constitutes a part of the compression system CS of the present invention, and controls a rotation number of the electromotive element 14 of the rotary compressor 10. As described above, the controller also controls the opening/closing of the electromagnetic valve 105 of the refrigerant pipe 101, and the electromagnetic valve 106 of the refrigerant pipe 102.

Figure 3:
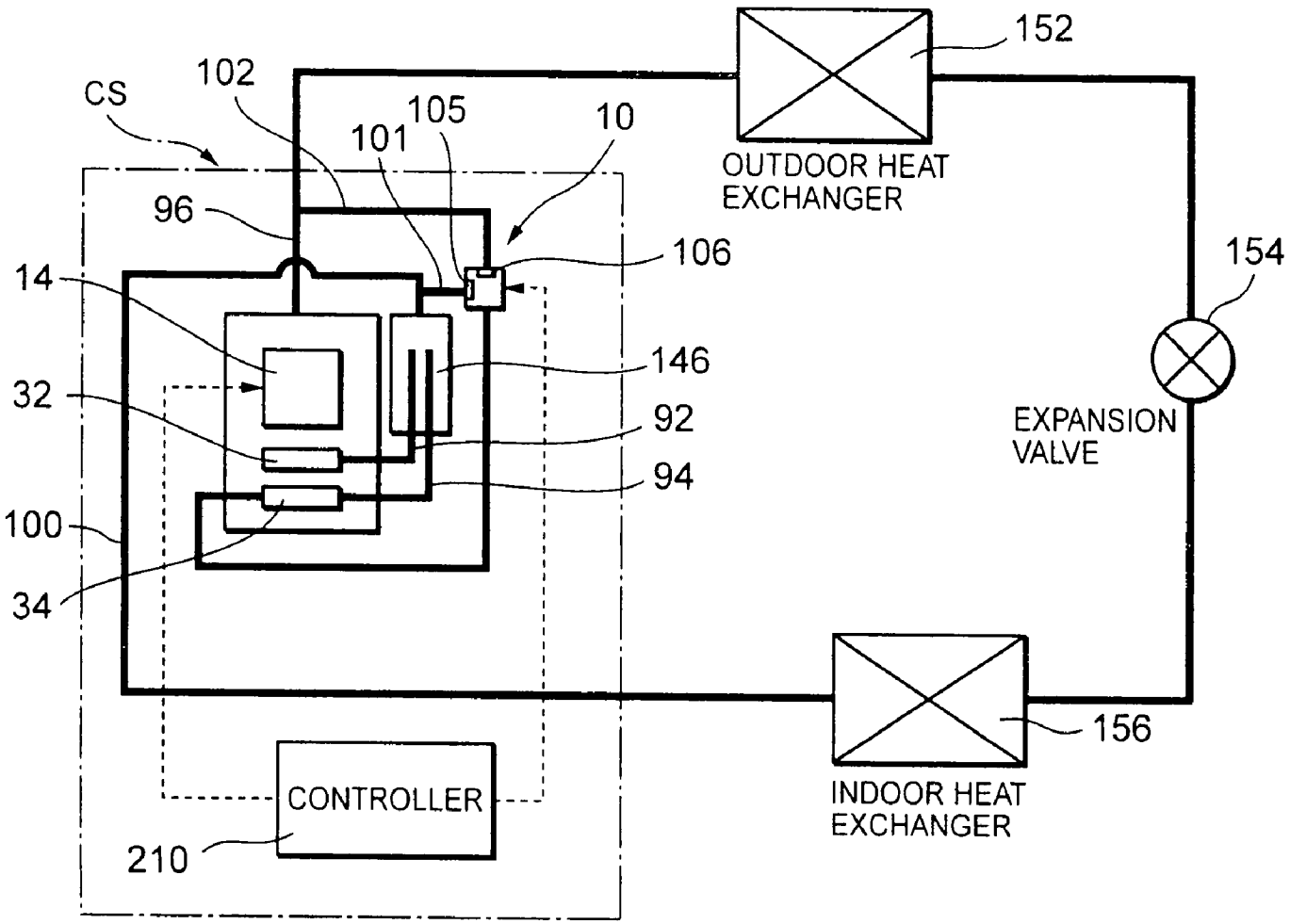
FIG. 3 is a refrigerant circuit diagram of an air conditioner using the compression system of the embodiment of the present invention.

Next, FIG. 3 shows a refrigerant circuit diagram of the air conditioner constituted using the compression system CS. That is, the compression system CS of the embodiment constitutes a part of the refrigerant circuit of the air conditioner shown in FIG. 3, and comprises the rotary compressor 10, the controller 210 and the like. The refrigerant discharge tube 96 of the rotary compressor 10 is connected to an inlet of an outdoor heat exchanger 152. The controller 210, rotary compressor 10, and outdoor heat exchanger 152 are disposed in an outdoor unit (not shown) of the air conditioner. A pipe connected to an outlet of the outdoor heat exchanger 152 is connected to an expansion valve 154 which is pressure reducing means, and a pipe extending out of the expansion valve 154 is connected to an indoor heat exchanger 156. These expansion valve 154 and indoor heat exchanger 156 are disposed in an indoor unit (not shown) of the air conditioner. The refrigerant pipe 100 of the rotary compressor 10 is connected to an outlet of the indoor heat exchanger 156.

It is to be noted that an HFC or HC-based refrigerant is used as the refrigerant. As oils which are lubricants, existing oils are used such as a mineral oil, an alkyl benzene oil, an ether oil, and an ester oil.

Next, an operation of the rotary compressor 10 constituted as described above will be described.

(1) First Operation Mode (Operation at Usual or High Load Time)

First, a first operation mode will be described in which both the rotary compression elements 32, 34 perform a compression work. The controller 210 controls a rotation number of the electromotive element 14 of the rotary compressor 10 based on an operation instruction input of an indoor-unit-side controller (not shown) disposed in the indoor unit. In a usual or high load indoor state, the controller 210 executes the first operation mode. In this first operation mode, the controller 210 closes the electromagnetic valve 105 of the refrigerant pipe 101 and the electromagnetic valve 106 of the refrigerant pipe 102.

Moreover, when the stator coil 28 of the electromotive element 14 is energized via a terminal 20 and wiring (not shown), the electromotive element 14 starts, and the rotor 24 rotates. By this rotation, the first and second rollers 46, 48 are fitted into the upper and lower eccentric portions 42, 44 integrally disposed in the rotation shaft 16, and eccentrically rotate in the first and second cylinders 38, 40.

Accordingly, the low-pressure refrigerant flows into the accumulator 146 from the refrigerant pipe 100 of the rotary compressor 10. Since the electromagnetic valve 105 of the refrigerant pipe 100 is closed as described above, all the refrigerant passed through the refrigerant pipe 100 flows into the accumulator 146 without flowing into the pipe 75.

Moreover, the low-pressure refrigerant which has flown into the accumulator 146 is separated into gas/liquid, and thereafter the only refrigerant gas enters the respective refrigerant discharge tubes 92, 94 which open in the accumulator 146. The low-pressure refrigerant gas which has entered the refrigerant introducing tube 92 is passed through the suction passage 58, and sucked on the low-pressure chamber side of the first cylinder 38 of the first rotary compression element 32.

The refrigerant gas sucked on the low-pressure chamber side of the first cylinder 38 is compressed by the operations of the first roller 46 and the first vane 50 to constitute a high-temperature/pressure refrigerant gas. The gas is passed through a discharge port (not shown) from the high-pressure chamber side of the first cylinder 38, and is discharged to the discharge muffling chamber 62.

On the other hand, the low-pressure refrigerant gas which has flown into the refrigerant introducing tube 94 is passed through the suction passage 60, and sucked on the low-pressure chamber side of the second cylinder 40 of the second rotary compression element 34. The refrigerant gas sucked on the low-pressure chamber side of the second cylinder 40 is compressed by the operations of the second roller 48 and the second vane 52.

At this time, since the electromagnetic valves 105, 106 are closed as described above, a closed space is formed in the pipe 75 connected to the back-pressure chamber 72A of the second vane 52. Furthermore, since not a little refrigerant in the second cylinder 40 flows into the back-pressure chamber 72A between the second vane 52 and the housing section 70A, a pressure in the back-pressure chamber 72A of the second vane 52 is an intermediate pressure between the suction-side and discharge-side pressures of both the rotary compression elements 32, 34, and the intermediate pressure is applied as the back pressure of the second vane 52. By this intermediate pressure, the second vane 52 can be sufficiently urged toward the second roller 48 without using any spring member.

Moreover, a high pressure which is the discharge-side pressure of both the rotary compression elements 32, 34 has heretofore been applied as the back pressure of the second vane 52. However, in this case, since the discharge-side pressure has large pulsation, and any spring member is not disposed, a follow-up property of the second vane 52 is deteriorated by the pulsation, a compression efficiency drops, and a problem has occurred that a collision sound is generated between the second vane 52 and the second roller 48.

However, by the application of the intermediate pressure between the suction-side and discharge-side pressures of both the rotary compression elements 32, 34 as the back pressure of the second vane 52, the pressure pulsation is remarkably reduced as compared with a case where the discharge-side pressure is applied as described above. Especially in the present embodiment, the electromagnetic valves 105, 106 are closed to interrupt the flowing of the suction-side and discharge-side refrigerants of both the rotary compression elements 32, 34 from the pipe 75. Therefore, pulsation of the back pressure of the second vane 52 can be further suppressed. Accordingly, the follow-up property of the second vane 52 is improved in the first operation mode, and the compression efficiency of the second rotary compression element 34 is enhanced.

It is to be noted that the refrigerant gas is compressed by the operations of the second roller 48 and second vane 52 to obtain a high-temperature/pressure. The gas is passed through a discharge port (not shown) from the high-pressure chamber side of the second cylinder 40, and is discharged to the discharge muffling chamber 64. The refrigerant gas discharged to the discharge muffling chamber 64 is discharged to the discharge muffling chamber 62 via the communication path 120, and flows together with the refrigerant gas compressed by the first rotary compression element 32. Moreover, the joined refrigerant gas is discharged into the sealed container 12 from a hole (not shown) extending through the cup member 63.

Thereafter, the refrigerant in the sealed container 12 is discharged to the outside from the refrigerant discharge tube 96 formed in the end cap 12B of the sealed container 12, and flows into the outdoor heat exchanger 152. In the exchanger, the refrigerant gas emits heat, pressure of the gas is reduced by the expansion valve 154, and thereafter the gas flows into the indoor heat exchanger 156. In the exchanger, the refrigerant evaporates, heat is absorbed from air circulated in the room to thereby exert a cooling function, and the inside of the room is cooled. Moreover, the refrigerant emanates from the indoor heat exchanger 156 and is sucked by the rotary compressor 10. The refrigerant repeats this cycle.

(2) Second Operation Mode (Operation at Light Load Time)

Next, a second operation mode will be described. In a case where the inside of the room has a state in which a load is light, the controller 210 shifts to the second operation mode. In this second operation mode, the only first rotary compression element 32 substantially performs a compression work. The operation mode is performed in a case where the inside of the room has a light load and the electromotive element 14 rotates at a low speed in the first operation mode. When the only first rotary compression element 32 substantially performs the compression work in a small capacity region of the compression system CS, an amount of the refrigerant gas to be compressed can be reduced as compared with a case where the first and second cylinders 38, 40 perform the compression work. Therefore, the rotation number of the electromotive element 14 is raised also at the light load time by the corresponding amount, the operation efficiency of the electromotive element 14 is improved, and a leak loss of the refrigerant can be reduced.

In this case, the controller 210 opens the electromagnetic valve 105 of the refrigerant pipe 101, and closes the electromagnetic valve 106 of the refrigerant pipe 102. Accordingly, the refrigerant pipe 101 communicates with the pipe 75, a suction-side refrigerant of the first rotary compression element 32 flows into the back-pressure chamber 72A, and the suction-side pressure of the first rotary compression element 32 is applied as the back pressure of the second vane 52.

On the other hand, the controller 210 energizes the stator coil 28 of the electromotive element 14 via the terminal 20 and the wiring (not shown), and rotates the rotor 24 of the electromotive element 14 as described above. By this rotation, the first and second rollers 46, 48 are fitted into the upper and lower eccentric portions 42, 44 disposed integrally with the rotation shaft 16, and eccentrically rotate in the first and second cylinders 38, 40.

Accordingly, the low-pressure refrigerant flows into the accumulator 146 from the refrigerant pipe 100 of the rotary compressor 10. Since the electromagnetic valve 105 of the refrigerant pipe 101 opens at this time as described above, a part of the refrigerant on the suction side of the first rotary compression element 32 passes through the refrigerant pipe 100, and flows into the back-pressure chamber 72A from the refrigerant pipe 101 via the pipe 75. Accordingly, the back-pressure chamber 72A has a suction-side pressure of the first rotary compression element 32, and the suction-side pressure of the first rotary compression element 32 is applied as the back pressure of the second vane 52.

Here, the suction-side pressures of both the rotary compression elements 32, 34 are applied as the back pressure of the second rotary compression element 34, and this pressure is a low pressure. Therefore, the second vane 52 cannot be urged toward the second roller 48. Therefore, the compression work is not substantially performed in the second rotary compression element 34, and the compression work of the refrigerant is performed only by the first rotary compression element 32 provided with the spring 74.

On the other hand, the low-pressure refrigerant which has flown into the accumulator 146 is separated into gas/liquid, and thereafter the refrigerant gas only enters the refrigerant discharge tube 92 which opens in the accumulator 146. The low-pressure refrigerant gas which has entered the refrigerant introducing tube 92 flows through the suction passage 58, and is sucked on the low-pressure chamber side of the first cylinder 38 of the first rotary compression element 32.

The refrigerant gas sucked on the low-pressure chamber side of the first cylinder 38 is compressed by the operations of the first roller 46 and the first vane 50 to constitute a high-temperature/pressure refrigerant gas, and the gas is discharged to the discharge muffling chamber 62 from the high-pressure chamber side of the first cylinder 38 through a discharge port (not shown). At this time, since the discharge muffling chamber 62 functions as an expanded type muffling chamber, and the discharge muffling chamber 64 functions as a resonant type muffling chamber in the second operation mode, it is further possible to reduce pressure pulsation of the refrigerant compressed by the first rotary compression element 32. Consequently, a muffling effect can be substantially further enhanced in the second operation mode in which the only first rotary compression element 32 performs the compression work.

The refrigerant gas discharged to the discharge muffling chamber 62 is discharged into the sealed container 12 from a hole (not shown) extending through the cup member 63. Thereafter, the refrigerant in the sealed container 12 is discharged to the outside from the refrigerant discharge tube 96 formed in the end cap 12B of the sealed container 12, and flows into the outdoor heat exchanger 152. There, the refrigerant gas emits heat. After the pressure of the gas is reduced by the expansion valve 154, the gas flows into the indoor heat exchanger 156. The refrigerant evaporates in the indoor heat exchanger 156, the heat is absorbed from air circulated in the room to thereby exert a cooling function, and the inside of the room is cooled. Moreover, the refrigerant emanates from the indoor heat exchanger 156 and is sucked by the rotary compressor 10. The refrigerant repeats this cycle.

(3) Switching from Second Operation Mode to First Operation Mode

Figure 4:
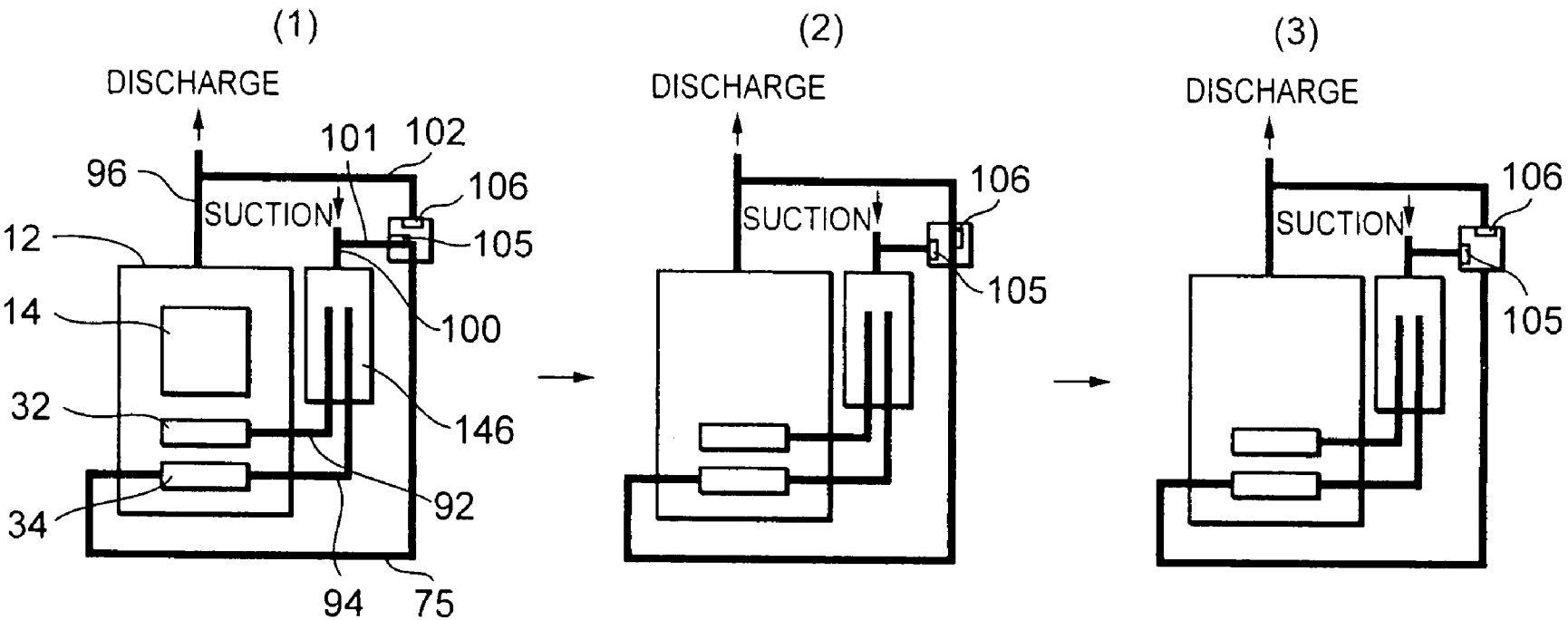
FIG. 4 is a diagram showing a switching operation from a second operation mode to a first operation mode of the multicylinder rotary compressor of FIG. 1.

On the other hand, when the above-described light load state turns to a usual load or high load state in the room, the controller 210 shifts from the second operation mode to the first operation mode. Here, an operation will be described in switching the second operation mode to the first operation mode with reference to FIG. 4. In this case, the controller 210 rotates the electromotive element 14 at a low speed (rotation number of 50 Hz or less), and controls a compression ratio of both the rotary compression elements 32, 34 into 3.0 or less. The controller 210 closes the electromagnetic valve 105 of the refrigerant pipe 101, and opens the electromagnetic valve 106 of the refrigerant pipe 102 (FIG. 4 (2)).

Accordingly, the refrigerant pipe 102 communicates with the pipe 75, discharge-side refrigerants of both the rotary compression elements 32, 34 flow into the back-pressure chamber 72A, and the discharge-side pressures of both the rotary compression elements 32, 34 are applied as the back pressure of the second vane 52.

When the discharge-side pressures of both the rotary compression elements 32, 34 are applied as the back pressure of the second vane 52, the back-pressure chamber 72A of the second vane 52 has a pressure which is remarkably higher than that inside the second cylinder 40. Therefore, the second vane 52 is pushed toward the second roller 48 to follow up the roller by the high pressure of the back-pressure chamber 72A.

Here, when the discharge-side pressures of both the rotary compression elements are applied as the back pressure of the second vane 52 at a switching time, the second vane 52 can be sufficiently pushed out on the side of the second roller 48. That is, when the second operation mode shifts to the first operation mode, the intermediate pressure is applied as the back pressure of the second vane 52 as in the above-described usual operation time in the first operation mode. The intermediate pressure is between the suction-side and discharge-side pressures of both the rotary compression elements 32, 34. At this intermediate pressure, a pressure difference is small between the inside of the second cylinder 40 and the back-pressure chamber 72A. Therefore, much time is required for the second vane 52 to follow up the second roller 48. During this time, a disadvantage has occurred that the second vane 52 collides with the second roller 48, and the collision sound is generated.

However, in the present invention, the discharge-side pressures of both the rotary compression elements 32, 34 are applied as the back pressure of the second vane 52 at the switching time from the second operation mode to the first operation mode. Accordingly, the second vane 52 is sufficiently urged toward the second roller 48 by the discharge-side pressure, and the second roller 48 can follow up in an early stage.

Consequently, at the switching time from the second operation mode to the first operation mode, the follow-up property of the second vane 52 is improved,-the operation efficiency is improved, and it is possible to avoid the generation of the collision sound of the second vane 52.

Moreover, at the switching time, the controller 210 rotates the electromotive element 14 at a low speed (rotation number of 50 Hz or less), and controls the compression ratio of both the rotary compression elements 32, 34 into 3.0 or less. Accordingly, since a pressure fluctuation can be suppressed, an influence is not easily exerted by the pressure fluctuation even in a case where the discharge-side pressures of both the rotary compression elements 32, 34 are applied as the back pressure of the second rotary compression element 34.

It is to be noted that the controller 210 applies the discharge-side pressures of both the rotary compression elements 32, 34 to the second vane 52. After the second vane 52 follows up the second roller 48, the controller applies the intermediate pressure between the suction-side and discharge-side pressures of both the rotary compression elements 32, 34 (FIG. 4 (3)). Accordingly, the pressure fluctuation is remarkably reduced as compared with the application of the discharge-side pressures of both the rotary compression elements 32, 34 to the back pressure of the second vane 52 as described above. Therefore, in the rotary compressor 10 after the switching of the operation mode, the follow-up property of the second vane 52 is improved, the compression efficiency of the second rotary compression element 34 is improved, and it is possible to avoid beforehand the generation of the collision sound between the second vane 52 and the second roller 48 in the first operation mode.

As described above in detail, according to the present invention, the performance and reliability of the compression system CS can be enhanced. The system comprises the rotary compressor 10 which is usable by the switching of the first operation mode in which the first and second rotary compression elements 32, 34 perform the compression work and the second operation mode in which the only first rotary compression element 32 substantially performs the compression work.

Consequently, when the refrigerant circuit of the air conditioner is constituted using the compression system CS, the operation efficiency and performance of the air conditioner are enhanced, and power consumption can be reduced.

Embodiment 2

Figure 5:
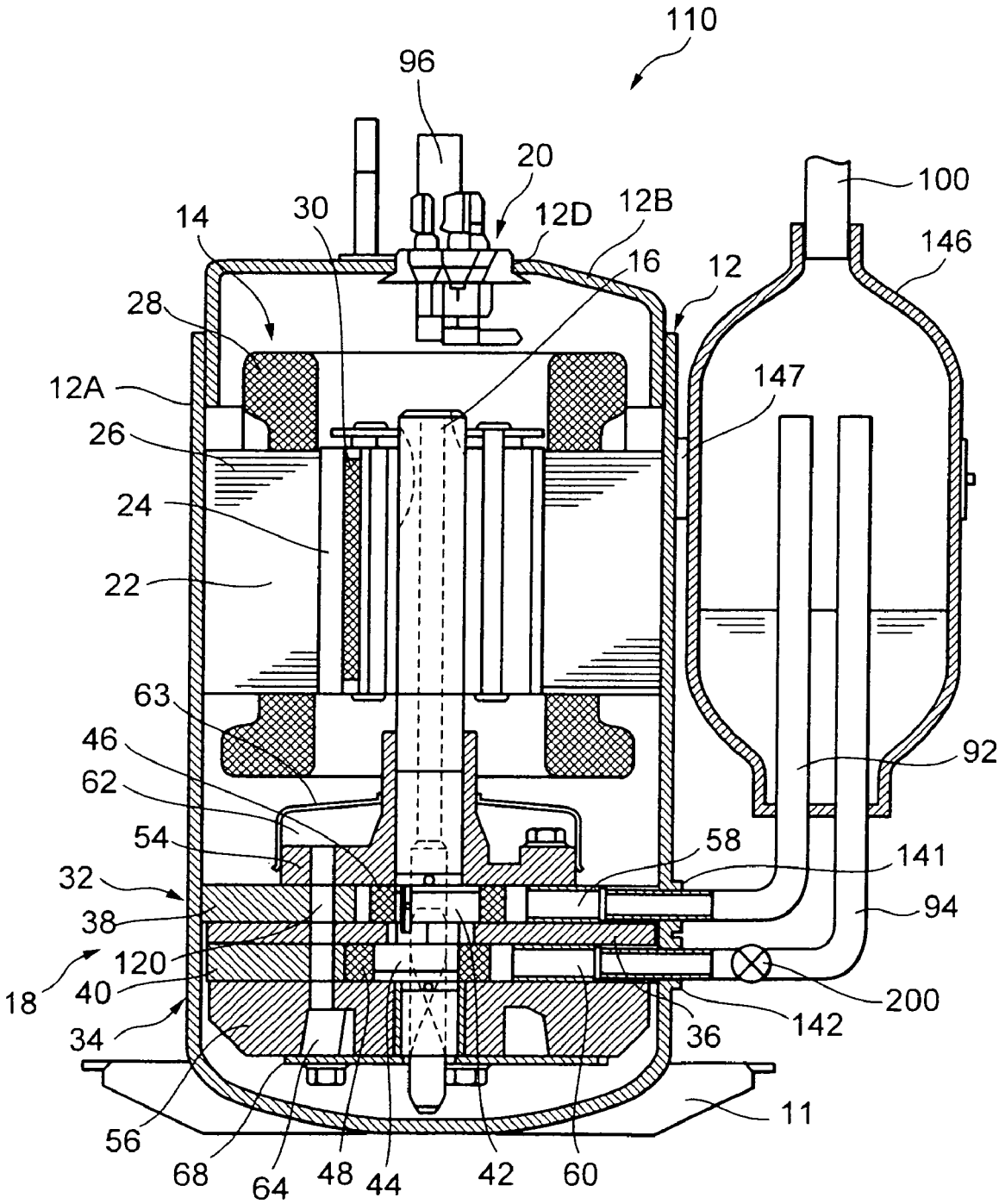
FIG. 5 is a vertically sectional side view of a multicylinder rotary compressor of a compression system according to Embodiment 2 of the present invention.

Next, another embodiment of a compression system CS of the present invention will be described. FIG. 5 shows a vertically sectional side view of an inner high pressure type rotary compressor 110 comprising first and second rotary compression elements, which is a multicylinder rotary compressor of the compression system CS in this embodiment. It is to be noted that, in FIG. 5, when components are denoted with the same reference numerals as those of FIGS. 1 to 4, the components produce the same or similar effects.

In FIG. 5, reference numeral 200 denotes a valve device, and the device is disposed in a middle portion of a refrigerant introducing tube 94 on an inlet side of the sealed container 12 on an outlet side of an accumulator 146. This electromagnetic valve 200 is a valve device for controlling flowing of a refrigerant into a second cylinder 40, and is controlled by the above-described controller 210 which is a control device.

It is to be noted that in the present embodiment, an HFC or HC-based refrigerant is used as a refrigerant in the same manner as in the above-described embodiment. As oils which are lubricants, existing oils are used such as a mineral oil, an alkyl benzene oil, an ether oil, and an ester oil.

Next, an operation of the rotary compressor 110 constituted as described above will be described.

(1) First Operation Mode (Operation at Usual or High Load Time)

First, a first operation mode will be described in which both rotary compression elements 32, 34 perform a compression work. The controller 210 controls a rotation number of an electromotive element 14 of the rotary compressor 110 based on an operation instruction input of an indoor-unit-side controller (not shown) disposed in the above-described indoor unit. Moreover, in a usual or high load indoor state, the controller 210 executes the first operation mode. In this first operation mode, the controller 210 opens the electromagnetic valve 200 of the refrigerant introducing pipe 94, and closes an electromagnetic valve 105 of a refrigerant pipe 101, and an electromagnetic valve 106 of a refrigerant pipe 102.

Moreover, when a stator coil 28 of the electromotive element 14 is energized via a terminal 20 and wiring (not shown), the electromotive element 14 starts, and a rotor 24 rotates. By this rotation, first and second rollers 46, 48 are fitted into upper and lower eccentric portions 42, 44 integrally disposed in a rotation shaft 16, and eccentrically rotate in first and second cylinders 38, 40.

Accordingly, a low-pressure refrigerant flows into the accumulator 146 from a refrigerant pipe 100 of the rotary compressor 110. Since the electromagnetic valve 105 of the refrigerant pipe 100 is closed as described above, all the refrigerant passed through the refrigerant pipe 100 flows into the accumulator 146 without flowing into a pipe 75.

Moreover, the low-pressure refrigerant which has flown into the accumulator 146 is separated into gas/liquid, and thereafter the only refrigerant gas enters refrigerant discharge tubes 92, 94 which open in the accumulator 146. The low-pressure refrigerant gas which has entered the refrigerant introducing tube 92 is passed through a suction passage 58, and sucked on a low-pressure chamber side of the first cylinder 38 of the first rotary compression element 32.

The refrigerant gas sucked on the low-pressure chamber side of the first cylinder 38 is compressed by the operations of a first roller 46 and a first vane 50 to constitute a high-temperature/pressure refrigerant gas. The gas flows through a discharge port (not shown) from the high-pressure chamber side of the first cylinder 38, and is discharged to a discharge muffling chamber 62.

On the other hand, the low-pressure refrigerant gas which has flown into the refrigerant introducing tube 94 is passed through a suction passage 60, and sucked on the low-pressure chamber side of the second cylinder 40 of the second rotary compression element 34. The refrigerant gas sucked on the low-pressure chamber side of the second cylinder 40 is compressed by the operations of the second roller 48 and a second vane 52.

At this time, since the electromagnetic valves 105, 106 are closed as described above, a closed space is formed in the pipe 75 connected to a back-pressure chamber 72A of the second vane 52. Furthermore, since not a little refrigerant in the second cylinder 40 flows into the back-pressure chamber 72A between the second vane 52 and a housing section 70A, a pressure in the back-pressure chamber 72A of the second vane 52 is an intermediate pressure between the suction-side and discharge-side pressures of both the rotary compression elements 32, 34, and the intermediate pressure is applied as the back pressure of the second vane 52. By this intermediate pressure, the second vane 52 can be sufficiently urged toward the second roller 48 without using any spring member.

Consequently, the follow-up property of the second vane 52 is improved in the first operation mode, and the compression efficiency of the second rotary compression element 34 can be enhanced in the same manner as in the above-described embodiment.

It is to be noted that the refrigerant gas is compressed by the operations of the second roller 48 and second vane 52 to obtain a high-temperature/pressure. The gas is passed through a discharge port (not shown) from the high-pressure chamber side of the second cylinder 40, and is discharged to the discharge muffling chamber 64. The refrigerant gas discharged to the discharge muffling chamber 64 is discharged to the discharge muffling chamber 62 via the communication path 120, and flows together with the refrigerant gas compressed by the first rotary compression element 32. Moreover, the joined refrigerant gas is discharged into the sealed container 12 from a hole (not shown) extending through the cup member 63.

Thereafter, the refrigerant in the sealed container 12 is discharged to the outside from the refrigerant discharge tube 96 formed in the end cap 12B of the sealed container 12, and flows into the outdoor heat exchanger 152. In the exchanger, the refrigerant gas emits heat, pressure of the gas is reduced by an expansion valve 154, and thereafter the gas flows into an indoor heat exchanger 156. In the indoor heat exchanger 156, the refrigerant evaporates, the heat is absorbed from air circulated in the room to thereby exert a cooling function, and the inside of the room is cooled. Moreover, the refrigerant emanates from the indoor heat exchanger 156 and is sucked by the rotary compressor 110. The refrigerant repeats this cycle.

(2) Switching from First Operation Mode to Second Operation Mode

Next, when the above-described usual or high load state turns to a light load state in the room, the controller 210 shifts to a second operation mode from the first operation mode.

Here, a switching operation will be described from the first operation mode to the second operation mode with reference to FIG. 6. It is to be noted that at a mode switching time, the controller 210 rotates the electromotive element 14 at a low speed, a rotation number is set, for example, to 50 Hz or less, and a compression ratio of the rotary compression element 32 is controlled into 3.0 or less.

Figure 6:
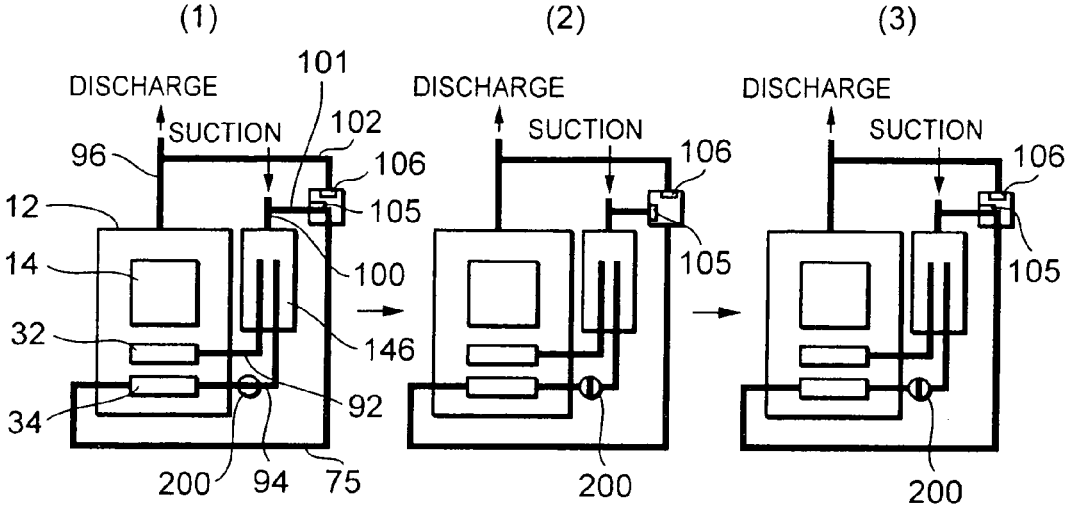
FIG. 6 is a diagram showing a switching operation from the first operation mode to the second operation mode of the multicylinder rotary compressor of FIG. 5.

First, the controller 210 closes the above-described electromagnetic valve 200, and interrupts the flowing of the refrigerant into the second cylinder 40 (FIG. 6 (2)). Accordingly, any compression work is not performed in the second rotary compression element 34. When the refrigerant is inhibited from being passed into the second cylinder 40, a pressure in the second cylinder 40 is slightly higher than a suction-side pressure of both the rotary compression elements 32, 34 (the second roller 48 rotates, a high pressure in the sealed container 12 slightly flows from a gap of the second cylinder 40 or the like, and therefore the pressure in the second cylinder 40 becomes slightly higher than the suction-side pressure).

It is to be noted that in the first operation mode, the pressure in the back-pressure chamber 72A is an intermediate pressure between the suction-side and discharge-side pressures of both the rotary compression elements 32, 34 as described above. Therefore, the pressure in the second cylinder 40 is substantially equal to that in the back-pressure chamber 72A of the second vane 52.

Moreover, the controller 210 opens the electromagnetic valve 105 of the refrigerant pipe 101. It is to be noted that the electromagnetic valve 106 of the refrigerant pipe 102 remains to be closed (FIG. 6 (3)). Accordingly, the refrigerant pipe 101 communicates with the pipe 75, the suction-side refrigerant of the first rotary compression element 32 flows into the back-pressure chamber 72A, and the suction-side pressure of the first rotary compression element 32 is applied as the back pressure of the second vane 52.

Accordingly, the refrigerant passes through the refrigerant pipe 100 on the suction side of the first rotary compression element 32, and a part of the refrigerant flows into the back-pressure chamber 72A from the refrigerant pipe 101 via the pipe 75. Accordingly, the back-pressure chamber 72A has a suction-side pressure of the first rotary compression element 32, and the suction-side pressure of the first rotary compression element 32 is applied as the back pressure of the second vane 52.

As described above, the pressure of the second cylinder 40 is higher than the suction-side pressure of the first rotary compression element 32. Therefore, when the suction-side pressure of the first rotary compression element 32 is applied as the back pressure of the second vane 52, the pressure in the back-pressure chamber 72A of the second vane 52 is higher than that of the second cylinder 40. Therefore, the second vane 52 is pushed toward the back-pressure chamber 72A on a side opposite to the second roller 48 by the pressure in the second cylinder 40, and housed in the guide groove 72. Consequently, at the switching time to the second operation mode, the second vane 52 can be retracted from the inside of the second cylinder 40, and housed in the guide groove 72 in an early stage. Therefore, it is possible to avoid beforehand a disadvantage that the second vane 52 collides with the second roller 48, and the collision sound is generated.

(3) Second Operation Mode

Next, an operation of the rotary compressor 110 will be described in a second operation mode. The low-pressure refrigerant flows into the accumulator 146 from the refrigerant pipe 100 of the rotary compressor 110. After the refrigerant is separated into the gas/liquid in the accumulator, the only refrigerant gas enters the refrigerant discharge tube 92 which opens in the accumulator 146. The low-pressure refrigerant gas which has entered the refrigerant introducing tube 92 flows through the suction passage 58, and is sucked on the low-pressure chamber side of the first cylinder 38 of the first rotary compression element 32.

The refrigerant gas sucked on the low-pressure chamber side of the first cylinder 38 is compressed by the operations of the first roller 46 and the first vane 50 to constitute a high-temperature/pressure refrigerant gas. The gas is discharged to the discharge muffling chamber 62 from the high-pressure chamber side of the first cylinder 38 through a discharge port (not shown). The refrigerant gas discharged to the discharge muffling chamber 62 is discharged into the sealed container 12 from a hole (not shown) extending through the cup member 63.

Thereafter, the refrigerant in the sealed container 12 is discharged to the outside from the refrigerant discharge tube 96 formed in the end cap 12B of the sealed container 12, and flows into the outdoor heat exchanger 152. In the exchanger, the refrigerant gas emits heat. After the pressure of the gas is reduced by the expansion valve 154, the gas flows into the indoor heat exchanger 156. In the exchanger, the refrigerant evaporates. At this time, the heat is absorbed from air circulated in the room to exert a cooling function, and the inside of the room is cooled. Moreover, the refrigerant emanates from the indoor heat exchanger 156 and is sucked into the rotary compressor 110, and this cycle is repeated.

It is to be noted that in the second operation mode, the controller 210 closes the above-described electromagnetic valve 200. The operation is performed while stopping the flowing of the refrigerant into the second cylinder 40. Accordingly, in the second operation mode, the pressure in the second cylinder 40 is kept to be higher than the back pressure of the second vane 52. Therefore, the second vane 52 is pushed toward the back-pressure chamber 72A opposite to the second roller 48 by the pressure in the second cylinder 40, and the vane does not come into the second cylinder 40. Consequently, it is possible to avoid beforehand a disadvantage that the second vane 52 comes into the second cylinder 40 during the operation in the second operation mode, the vane collides with the second roller 48, and the collision sound is generated.

(4) Switching from Second Operation Mode to First Operation Mode

Figure 7:
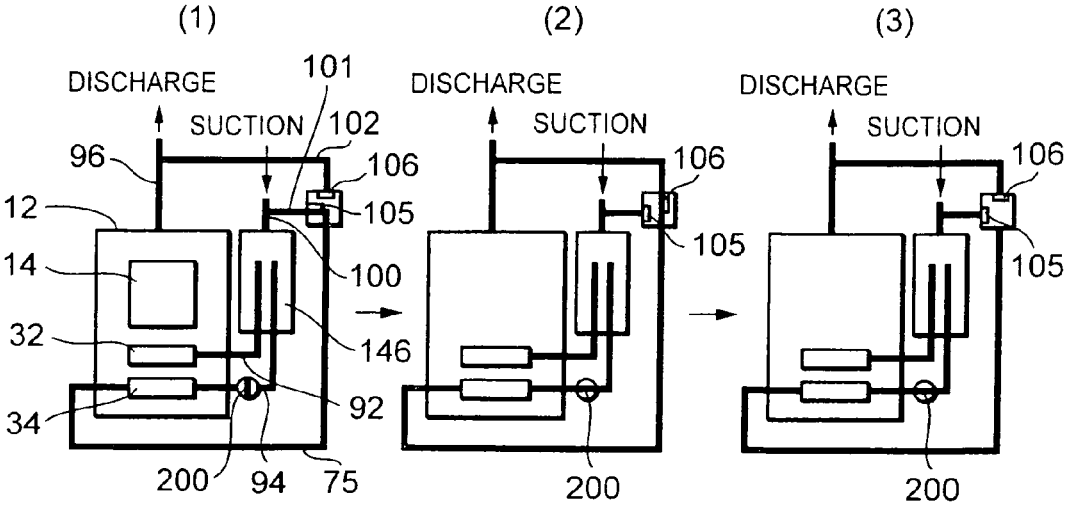
FIG. 7 is a diagram showing a switching operation from the second operation mode to the first operation mode of the multicylinder rotary compressor of FIG. 5.

On the other hand, when the above-described light load state turns to a usual or high load state in the room, the controller 210 shifts from the second operation mode to the first operation mode. Here, an operation will be described in switching the second operation mode to the first operation mode with reference to FIG. 7. In this case, the controller 210 opens the electromagnetic valve 200 and allows the refrigerant to flow into the second cylinder 40. Moreover, the controller closes the electromagnetic valve 105 of the refrigerant pipe 101, and opens the electromagnetic valve 106 of the refrigerant pipe 102 (FIG. 7 (2)).

Accordingly, the refrigerant pipe 102 communicates with the pipe 75, discharge-side refrigerants of both the rotary compression elements 32, 34 flow into the back-pressure chamber 72A, and the discharge-side pressures of both the rotary compression elements 32, 34 are applied as the back pressure of the second vane 52.

When the discharge-side pressures of both the rotary compression elements 32, 34 are applied as the back pressure of the second vane 52, the back-pressure chamber of the second vane 52 has a pressure which is remarkably higher than that inside the second cylinder 40. Therefore, the second vane 52 is pushed toward the second roller 48 to follow up the roller by the high pressure of the back-pressure chamber 72A.

Here, when the discharge-side pressures of both the rotary compression elements are applied as the back pressure of the second vane 52 at a switching time, the second vane 52 can be sufficiently pushed out on the side of the second roller. That is, when the second operation mode shifts to the first operation mode, the intermediate pressure is applied as the back pressure of the second vane 52 as in the above-described usual operation time in the first operation mode. The intermediate pressure is between the suction-side and discharge-side pressures of both the rotary compression elements 32, 34. At this intermediate pressure, a pressure difference is small between the inside of the second cylinder 40 and the back-pressure chamber 72A. Therefore, much time is required for the second vane 52 to follow up the second roller 48. During this time, a disadvantage has occurred that the second vane 52 collides with the second roller 48, and the collision sound is generated.

However, in the present invention, the discharge-side pressures of both the rotary compression elements 32, 34 are applied as the back pressure of the second vane 52 at the switching time from the second operation mode to the first operation mode. Accordingly, the second vane 52 is sufficiently urged toward the second roller 48 by the discharge-side pressure, and the second roller 48 can follow up in an early stage.

Consequently, at the switching time from the second operation mode to the first operation mode, the follow-up property of the second vane 52 is improved, the operation efficiency is improved, and it is possible to avoid the generation of the collision sound of the second vane 52.

Moreover, at the switching time, the controller 210 rotates the electromotive element 14 at a low speed (rotation number of 50 Hz or less), and controls the compression ratio of both the rotary compression elements 32, 34 into 3.0 or less. Accordingly, since a pressure fluctuation can be suppressed, an influence is not easily exerted by the pressure fluctuation even in a case where the discharge-side pressures of both the rotary compression elements 32, 34 are applied as the back pressure of the second rotary compression element 34.

It is to be noted that the controller 210 applies the discharge-side pressures of both the rotary compression elements 32, 34 to the second vane 52. After the second vane 52 follows up the second roller 48, the controller closes the electromagnetic valve 106 (FIG. 7 (3)), and applies the intermediate pressure between the suction-side and discharge-side pressures of both the rotary compression elements 32, 34. Accordingly, the pressure fluctuation is remarkably reduced as compared with the application of the discharge-side pressures of both the rotary compression elements 32, 34 to the back pressure of the second vane 52 as described above. Therefore, in the rotary compressor 110 after the switching of the operation mode, the follow-up property of the second vane 52 Is improved, the compression efficiency of the second rotary compression element 34 is improved, and it is possible to avoid beforehand the generation of the collision sound between the second vane 52 and the second roller 48 in the first operation mode.

As described above in detail, also in the present embodiment, the performance and reliability of the compression system CS can be enhanced. The system comprises the rotary compressor 110 which is usable by the switching of the first operation mode in which the first and second rotary compression elements 32, 34 perform the compression work and the second operation mode in which the only first rotary compression element 32 substantially performs the compression work.

Consequently, when the refrigerant circuit of the air conditioner is constituted using the compression system CS, the operation efficiency and performance of the air conditioner are enhanced, and power consumption can be reduced.

Embodiment 3

It has been described in the above-described embodiments that an HFC or HC-based refrigerant is used as a refrigerant, but a refrigerant having a large high/low pressure difference may be used such as carbon dioxide. For example, a combination of carbon dioxide and polyalkyl glycol (PAG) may be used as the refrigerant. In this case, since the refrigerant compressed by rotary compression elements 32 and 34 has a very high pressure, there is a possibility that a cup member 63 is broken by the high pressure in a case where a discharge muffling chamber 62 is formed into a shape to cover an upper support member 54 with the cup member 63 as in the respective embodiments.

Figure 8:
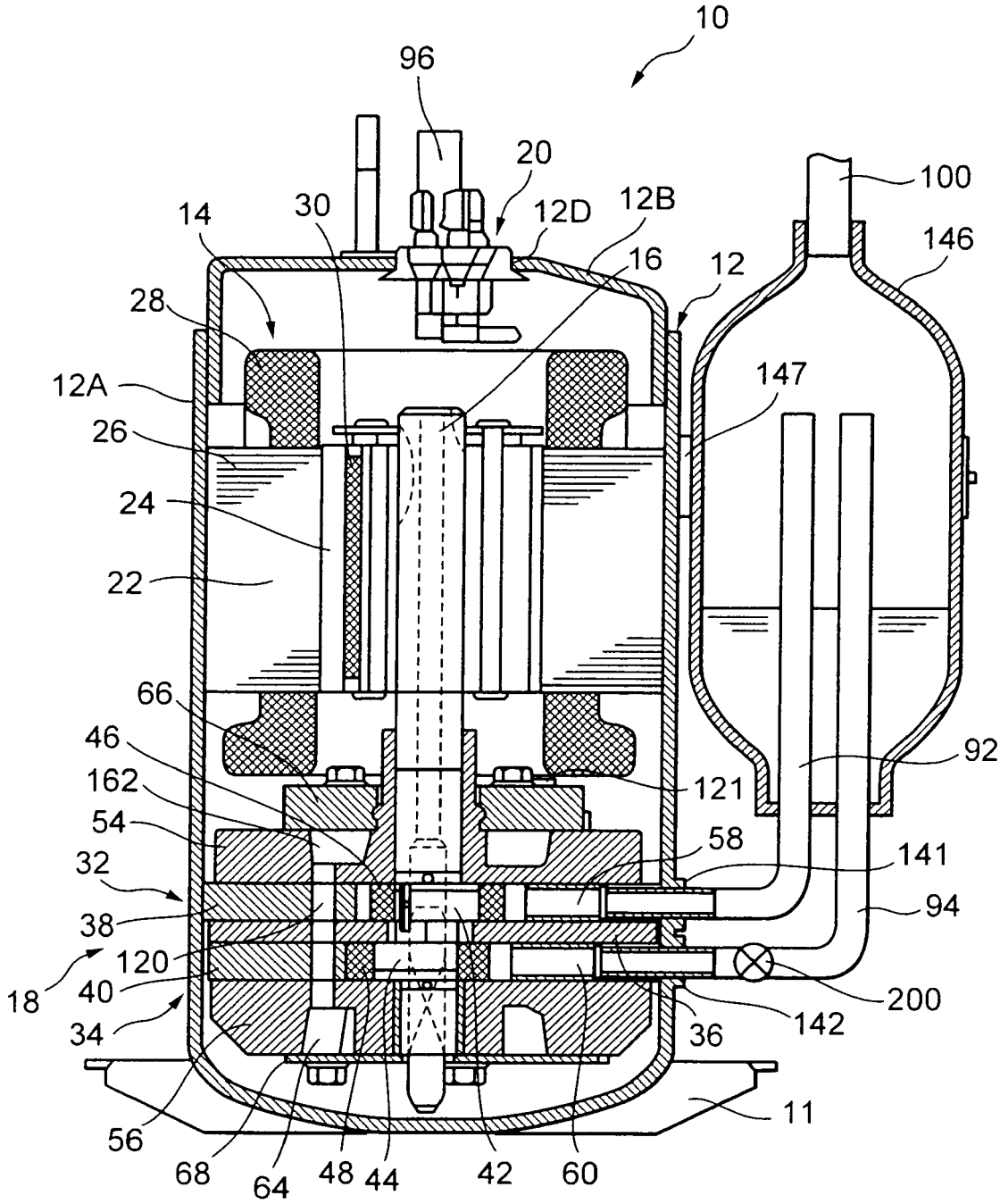
FIG. 8 is a vertically sectional side view of a multicylinder rotary compressor of a compression system according to Embodiment 3 of the present invention.

Therefore, when the discharge muffling chamber is formed into a shape shown in FIG. 8, resistance to pressure can be secured. The chamber is above the upper support member 54 in which refrigerants compressed by both the rotary compression elements 32, 34 flow together. That is, in a discharge muffling chamber 162 of FIG. 8, a depressed portion is formed in an upper part of the upper support member 54, and the depressed portion is closed by an upper cover 66 which is a cover to constitute the chamber. Consequently, the present invention is applicable even to a case where a refrigerant having a large high/low pressure difference is contained like carbon dioxide.

Embodiment 4

Next, an operation will be described at the time of starting of a compression system CS in the present invention. It is to be noted that the present embodiment uses the same compression system CS, multicylinder rotary compressor, and refrigerant circuit as those used in Embodiment 1 of FIGS. 1 to 3. Therefore, description of these constitutions is omitted. It is to be noted that an HFC or HC-based refrigerant is used as a refrigerant for use in the same manner as in the above-described embodiments. As oils which are lubricants, existing oils are used such as a mineral oil, an alkyl benzene oil, an ether oil, and an ester oil.

Here, an operation will be described in starting a rotary compressor 10 of the present embodiment with reference to FIG. 9. A controller 210 energizes an electromotive element 14 of a rotary compressor 10 based on an operation instruction input of an indoor-unit-side controller (not shown) disposed in the above-described indoor unit. At this time, simultaneously with the energization of the electromotive element 14, the controller 210 opens an electromagnetic valve 105 of a refrigerant pipe 101, and closes an electromagnetic valve 106 of a refrigerant pipe 102 (FIG. 9 (1)). Accordingly, the refrigerant pipe 101 communicates with a pipe 75. The controller 210 controls a rotation number of the electromotive element 14 of the rotary compressor 10 to start the compressor in a state in which suction-side pressures of both rotary compression elements 32, 34 are applied as a back pressure of a second vane 52.

Moreover, when a stator coil 28 of the electromotive element 14 is energized via a terminal 20 and wiring (not shown), the electromotive element 14 starts, and a rotor 24 rotates. By this rotation, first and second rollers 46, 48 are fitted into upper and lower eccentric portions 42, 44 integrally disposed in a rotation shaft 16, and eccentrically rotate in first and second cylinders 38, 40.

Accordingly, the refrigerant flows into an accumulator 146 from a refrigerant pipe 100 of the rotary compressor 10. Since the electromagnetic valve 105 of the refrigerant pipe 101 is opened as described above, a part of the refrigerant passed through the refrigerant pipe 100 on suction sides of both rotary compression elements 32, 34 flows into a back-pressure chamber 72A via the refrigerant pipe 101 and the pipe 75.

On the other hand, the refrigerant which has flown into the accumulator 146 is separated into gas/liquid in the accumulator. Thereafter, an only refrigerant gas enters a refrigerant introducing tube 92 which opens in the accumulator 146. The refrigerant gas which has entered the refrigerant introducing tube 92 is sucked on a low-pressure chamber side of the first cylinder 38 of the first rotary compression element 32 via a suction passage 58.

The refrigerant gas sucked on the low-pressure chamber side of the first cylinder 38 is compressed by operations of the first roller 46 and a first vane 50 to constitute a high-temperature/pressure refrigerant gas. The gas passes through a discharge port (not shown) from a high-pressure chamber side of the first cylinder 38, and is discharged to a discharge muffling chamber 62. The refrigerant gas discharged to the discharge muffling chamber 62 is discharged into a sealed container 12 from a hole (not shown) extending through a cup member 63.

Here, there is an equilibrium pressure in a refrigerant circuit at a starting time of the rotary compressor 10. That is, after stopping the previous operation of the rotary compressor 10, the pressure is gradually equalized. After elapse of a predetermined time, the inside of the refrigerant circuit has the equilibrium pressure. Therefore, when the rotary compressor 10 is started in a state in which the inside of the refrigerant circuit is brought into the equilibrium pressure, immediately after starting the rotary compressor 10, the equilibrium pressure is substantially indicated by pressures of suction-side refrigerants of both the rotary compression elements 32, 34. The pressures are applied as a back pressure of the second vane 52. Similarly, the pressure inside the second cylinder 40 also indicates a substantially equilibrium pressure. Therefore, since the second vane 52 cannot be urged toward the second roller 48, the compression work is not substantially performed in the second rotary compression element 34, and the compression work of the refrigerant is performed only by the first rotary compression element 32 provided with a spring 74.

Thereafter, the refrigerant in the sealed container 12 is discharged to the outside from a refrigerant discharge tube 96 formed in an end cap 12B of the sealed container 12, and flows into an outdoor heat exchanger 152. In the exchanger, the refrigerant gas emits heat, pressure of the gas is reduced by an expansion valve 154, and thereafter the gas flows into an indoor heat exchanger 156. The refrigerant which has flown into the indoor heat exchanger 156 evaporates in the exchanger, heat is absorbed from air circulated in a room to thereby exert a cooling function, and the inside of the room is cooled. Moreover, the refrigerant emanates from the indoor heat exchanger 156 and is sucked by the rotary compressor 10. The refrigerant repeats this cycle.

On the other hand, when the rotary compressor 10 starts, and a predetermined time elapses, a high/low pressure difference is constituted in the refrigerant circuit, and a state in the refrigerant circuit is stabilized. It is to be noted that, at this time, the pressures of the suction-side refrigerants of both the rotary compression elements 32, 34 are low which are applied as the back pressure of the second vane 52, but the second vane 52 cannot be urged toward the second roller 48 at this low pressure, and therefore the compression work is substantially performed only by the first rotary compression element 32.

Figure 9:
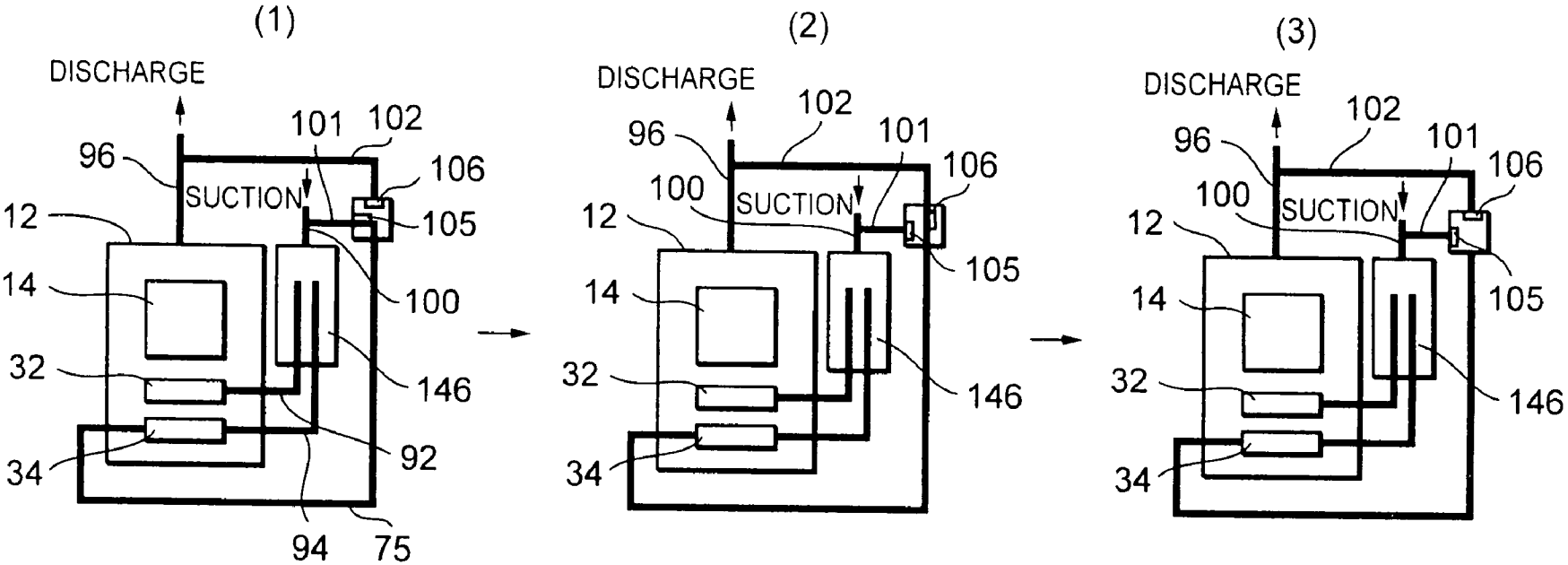
FIG. 9 is a diagram showing an operation of each electromagnetic valve in the second operation mode of a multicylinder rotary compressor of a compression system according to Embodiment 5 of the present invention.

Here, when the rotary compressor 10 starts, and a predetermined time elapses, as shown in FIG. 9 (2), the controller 210 closes the electromagnetic valve 105 of the refrigerant pipe 101, and opens the electromagnetic valve 106 of the refrigerant pipe 102. Accordingly, the refrigerant pipe 102 communicates with the pipe 75, and all the refrigerant flowing through the refrigerant pipe 100 of the rotary compressor 10 flows into the accumulator 146.

Moreover, a part of the refrigerant discharged to the refrigerant discharge tube 96 from the sealed container 12 flows into the back-pressure chamber 72A from the refrigerant pipe 102 through the pipe 75. Accordingly, the back-pressure chamber 72A has discharge-side pressures of both the rotary compression elements 32, 34, and the discharge-side pressures of both the rotary compression elements 32, 34 are applied as the back pressure of the second vane 52.

When the discharge-side pressures of both the rotary compression elements 32, 34 are applied as the back pressure of the second vane 52, the back-pressure chamber of the second vane 52 has a pressure which is remarkably higher than that in the second cylinder 40. Therefore, the second vane 52 is urged toward the second roller 48 to follow up the roller by the high pressure of the back-pressure chamber 72A, and the compression work is started in the second rotary compression element 34.

That is, the only refrigerant gas separated into the gas/liquid in the accumulator 146 enters the respective refrigerant discharge tubes 92, 94 which open In the accumulator 146. The low-pressure refrigerant gas which has entered the refrigerant introducing tube 92 flows through the suction passage 58, and is sucked on the low-pressure chamber side of the first cylinder 38 of the first rotary compression element 32 as described above.

The refrigerant gas sucked on the low-pressure chamber side of the first cylinder 38 is compressed by the operations of the first roller 46 and the first vane 50 to constitute a high-temperature/pressure refrigerant gas, and the gas is discharged to the discharge muffling chamber 62 from the high-pressure chamber side of the first cylinder 38 through a discharge port (not shown).

On the other hand, the low-pressure refrigerant gas which has entered the refrigerant introducing tube 94 flows through the suction passage 60, and is sucked on the low-pressure pressure chamber side of the second cylinder 40 of the second rotary compression element 34. The refrigerant gas sucked on the low-pressure chamber side of the second cylinder 40 is compressed by the operations of the second roller 48 and the second vane 52.

Here, the controller 210 closes the electromagnetic valve 105, opens the electromagnetic valve 106, and starts the rotary compressor 10 in a state in which the discharge-side pressures of both the rotary compression elements 32, 34 are applied as the back pressure of the second vane 52. In this case, the pressure in the refrigerant circuit immediately after the starting is a substantially equilibrium pressure as described above. Therefore, even when the electromagnetic valve 106 is opened, the pressure applied as the back pressure of the second vane 52 is the equilibrium pressure, and much time is required until the discharge-side pressures of both the rotary compression elements 32, 34 reach high pressures. Therefore, the second vane 52 cannot follow up the second roller 48 until the discharge-side pressures of both the rotary compression elements 32, 34 rise to a certain degree.

Moreover, immediately after the starting, the state in the refrigerant circuit is unstable. Therefore, pulsations of the discharge-side pressures of both the rotary compression elements 32, 34 also remarkably increase. Therefore, when the compressor is started in a state in which the discharge-side pressures of both the rotary compression elements 32, 34 are applied, disadvantages have occurred that a follow-up property of the second vane 52 is deteriorated by the pulsations of the discharge-side pressures of both the rotary compression elements 32, 34, the second vane 52 collides with the second roller 48, and a collision sound is generated.

However, as in the present invention, the electromagnetic valve 105 is opened, the compressor is started in a state in which the suction-side pressures of both the rotary compression elements 32, 34 are applied, the second vane 52 is not allowed to follow up the second roller 48, and the compression work in the second rotary compression element 34 is substantially invalidated. Moreover, when the compressor is started, and the inside of the refrigerant circuit is stabilized, the discharge-side pressures of both the rotary compression elements 32, 34 are applied, and the second vane 52 is urged toward the second roller 48 to follow up the first cylinder 38 by the discharge-side pressures. Consequently, the above-described disadvantages can be avoided, and the follow-up property of the second vane 52 can be improved at the starting time.

Consequently, the operation efficiency of the rotary compressor 10 is improved, and it is possible to avoid the generation of the collision sound of the second vane 52.

It is to be noted that the refrigerant gas is compressed by the operations of the second roller 48 and the second vane 52 to have a high-temperature/pressure, the gas passes through the discharge port (not shown) from the high-pressure chamber side of the second cylinder 40, and is discharged to the discharge muffling chamber 64. The refrigerant gas discharged to the discharge muffling chamber 64 is discharged to the discharge muffling chamber 62 via the communication path 120, and the gas joins the refrigerant gas compressed by the first rotary compression element 32. Moreover, the joint refrigerant gas is discharged into the sealed container 12 via a hole (not shown) extending through the cup member 63.

Thereafter, the refrigerant in the sealed container 12 is discharged to the outside from the refrigerant discharge tube 96 formed in the end cap 12B of the sealed container 12, and flows into the outdoor heat exchanger 152. The discharge-side refrigerants of both the rotary compression elements 32, 34 pass through the refrigerant discharge tube 96. Since the electromagnetic valve 106 is opened as described above, a part of the refrigerant flows into the back-pressure chamber 72A from the refrigerant pipe 102 via the pipe 75. Accordingly, the discharge-side pressures of both the rotary compression elements 32, 34 are applied as the back pressure of the second vane 52.

On the other hand, the refrigerant gas which has flown into the outdoor heat exchanger 152 emits heat in the exchanger, the pressure of the gas is reduced by the expansion valve 154, and thereafter the gas flows into the indoor heat exchanger 156. The refrigerant evaporates in the indoor heat exchanger 156, the heat is absorbed from air circulated in the room to thereby exert a cooling function, and the inside of the room is cooled. Moreover, the refrigerant emanates from the indoor heat exchanger 156 and is sucked by the rotary compressor 10. The refrigerant repeats this cycle.

On the other hand, when the discharge-side pressures of both the rotary compression elements 32, 34 are applied, and the second vane 52 follows up the second roller 48, the controller 210 thereafter closes the electromagnetic valve 106 (FIG. 9 (3)). Accordingly, a closed space is formed in the pipe 75 connected to the back-pressure chamber 72A of the second vane 52. Here, since not a little refrigerant in the second cylinder 40 flows into the back-pressure chamber 72A between the second vane 52 and the housing section 70A, the pressure in the back-pressure chamber 72A of the second vane 52 is an intermediate pressure between the suction-side and discharge-side pressures of both the rotary compression elements 32, 34, and the intermediate pressure is applied as the back pressure of the second vane 52. By this intermediate pressure, the second vane 52 can be sufficiently urged toward the second roller 48 without using any spring member.

Here, when a high pressure continues to be applied as the back pressure of the second vane 52, the discharge-side pressure has large pulsation. The high pressure corresponds to the discharge-side pressures of both the rotary compression elements 32, 34. Additionally, since any spring member is not disposed in the second rotary compression element 34, this pulsation causes a problem that the follow-up property of the second vane 52 is deteriorated, the compression efficiency drops, and the collision sound is generated between the second vane 52 and the second roller 48.

Moreover, the rotary compressor 10 is started, and the intermediate pressure is applied as the second vane 52 without applying the high pressure corresponding to the discharge-side pressure of both the rotary compression elements 32, 34. The intermediate pressure is between the suction-side and discharge-side pressures of both the rotary compression elements 32, 34. With this intermediate pressure, a pressure difference is small between the inside of the second cylinder 40 and the back-pressure chamber 72A. Therefore, much time is required for the second vane 52 to follow up the second roller 48. During this time, a disadvantage occurs that the second vane 52 collides with the second roller 48, and the collision sound is generated.

Therefore, the discharge-side pressures of both the rotary compression elements 32, 34 are applied as the back pressure of the second vane 52. The second vane 52 is urged toward the second roller 48 to follow up the second roller 48 by the discharge-side pressure. Thereafter, the back-pressure chamber 72A is brought into the intermediate pressure between the suction-side and discharge-side pressures of both the rotary compression elements 32, 34. Consequently, the follow-up property of the second vane 52 is improved, the compression efficiency of the second rotary compression element 34 is improved, and it is possible to avoid beforehand the generation of the collision sound between the second vane 52 and the second roller 48 at the starting time.

It is to be noted that in the present embodiment, simultaneously with the energization of the electromotive element 14, the controller 210 exerts a control in such a manner as to open the electromagnetic valve 105 and close the electromagnetic valve 106. The electromagnetic valves 105, 106 may be opened/closed before starting the rotary compressor 10. For example, the controller 210 may open the electromagnetic valve 105, and close the electromagnetic valve 106 before the energization of the electromotive element 14.

Moreover, since operations similar to those of Embodiment 1 are performed in the first operation mode performed at the usual or high load time and the second operation mode performed at the light load time, description thereof is omitted.

Embodiment 5

Furthermore, in a compression system CS of the present invention, an electromagnetic valve 200 is disposed in a middle portion of a refrigerant introducing tube 94 on an inlet side of a sealed container 12 on an outlet side of an accumulator 146 as shown in FIG. 5 of Embodiment 2, and the electromagnetic valve 200 may be controlled by a controller 210.

When the electromagnetic valve 200 is disposed in the refrigerant introducing tube 94 in this manner, the electromagnetic valve is closed at a starting time, flowing of a refrigerant into a second rotary compression element 34 is completely interrupted, an electromagnetic valve 106 of a refrigerant pipe 102 is opened, and the electromagnetic valve 200 is opened. Even in this case, the present invention is effective.

Moreover, the system is operated in a state in which the controller 210 closes the electromagnetic valve 200 to stop the flowing of the refrigerant into a second cylinder 40 in a second operation mode. Accordingly, a pressure inside the second cylinder 40 can be set to be higher than a suction-side pressure of a first rotary compression element 32.

It is to be noted that in the present embodiment, an HFC or HC-based refrigerant is used as a refrigerant in the same manner as in the above-described embodiments. As oils which are lubricants, existing oils are used such as a mineral oil, an alkyl benzene oil, an ether oil, and an ester oil.

An operation in this case will be described. The controller 210 closes the above-described electromagnetic valve 200 to stop the flowing of the refrigerant into the second cylinder 40. Accordingly, any compression work is not performed in the second rotary compression element 34. When the flowing of the refrigerant into the second cylinder 40 is stopped, the pressure in the second cylinder 40 is slightly higher than the suction-side pressures of both the rotary compression elements 32, 34 (since a second roller 48 rotates, and a high pressure in the sealed container 12 slightly flows via a gap of the second cylinder 40, the pressure in the second cylinder 40 becomes slightly higher than the suction-side pressure).

Moreover, the controller 210 opens an electromagnetic valve 105 of a refrigerant pipe 101, and closes an electromagnetic valve 106 of a refrigerant pipe 102. Accordingly, the refrigerant pipe 101 communicates with a pipe 75, the suction-side refrigerant of the first rotary compression element 32 flows into a back-pressure chamber 72A, and the suction-side pressure of the first rotary compression element 32 is applied as a back pressure of a second vane 52.

Furthermore, the refrigerant passes through a refrigerant pipe 100 of a rotary compressor 110 on a suction side of the first rotary compression element 32, and a part of the refrigerant flows into a back-pressure chamber 72A from the refrigerant pipe 101 via a pipe 75. Accordingly, the back-pressure chamber 72A has the suction-side-pressure of the first rotary compression element 32, and the suction-side pressure of the first rotary compression element 32 is applied as the back pressure of the second vane 52.

Here, the electromagnetic valve 200 is closed to stop the flowing of the refrigerant into the second cylinder 40, and the pressure in the second cylinder 40 is set to be higher than the suction-side pressure of the first rotary compression element 32. In this case, when the suction-side pressure of the first rotary compression element 32 is applied as the back pressure of the second vane 52, the pressure in the second cylinder 40 becomes higher than the back pressure of the second vane 52. Therefore, the second vane 52 is pushed toward the back-pressure chamber 72A opposite to the second roller 48 by the pressure in the second cylinder 40, and the vane does not come into the second cylinder 40. Consequently, it is possible to avoid beforehand a disadvantage that the second vane 52 comes into the second cylinder 40 to collide with the second roller 48, and a collision sound is generated.

On the other hand, the low-pressure refrigerant which has flown into the accumulator 146 is separated into gas/liquid in the accumulator. Thereafter, an only refrigerant gas enters a refrigerant introducing tube 92 which opens in the accumulator 146. The low-pressure refrigerant gas which has entered the refrigerant introducing tube 92 is sucked on a low-pressure chamber side of a first cylinder 38 of the first rotary compression element 32 via a suction passage 58.

The refrigerant gas sucked on the low-pressure chamber side of the first cylinder 38 is compressed by operations of the first roller 46 and a first vane 50 to constitute a high-temperature/pressure refrigerant gas. The gas passes through a discharge port (not shown) from a high-pressure chamber side of the first cylinder 38, and is discharged to a discharge muffling chamber 62. The refrigerant gas discharged to the discharge muffling chamber 62 is discharged into the sealed container 12 from a hole (not shown) extending through a cup member 63.

Thereafter, the refrigerant in the sealed container 12 is discharged to the outside from a refrigerant discharge tube 96 formed in an end cap 12B of the sealed container 12, and flows into an outdoor heat exchanger 152. The refrigerant gas emits heat in the exchanger, the pressure of the gas is reduced by an expansion valve 154, and thereafter the gas flows into an indoor heat exchanger 156. The refrigerant evaporates in the indoor heat exchanger 156, the heat is absorbed from air circulated in a room to thereby exert a cooling function, and the inside of the room is cooled. Moreover, the refrigerant emanates from the indoor heat exchanger 156 and is sucked by the rotary compressor 110. The refrigerant repeats this cycle.

As described above, the electromagnetic valve 200 is disposed in the middle portion of the refrigerant introducing tube 94, and the compressor is operated in a state in which the controller 210 closes the electromagnetic valve 200 to stop the flowing of the refrigerant into the second cylinder 40 in the second operation mode. Accordingly, in the second operation mode, the pressure in the second cylinder 40 is kept to be higher than the back pressure of the second vane 52. Therefore, the second vane 52 is pushed toward the back-pressure chamber 72A opposite to the second roller 48 by the pressure in the second cylinder 40, and the vane does not come into the second cylinder 40. Consequently, it is possible to avoid beforehand the disadvantage that the second vane 52 comes into the second cylinder 40 to collide with the second roller 48, and the collision sound is generated during the operation in the second operation mode.

As described above in detail, according to the present invention, the performance and reliability of a compression system CS can be enhanced. The system comprises the rotary compressor 110 which is usable by the switching of the first operation mode in which the first and second rotary compression elements 32, 34 perform the compression work and the second operation mode in which the only first rotary compression element 32 substantially performs the compression work.

Consequently, when the refrigerant circuit of the air conditioner is constituted using the compression system CS, the operation efficiency and performance of the air conditioner are enhanced, and power consumption can be reduced.

Embodiment 6

Moreover, it has been described in Embodiments 4 and 5 described above that an HFC or HC-based refrigerant is used as a refrigerant, but a refrigerant having a large high/low pressure difference may be used such as carbon dioxide. For example, a combination of carbon dioxide and polyalkyl glycol (PAG) may be used as the refrigerant. In this case, since the refrigerant compressed by rotary compression elements 32 and 34 has a very high pressure, there is a possibility that a cup member 63 is broken by the high pressure in a case where a discharge muffling chamber 62 is formed into a shape to cover an upper support member 54 with the cup member 63 as in the respective embodiments.

Therefore, when the discharge muffling chamber is formed into a shape shown in FIG. 8, resistance to pressure can be secured. The chamber is above the upper support member 54 in which the refrigerant compressed by both the rotary compression elements 32, 34 flows together. That is, in a discharge muffling chamber 162 of FIG. 8, a depressed portion is formed in an upper part of the upper support member 54, and the depressed portion is closed by an upper cover 66 which is a cover to constitute the chamber. Consequently, the present invention is applicable even to a case where a refrigerant having a large high/low pressure difference is contained like carbon dioxide.

Embodiment 7

Figure 10:
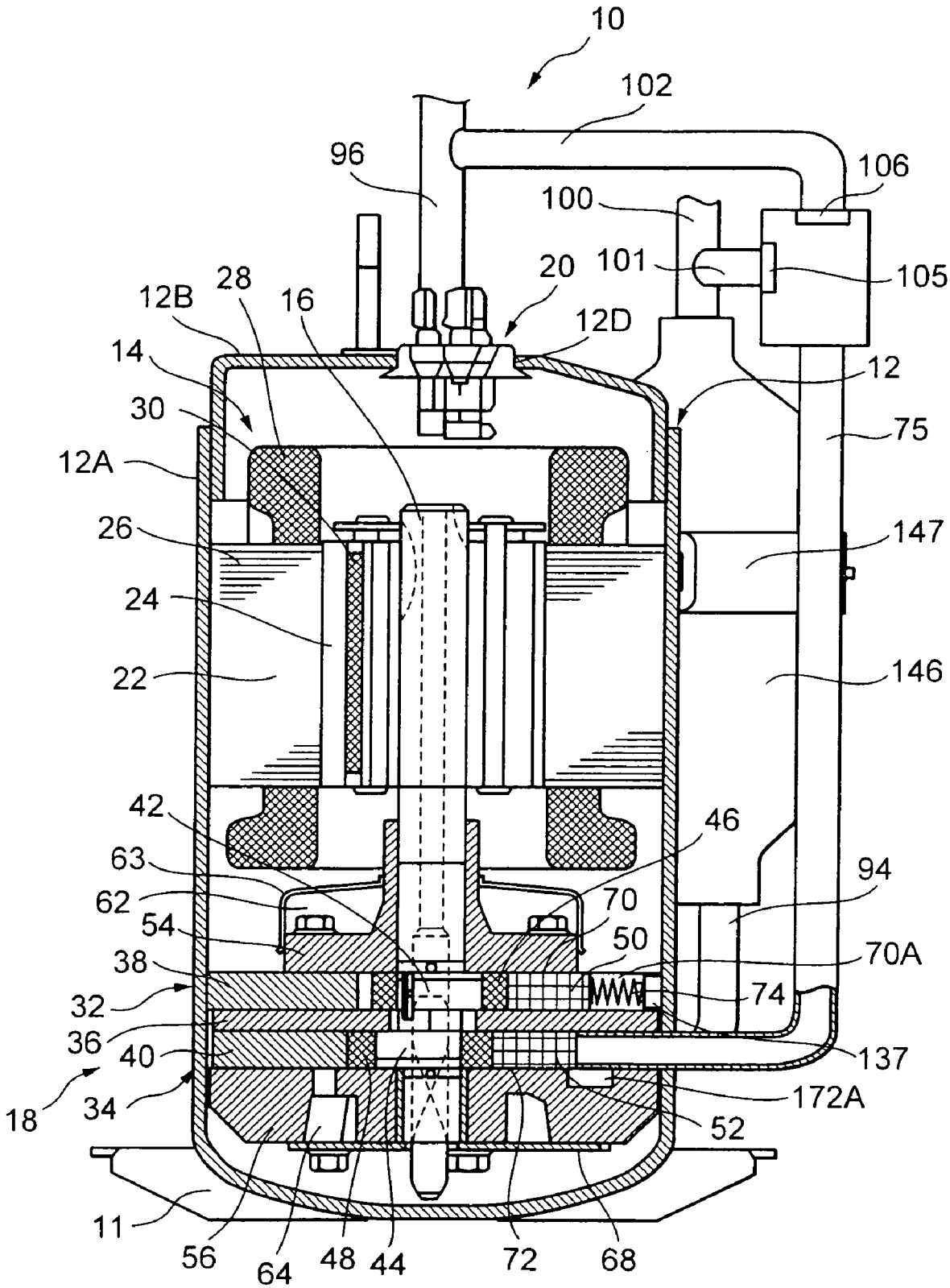
FIG. 10 is a vertically sectional side view of a multicylinder rotary compressor according to Embodiment 7 of the present invention.

Next, still another embodiment of a multicylinder rotary compressor will be described according to the present invention. FIG. 10 is a vertically sectional side view of the multicylinder rotary compressor according to the present invention in this case. Another vertically sectional side view of the multicylinder rotary compressor of the present embodiment is the same as FIG. 1 of Embodiment 1, and a refrigerant circuit diagram is also the same as FIG. 3. Therefore, an only constitution different from that of Embodiment 1 will be described in the present embodiment. It is to be noted that in the present embodiment, components denoted with the same reference numerals as those of FIGS. 1 to 3 produce the same or similar effects.

In the present embodiment, a back-pressure chamber 172A opens on the sides of a guide groove 72 and a sealed container 12, a pipe 75 described later communicates with/is connected to an opening on the sealed container 12 side, and the pipe is sealed together with the inside of the sealed container 12.

Moreover, the back-pressure chamber 172A of the present invention is constituted as a muffler chamber having a predetermined space volume. As shown in FIG. 10, the back-pressure chamber 172A of the embodiment has a shape in which a concavely depressed chamber having the predetermined space volume is disposed in a position constituting a connection portion of the pipe 75 to the guide groove 72 on a lower support member 56. That is, the back-pressure chamber 172A of the present embodiment is formed by a concavely depressed portion formed in a position corresponding to the pipe 75 and the guide groove 72 on the upper surface of the lower support member 56 which closes an opening face under a second cylinder 40. In the depressed portion, an opening in the lower surface of the second cylinder 40 is closed by the lower support member 56.

When the back-pressure chamber 172A is formed in such a manner as to have the predetermined space volume ad described above, the back-pressure chamber 172A can reduce pressure pulsation caused by an urging operation of a second vane 52, and pulsation of a pressure applied as a back pressure of the second vane 52.

It is to be noted that an HFC or HC-based refrigerant is used as a refrigerant. As oils which are lubricants, existing oils are used such as a mineral oil, an alkyl benzene oil, an ether oil, and an ester oil.

An operation of a rotary compressor 10 including the above-described constitution will be described.

(1) First Operation Mode (Usual or High Load Time)

First, a first operation mode will be described in which both rotary compression elements 32, 34 perform a compression work. A controller 210 controls a rotation number of an electromotive element 14 of the rotary compressor 10 based on an operation instruction input of an indoor-unit-side controller (not shown) disposed in the above-described indoor unit. Moreover, in a usual or high load indoor state, the controller 210 executes the first operation mode. In this first operation mode, the controller 210 closes an electromagnetic valve 105 of a refrigerant pipe 101 and opens an electromagnetic valve 106 of a refrigerant pipe 102. Accordingly, the refrigerant pipe 102 communicates with the pipe 75, suction-side refrigerants of both the rotary compression elements 32, 34 flow into the back-pressure chamber 172A, and suction-side pressures of both the rotary compression elements 32, 34 are applied as a back pressure of the second vane 52.

Moreover, when a stator coil 28 of the electromotive element 14 is energized via a terminal 20 and wiring (not shown), the electromotive element 14 starts, and a rotor 24 rotates. By this rotation, first and second rollers 46, 48 are fitted into upper and lower eccentric portions 42, 44 integrally disposed in a rotation shaft 16, and eccentrically rotate in first and second cylinders 38, 40.

Accordingly, a low-pressure refrigerant flows into an accumulator 146 from a refrigerant pipe 100 of the rotary compressor 10. Since the electromagnetic valve 105 of the refrigerant pipe 100 is closed as described above, all the refrigerant passed through the refrigerant pipe 100 flows into the accumulator 146 without flowing into the pipe 75.

Moreover, the low-pressure refrigerant which has flown into the accumulator 146 is separated into gas/liquid, and thereafter the only refrigerant gas enters refrigerant discharge tubes 92, 94 which open in the accumulator 146. The low-pressure refrigerant gas which has entered the refrigerant introducing tube 92 is sucked on a low-pressure chamber side of the first cylinder 38 of the first rotary compression element 32 via a suction passage 58.

The refrigerant gas sucked on the low-pressure chamber side of the first cylinder 38 is compressed by the operations of the first roller 46 and a first vane 50 to constitute a high-temperature/pressure refrigerant gas. The gas is passed through a discharge port (not shown) from the high-pressure chamber side of the first cylinder 38, and is discharged to a discharge muffling chamber 62.

On the other hand, the low-pressure refrigerant gas which has flown into the refrigerant introducing tube 94 is passed through a suction passage 60, and sucked on the low-pressure chamber side of the second cylinder 40 of the second rotary compression element 34. The refrigerant gas sucked on the low-pressure chamber side of the second cylinder 40 is compressed by the operations of the second roller 48 and the second vane 52.

At this time, pressure pulsation is caused on the side of the back-pressure chamber 172A opposite to the second roller 48 of the second vane 52 by an urging operation of the second vane 52 toward the second roller 48 as described above. In this case, in the second rotary compression element 34 in which any spring member has not heretofore been disposed, a problem has occurred that a follow-up property of the second vane 52 is deteriorated with respect to the second roller by the pressure pulsation.

Furthermore, the discharge-side pressures of both the rotary compression elements 32, 34, applied as a back pressure of the second vane 52, have large pulsations. Additionally, any spring member is not disposed, and therefore the follow-up property of the second vane 52 Is deteriorated by the pulsation. Consequently, a problem has occurred that the compression efficiency is deteriorated, and a collision sound is generated between the second vane 52 and the second roller 48.

However, when the back-pressure chamber 172A is formed into the muffler chamber having the predetermined space volume as in the present invention, it is possible to reduce the pressure pulsation generated by the urging operation of the second vane 52. As to the discharge-side refrigerants of both the rotary compression elements 32, 34 from the pipe 75, the pressure pulsation is remarkably reduced in a process in which the refrigerants pass through the back-pressure chamber 172A. Accordingly, the second vane 52 can be sufficiently urged toward the second roller 48 without using any spring member.

Consequently, the follow-up property of the second vane 52 is improved in the first operation mode, and the compression efficiency of the second rotary compression element 34 is enhanced. Furthermore, since the follow-up property of the second vane 52 is improved, it is possible to avoid the collision with the second roller 48. Therefore, it is possible to avoid as much as possible the disadvantage that the collision sound is generated between the second vane and the second roller 48.

It is to be noted that the refrigerant gas is compressed by the operations of the second roller 48 and second vane 52 to obtain a high-temperature/pressure. The gas is passed through a discharge port (not shown) from the high-pressure chamber side of the second cylinder 40, and is discharged to a discharge muffling chamber 64. The refrigerant gas discharged to the discharge muffling chamber 64 is discharged to the discharge muffling chamber 62 via a communication path 120, and flows together with the refrigerant gas compressed by the first rotary compression element 32. Moreover, the joined refrigerant gas is discharged into a sealed container 12 from a hole (not shown) extending through a cup member 63.

Thereafter, the refrigerant in the sealed container 12 is discharged to the outside from a refrigerant discharge tube 96 formed in an end cap 12B of the sealed container 12, and flows into an outdoor heat exchanger 152. On the other hand, since the electromagnetic valve 106 is opened by the controller 210 as described above, a part of the discharge-side refrigerant flows into the back-pressure chamber 172A from the refrigerant pipe 102 via the pipe 75. The discharge-side refrigerants of both the rotary compression elements 32, 34 flow through the refrigerant discharge tube 96. Accordingly, the discharge-side pressures of both the rotary compression elements 32, 34 are applied as the back pressure of the second vane 52.

On the other hand, the refrigerant gas which has flown into the outdoor heat exchanger 152 emits heat in the exchanger, the pressure of the gas is reduced by an expansion valve 154, and thereafter the gas flows into an indoor heat exchanger 156. The refrigerant evaporates in the indoor heat exchanger 156, the heat is absorbed from air circulated in the room to thereby exert a cooling function, and the inside of the room is cooled. Moreover, the refrigerant emanates from the indoor heat exchanger 156 and is sucked by the rotary compressor 10. The refrigerant repeats this cycle.

It is to be noted that in the above-described first operation mode, the controller 210 closes the electromagnetic valve 105 of the refrigerant pipe 101, and opens the electromagnetic valve 106 of the refrigerant pipe 102 in such a manner that the refrigerant pipe 102 communicates with the pipe 75. The discharge-side pressures of both the rotary compression elements 32, 34 are high pressures, and are applied as the back pressure of the second vane 52. However, an intermediate pressure may be applied as the back pressure of the second vane 52 in the first operation mode, and the intermediate pressure is between the suction-side and discharge-side pressures of both the rotary compression elements 32, 34. In this case, for example, the controller 210 closes the electromagnetic valve 105 of the refrigerant pipe 101 and the electromagnetic valve 106 of the refrigerant pipe 102 to form a closed space inside the pipe 75 connected to the back-pressure chamber 172A of the second vane 52. Then, not a little refrigerant in the second cylinder 40 flows into the back-pressure chamber 172A between the second vane 52 and the housing section 70A. Therefore, the pressure in the back-pressure chamber 172A of the second vane 52 constitutes the intermediate pressure between the suction-side and discharge-side pressures of both the rotary compression elements 32, 34, and this intermediate pressure is applied as the back pressure of the second vane 52.

Even when the intermediate pressure is applied as the back pressure of the second vane 52 in this manner, the second vane 52 can be sufficiently urged toward the second roller 48 by the intermediate pressure without using any spring member. Furthermore, the pressure pulsation is remarkably reduced as compared with the application of the discharge-side pressures of both the rotary compression elements 32, 34. Therefore, in addition to a pulsation reducing effect by the back-pressure chamber 172A, the pulsation can further be reduced. Especially, when the electromagnetic valves 105, 106 are closed as described above to interrupt the flowing of the suction-side and discharge-side refrigerants of both the rotary compression elements 32, 34 from the pipe 75, the pulsation of the back pressure of the second vane 52 can be further suppressed.

(2) Second Operation Mode (Operation at light Load Time)

Next, a second operation mode will be described. In a case where the inside of the room has a state in which a load is light, the controller 210 shifts to the second operation mode. In this second operation mode, the only first rotary compression element 32 substantially performs a compression work. The operation mode is performed in a case where the inside of the room has a light load and the electromotive element 14 rotates at a low speed in the first operation mode. When the only first rotary compression element 32 substantially performs the compression work in a small capacity region, an amount of the refrigerant gas to be compressed can be reduced as compared with a case where the first and second cylinders 38, 40 perform the compression work. Therefore, the rotation number of the electromotive element 14 is raised also at the light load time by the corresponding amount, the operation efficiency of the electromotive element 14 is improved, and a leak loss of the refrigerant can be reduced.

In this case, the controller 210 opens the electromagnetic valve 105 of the refrigerant pipe 101, and closes the electromagnetic valve 106 of the refrigerant pipe 102. Accordingly, the refrigerant pipe 101 communicates with the pipe 75, a suction-side refrigerant of the first rotary compression element 32 flows into the back-pressure chamber 172A, and the suction-side pressure of the first rotary compression element 32 is applied as the back pressure of the second vane 52.

On the other hand, the controller 210 energizes the stator coil 28 of the electromotive element 14 via the terminal 20 and the wiring (not shown), and rotates the rotor 24 of the electromotive element 14 as described above. By this rotation, the first and second rollers 46, 48 are fitted into the upper and lower eccentric portions 42, 44 disposed integrally with the rotation shaft 16, and eccentrically rotate in the first and second cylinders 38, 40.

Accordingly, the low-pressure refrigerant flows into the accumulator 146 from the refrigerant pipe 100 of the rotary compressor 10. Since the electromagnetic valve 105 of the refrigerant pipe 101 opens at this time as described above, a part of the refrigerant on the suction side of the first rotary compression element 32 passes through the refrigerant pipe 100, and flows into the back-pressure chamber 172A from the refrigerant pipe 101 via the pipe 75. Accordingly, the back-pressure chamber 172A has a suction-side pressure of the first rotary compression element 32, and the suction-side pressure of the first rotary compression element 32 is applied as the back pressure of the second vane 52.

Here, the suction-side pressures of both the rotary compression elements 32, 34 are applied as the back pressure of the second rotary compression element 34, and this pressure is a low pressure. Therefore, the second vane 52 cannot be urged toward the second roller 48. Therefore, the compression work is not substantially performed in the second rotary compression element 34, and the compression work of the refrigerant is performed only by the first rotary compression element 32 provided with the spring 74.

In this case, since equal suction-side pressures are applied to the pressure inside the second cylinder 40 and the back pressure of the second vane, there has heretofore been a problem that the second vane comes into the second cylinder by a fluctuation of balance between both spaces, the vane collides with the second roller, and the collision sound is generated. However, since the fluctuation can be reduced by the back-pressure chamber 172A having the predetermined space volume in the present invention, it is possible to avoid as much as possible the disadvantage that the second vane 52 comes into the second cylinder 40, collides with the second roller 48, and generates a collision sound.

On the other hand, the low-pressure refrigerant which has flown into the accumulator 146 is separated into gas/liquid, and thereafter the refrigerant gas only enters the refrigerant discharge tube 92 which opens in the accumulator 146. The low-pressure refrigerant gas which has entered the refrigerant introducing tube 92 flows through the suction passage 58, and is sucked on the low-pressure chamber side of the first cylinder 38 of the first rotary compression element 32.

The refrigerant gas sucked on the low-pressure chamber side of the first cylinder 38 is compressed by the operations of the first roller 46 and the first vane 50 to constitute a high-temperature/pressure refrigerant gas, and the gas is discharged to the discharge muffling chamber 62 from the high-pressure chamber side of the first cylinder 38 through a discharge port (not shown). The refrigerant gas discharged to the discharge muffling chamber 62 is discharged into the sealed container 12 from a hole (not shown) extending through the cup member 63.

Thereafter, the refrigerant in the sealed container 12 is discharged to the outside from the refrigerant discharge tube 96 formed in the end cap 12B of the sealed container 12, and flows into the outdoor heat exchanger 152. There, the refrigerant gas emits heat. After the pressure of the gas is reduced by the expansion valve 154, the gas flows into the indoor heat exchanger 156. The refrigerant evaporates in the indoor heat exchanger 156, the heat is absorbed from air circulated in the room to thereby exert a cooling function, and the inside of the room is cooled. Moreover, the refrigerant emanates from the indoor heat exchanger 156 and is sucked by the rotary compressor 10. The refrigerant repeats this cycle.

As described above in detail, according to the present invention, the performance and reliability of the rotary compressor 10 can be enhanced. The compressor is usable by the switching of the first operation mode in which the first and second rotary compression elements 32, 34 perform the compression work and the second operation mode in which the only first rotary compression element 32 substantially performs the compression work.

Consequently, when the refrigerant circuit of the air conditioner is constituted using the rotary compressor 10, the operation efficiency and performance of the air conditioner are enhanced, and power consumption can be reduced.

Embodiment 8

Figure 11:
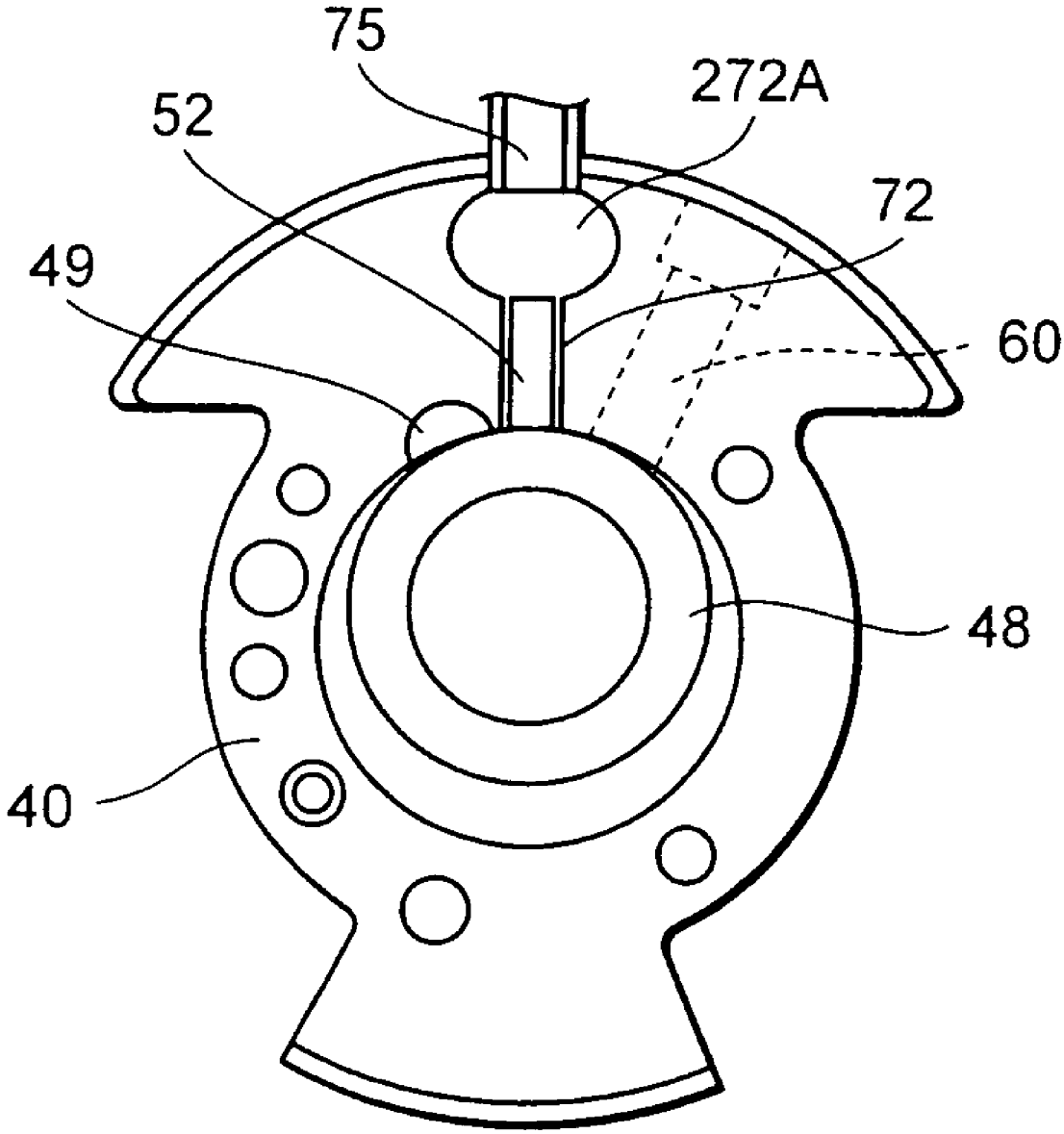
FIG. 11 is a flat sectional view of a second cylinder according to Embodiment 8 of the multicylinder rotary compressor.

It is to be noted that in Embodiment 7 a back-pressure chamber 172A is formed into a shape having a concavely depressed chamber having a predetermined space volume, but the present invention is not limited to this embodiment, and the back-pressure chamber of the present invention is not limited as long as the chamber has a predetermined space volume. The present invention is also effective, for example, in a case where the back-pressure chamber has a shape shown in FIG. 11. It is to be noted that FIG. 11 is a flat sectional view of a second cylinder in this case. In FIG. 11, components denoted with the same reference numerals as those of FIGS. 1 to 10 produce the same or similar effects.

In FIG. 11, reference numeral 49 denotes a discharge port of the second rotary compression element 34. A back-pressure chamber 272A of the present embodiment has an expanded portion having a predetermined space volume in a transverse direction of a second cylinder 40, and entirely has a substantially cylindrical shape. Even when the back-pressure chamber 272A is formed into the shape of the present embodiment in this manner, the back-pressure chamber 272A can reduce pressure pulsation, improve a follow-up property of a second vane 52, and avoid collision with a second roller 48.

Embodiment 9

It is to be noted that even in Embodiments 7 and 8 described above, as shown in FIG. 5, an electromagnetic valve 200 is disposed in a middle portion of a refrigerant introducing tube 94 on an inlet side of a sealed container 12 on an outlet side of an accumulator 146 of a rotary compressor 10 in such a manner as to control flowing of a refrigerant into a second rotary compression element 34. In a second operation mode, the electromagnetic valve 200 may be closed to interrupt the flowing of the refrigerant into a second cylinder 40.

In this case, when the refrigerant is inhibited from being passed into the second cylinder 40, a pressure in the second cylinder 40 is slightly higher than a suction-side pressure of both the rotary compression elements 32, 34 (the second roller 48 rotates, a high pressure in the sealed container 12 slightly flows from a gap of the second cylinder 40 or the like, and therefore the pressure in the second cylinder 40 becomes slightly higher than the suction-side pressure).

Therefore, the second vane 52 is pushed toward a back-pressure chamber 172A (or the back-pressure chamber 272A) opposite to the second roller 48, and does not come into the second cylinder 40 by the pressure in the second cylinder 40. Therefore, in addition to the above-described effect of the back-pressure chamber 172A (or the back-pressure chamber 272A), it is possible to avoid more effectively a disadvantage that the second vane 52 collides with the second roller 48.

Embodiment 10

It has been described in Embodiments 7, 8, and 9 that an HFC or HC-based refrigerant is used as a refrigerant, but a refrigerant having a large high/low pressure difference may be used such as carbon dioxide. For example, a combination of carbon dioxide and polyalkyl glycol (PAG) may be used as the refrigerant. In this case, since the refrigerant compressed by rotary compression elements 32 and 34 has a very high pressure, there is a possibility that a cup member 63 is broken by the high pressure in a case where a discharge muffling chamber 62 is formed into a shape to cover an upper support member 54 with the cup member 63 as in the respective embodiments.

Therefore, when the discharge muffling chamber is formed into a shape shown in FIG. 8, resistance to pressure can be secured. The chamber is above the upper support member 54 in which the refrigerants compressed by both the rotary compression elements 32, 34 flow together. That is, in a discharge muffling chamber 162 of FIG. 8, a concavely depressed portion is formed in an upper part of the upper support member 54, and the concavely depressed portion is closed by an upper cover 66 which is a cover to constitute the chamber. Consequently, the present invention is applicable even to a case where a refrigerant having a large high/low pressure difference is contained like carbon dioxide.

Embodiment 11

Figure 12:
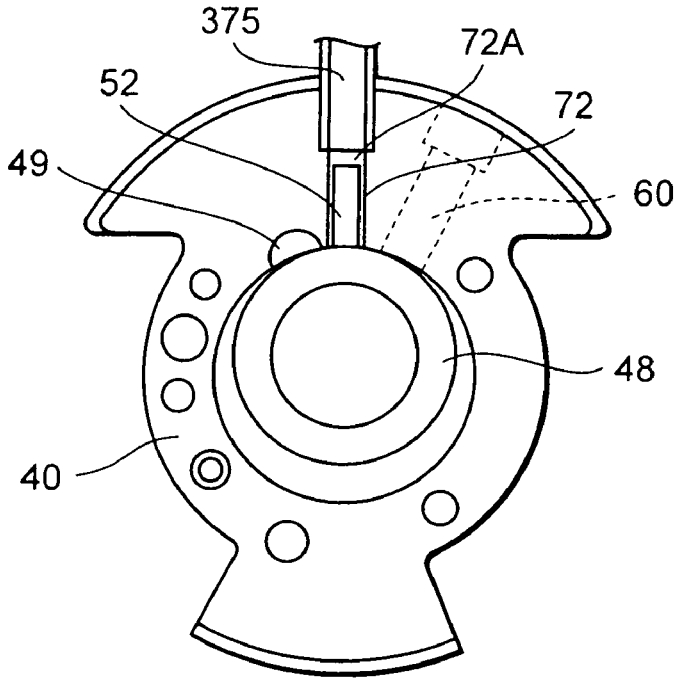
FIG. 12 is a flat sectional view of the second cylinder in a case where the second roller of the second rotary compression element is positioned in a top dead center according to Embodiment 11 of the multicylinder rotary compressor of the present invention.
Figure 13:
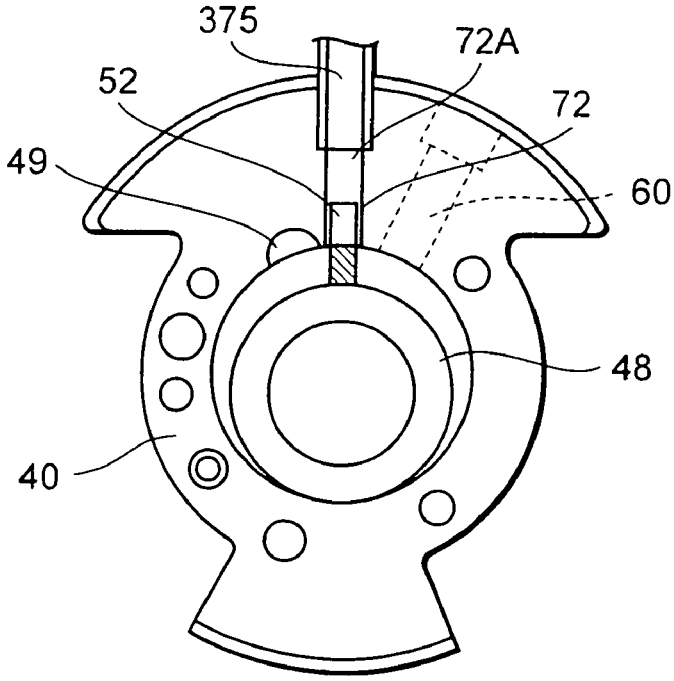
FIG. 13 is a flat sectional view of the second cylinder in a case where the second roller of the second rotary compression element is positioned in a bottom dead center according to Embodiment 11 of the multicylinder rotary compressor of the present invention.

Next, still another embodiment of a multicylinder rotary compressor of the present invention will be described with reference to FIGS. 12 and 13. FIG. 12 is a flat sectional view of a second cylinder in a case where a second roller of a second rotary compression element is positioned in a top dead center in the multicylinder rotary compressor of the present invention, and FIG. 13 is a flat sectional view of the second cylinder in a case where the second roller of the second rotary compression element is positioned in a bottom dead center.

It is to be noted that a vertically sectional side view of the multicylinder rotary compressor of the embodiment is the same as FIGS. 1 and 2 of Embodiment 1, and a refrigerant circuit diagram is the same as FIG. 3 of Embodiment 1. Therefore, the figures are omitted. Therefore, in the present embodiment. an only part different from that of a constitution of Embodiment 1 will be described. It is to be noted that in the present embodiment, components denoted with the same reference numerals as those of FIGS. 1 to 3 produce the same or similar effects.

Here, a back-pressure chamber 72A is formed on a back-surface side of a second vane 52. The back-pressure chamber 72A opens on the sides of a guide groove 72 and a sealed container 12. An opening on a sealed container 12 side communicates with/is connected to a pipe 375 which is a passage for a back pressure (FIGS. 12 and 13), and is sealed together with the inside of the sealed container 12.

The pipe 375 is a back-pressure passage for applying a back pressure to the second vane 52 of a second rotary compression element 34. The pipe communicates with a refrigerant pipe 100 on a suction side of rotary compression elements 32 and 34 via a refrigerant pipe 101 described later, and a refrigerant discharge tube 96 on a discharge side of both the rotary compression elements 32, 34 via a refrigerant pipe 102. Moreover, discharge-side refrigerants of both the rotary compression elements 32, 34 flow into the back-pressure chamber 72A from a pipe 75, or suction-side refrigerants of both the rotary compression elements 32, 34 flow into the chamber. As the back pressure of the second vane 52, the discharge-side or suction-side pressures of both the rotary compression elements 32, 34 are added.

Moreover, in the present invention, a sectional area of the pipe 375 is set to be not less than an average value of a surface area of the second vane 52 exposed into a second cylinder 40. That is, the average value of the sectional area of the second vane 52 is calculated which is exposed into the second cylinder 40 from when the second vane 52 moves from the top dead center in which the vane is not most exposed into the second cylinder 40 as shown in FIG. 12 to the bottom dead center in which the second vane 52 is most exposed into the second cylinder 40 as shown in FIG. 13 (a broken line of the second vane 52 of FIG. 13 shows a portion exposed into the second cylinder 40). The second vane follows up a second roller 48 which eccentrically rotates in the second cylinder 40. The sectional area of the pipe 375 is set to be not less than the average value of the surface area.

When the sectional area of the pipe 375 is set to be not less than the average value of the surface area of the second vane 52 exposed into the second cylinder 40 in this manner, a sufficient area can be sufficiently secured on a back-pressure chamber 72A side opposite to the second roller 48 of the second vane 52.

It is to be noted that an HFC or HC-based refrigerant is used as the refrigerant. As oils which are lubricants, existing oils are used such as a mineral oil, an alkyl benzene oil, an ether oil, and an ester oil.

Next, an operation of the rotary compressor 10 constituted as described above will be described.

(1) First Operation Mode (Usual or High Load Time)

First, a first operation mode will be described in which both the rotary compression elements 32, 34 perform a compression work. A controller 210 controls a rotation number of an electromotive element 14 of a rotary compressor 10 based on an operation instruction input of an indoor-unit-side controller (not shown) disposed in the above-described indoor unit. Moreover, in a usual or high load indoor state, the controller 210 executes the first operation mode. In this first operation mode, the controller 210 closes an electromagnetic valve 105 of the refrigerant pipe 101 and opens an electromagnetic valve 106 of the refrigerant pipe 102. Accordingly, the refrigerant pipe 102 communicates with the pipe 375, discharge-side refrigerants of both the rotary compression elements 32, 34 flow into the back-pressure chamber 72A, and the discharge-side pressures of both the rotary compression elements 32, 34 are applied as a back pressure of the second vane 52.

Moreover, when a stator coil 28 of the electromotive element 14 is energized via a terminal 20 and wiring (not shown), the electromotive element 14 starts, and a rotor 24 rotates. By this rotation, first and second rollers 46, 48 are fitted into upper and lower eccentric portions 42, 44 integrally disposed in a rotation shaft 16, and eccentrically rotate in the first and second cylinders 38, 40.

Accordingly, a low-pressure refrigerant flows into an accumulator 146 from the refrigerant pipe 100 of the rotary compressor 10. Since the electromagnetic valve 105 of the refrigerant pipe 100 is closed as described above, all the refrigerant passed through the refrigerant pipe 100 flows into the accumulator 146 without flowing into the pipe 375.

Moreover, the low-pressure refrigerant which has flown into the accumulator 146 is separated into gas/liquid, and thereafter the only refrigerant gas enters refrigerant discharge tubes 92, 94 which open in the accumulator 146. The low-pressure refrigerant gas which has entered the refrigerant introducing tube 92 is sucked on the low-pressure chamber side of the first cylinder 38 of the first rotary compression element 32 via a suction passage 58.

The refrigerant gas sucked on the low-pressure chamber side of the first cylinder 38 is compressed by the operations of the first roller 46 and a first vane 50 to constitute a high-temperature/pressure refrigerant gas. The gas is passed through a discharge port (not shown) from the high-pressure chamber side of the first cylinder 38, and is discharged to a discharge muffling chamber 62.

On the other hand, the low-pressure refrigerant gas which has flown into the refrigerant introducing tube 94 is sucked on the low-pressure chamber side of the second cylinder 40 of the second rotary compression element 34 via a suction passage 60. The refrigerant gas sucked on the low-pressure chamber side of the second cylinder 40 is compressed by the operations of the second roller 48 and the second vane 52.

At this time, pressure pulsation is caused on the side of the back-pressure chamber 72A opposite to the second roller 48 of the second vane 52 by an urging operation of the second vane 52 toward the second roller 48 as described above. In this case, in the second rotary compression element 34 in which any spring member has not heretofore been disposed, a problem has occurred that a follow-up property of the second vane 52 is deteriorated with respect to the second roller by the pressure pulsation.

Furthermore, the discharge-side pressures of both the rotary compression elements 32, 34, applied as a back pressure of the second vane 52, have large pulsations. Additionally, any spring member is not disposed in the second rotary compression element 34, and therefore the follow-up property of the second vane 52 is deteriorated by the pulsation. Consequently, a problem has occurred that the compression efficiency is deteriorated, and a collision sound is generated between the second vane 52 and the second roller 48.

However, when the sectional area of the pipe 375 is set to be not less than the average value of the surface area of the second vane 52 exposed into the second cylinder 40, it is possible to secure a sufficient area on a back-pressure chamber 72A side opposite to the second roller 48 of the second vane 52, and it is also possible to reduce the pressure pulsation generated by the urging operation of the second vane 52. As to the discharge-side refrigerants of both the rotary compression elements 32, 34 from the pipe 375, the pressure pulsation is remarkably reduced in a process in which the refrigerants pass through the pipe 375. Accordingly, the second vane 52 can be sufficiently urged toward the second roller 48 without using any spring member.

Consequently, the follow-up property of the second vane 52 is improved in the first operation mode, and the compression efficiency of the second rotary compression element 34 is enhanced. Furthermore, since the follow-up property of the second vane 52 is improved, it is possible to avoid the collision with the second roller 48. Therefore, it is possible to avoid as much as possible the disadvantage that the collision sound is generated between the second vane and the second roller 48.

It is to be noted that the refrigerant gas is compressed by the operations of the second roller 48 and second vane 52 to obtain a high-temperature/pressure. The gas is passed through a discharge port 49 from the high-pressure chamber side of the second cylinder 40, and is discharged to the discharge muffling chamber 64. The refrigerant gas discharged to the discharge muffling chamber 64 is discharged to the discharge muffling chamber 62 via the communication path 120, and flows together with the refrigerant gas compressed by the first rotary compression element 32. Moreover, the joined refrigerant gas is discharged into the sealed container 12 from a hole (not shown) extending through the cup member 63.

Thereafter, the refrigerant in the sealed container 12 is discharged to the outside from the refrigerant discharge tube 96 formed in an end cap 12B of the sealed container 12, and flows into an outdoor heat exchanger 152. Here, since the electromagnetic valve 106 of the refrigerant pipe 102 is opened as described above, a part of the discharge-side refrigerant of both the rotary compression elements 32, 34 passed through the refrigerant discharge tube 96 enters the pipe 375 from the refrigerant pipe 102 as described above, and is applied as the back pressure of the second vane 52.

On the other hand, the refrigerant gas which has flown into the outdoor heat exchanger 152 emits heat in the exchanger, pressure of the gas is reduced by an expansion valve 154, and thereafter the gas flows into an indoor heat exchanger 156. In the indoor heat exchanger 156, the refrigerant evaporates, the heat is absorbed from air circulated in the room to thereby exert a cooling function, and the inside of the room is cooled. Moreover, the refrigerant emanates from the indoor heat exchanger 156 and is sucked by the rotary compressor 10. The refrigerant repeats this cycle.

It is to be noted that in the above-described first operation mode, the controller 210 closes the electromagnetic valve 105 of the refrigerant pipe 101, and opens the electromagnetic valve 106 of the refrigerant pipe 102 in such a manner that the refrigerant pipe 102 communicates with the pipe 375. The discharge-side pressures of both the rotary compression elements 32, 34 are high pressures, and are applied as the back pressure of the second vane 52. However, an intermediate pressure may be applied as the back pressure of the second vane 52, and the intermediate pressure is between the suction-side and discharge-side pressures of both the rotary compression elements 32, 34. In this case, for example, the controller 210 closes the electromagnetic valve 105 of the refrigerant pipe 101 and the electromagnetic valve 106 of the refrigerant pipe 102 to form a closed space inside the pipe 375 connected to the back-pressure chamber 72A of the second vane 52. Then, not a little refrigerant in the second cylinder 40 flows into the back-pressure chamber 72A between the second vane 52 and the housing section 70A. Therefore, the pressure in the back-pressure chamber 72A of the second vane 52 constitutes the intermediate pressure between the suction-side and discharge-side pressures of both the rotary compression elements 32, 34, and this intermediate pressure is applied as the back pressure of the second vane 52.

Even when the intermediate pressure is applied as the back pressure of the second vane 52 in this manner, the second vane 52 can be sufficiently urged toward the second roller 48 by the intermediate pressure without using any spring member. Furthermore, the pressure pulsation is remarkably reduced as compared with the application of the discharge-side pressures of both the rotary compression elements 32, 34. Therefore, in addition to the effect by the pipe 375, the pulsation can further be reduced. Especially, when the electromagnetic valves 105, 106 are closed as described above to interrupt the flowing of the suction-side and discharge-side refrigerants of both the rotary compression elements 32, 34 from the pipe 75, the pulsation of the back pressure of the second vane 52 can be further suppressed.

(2) Second Operation Mode (Operation at Light Load Time)

Next, a second operation mode will be described. In a case where the inside of the room has a state in which a load is light, the controller 210 shifts to the second operation mode. In this second operation mode, the only first rotary compression element 32 substantially performs a compression work. The operation mode is performed in a case where the inside of the room has a light load and the electromotive element 14 rotates at a low speed in the first operation mode. When the only first rotary compression element 32 substantially performs the compression work in a small capacity region, an amount of the refrigerant gas to be compressed can be reduced as compared with a case where the first and second cylinders 38, 40 perform the compression work. Therefore, the rotation number of the electromotive element 14 is raised also at the light load time by the corresponding amount, the operation efficiency of the electromotive element 14 is improved, and a leak loss of the refrigerant can be reduced.

In this case, the controller 210 opens the electromagnetic valve 105 of the refrigerant pipe 101, and closes the electromagnetic valve 106 of the refrigerant pipe 102. Accordingly, the refrigerant pipe 101 communicates with the pipe 75, a suction-side refrigerant of the first rotary compression element 32 flows into the back-pressure chamber 72A, and the suction-side pressure of the first rotary compression element 32 is applied as the back pressure of the second vane 52.

On the other hand, the controller 210 energizes the stator coil 28 of the electromotive element 14 via the terminal 20 and the wiring (not shown), and rotates the rotor 24 of the electromotive element 14 as described above. By this rotation, the first and second rollers 46, 48 are fitted into the upper and lower eccentric portions 42, 44 disposed integrally with the rotation shaft 16, and eccentrically rotate in the first and second cylinders 38, 40.

Accordingly, the low-pressure refrigerant flows into the accumulator 146 from the refrigerant pipe 100 of the rotary compressor 10. Since the electromagnetic valve 105 of the refrigerant pipe 101 opens at this time as described above, a part of the refrigerant on the suction side of the first rotary compression element 32 passes through the refrigerant pipe 100, and flows into the back-pressure chamber 72A from the refrigerant pipe 101 via the pipe 375. Accordingly, the back-pressure chamber 72A has a suction-side pressure of the first rotary compression element 32, and the suction-side pressure of the first rotary compression element 32 is applied as the back pressure of the second vane 52.

Here, the suction-side pressures of both the rotary compression elements 32, 34 are applied as the back pressure of the second rotary compression element 34, and this pressure is a low pressure. Therefore, the second vane 52 cannot be urged toward the second roller 48. Therefore, the compression work is not substantially performed in the second rotary compression element 34, and the compression work of the refrigerant is performed only by the first rotary compression element 32 provided with the spring 74.

In this case, since equal suction-side pressures are applied to the pressure inside the second cylinder 40 and the back pressure of the second vane, there has heretofore been a problem that the second vane 52 comes into the second cylinder 40 by a fluctuation of balance between both spaces, the vane collides with the second roller 48, and the collision sound is generated. However, when the sectional area of the pipe 375 communicating with/connected to the back-pressure chamber 72A of the second vane 52 is set to be not less than the average value of the surface area of the second vane 52 exposed in the second cylinder 40, fluctuation can be reduced by the pipe 375. Therefore, it is possible to avoid as much as possible the disadvantage that the second vane 52 comes into the second cylinder 40, collides with the second roller 48, and generates a collision sound.

On the other hand, the low-pressure refrigerant which has flown into the accumulator 146 is separated into gas/liquid, and thereafter the refrigerant gas only enters the refrigerant discharge tube 92 which opens in the accumulator 146. The low-pressure refrigerant gas which has entered the refrigerant introducing tube 92 flows through the suction passage 58, and is sucked on the low-pressure chamber side of the first cylinder 38 of the first rotary compression element 32.

The refrigerant gas sucked on the low-pressure chamber side of the first cylinder 38 is compressed by the operations of the first roller 46 and the first vane 50 to constitute a high-temperature/pressure refrigerant gas, and the gas is discharged to the discharge muffling chamber 62 from the high-pressure chamber side of the first cylinder 38 through a discharge port (not shown). The refrigerant gas discharged to the discharge muffling chamber 62 is discharged into the sealed container 12 from a hole (not shown) extending through the cup member 63.

Thereafter, the refrigerant in the sealed container 12 is discharged to the outside from the refrigerant discharge tube 96 formed in the end cap 12B of the sealed container 12, and flows into the outdoor heat exchanger 152. There, the refrigerant gas emits heat. After the pressure of the gas is reduced by the expansion valve 154, the gas flows into the indoor heat exchanger 156. The refrigerant which has flown into the indoor heat exchanger 156 evaporates in the exchanger, the heat is absorbed from air circulated in the room to thereby exert a cooling function, and the inside of the room is cooled. Moreover, the refrigerant emanates from the indoor heat exchanger 156 and is sucked by the rotary compressor 10. The refrigerant repeats this cycle.

As described above in detail, according to the present invention, the performance and reliability of the rotary compressor 10 can be enhanced. The compressor is usable by the switching of the first operation mode in which the first and second rotary compression elements 32, 34 perform the compression work and the second operation mode in which the only first rotary compression element 32 substantially performs the compression work.

Consequently, when the refrigerant circuit of the air conditioner is constituted using the rotary compressor 10, the operation efficiency and performance of the air conditioner are enhanced, and power consumption can be reduced.

Embodiment 12

It is to be noted that, as shown in FIG. 5, an electromagnetic valve 200 is disposed in a middle portion of a refrigerant introducing tube 94 on an inlet side of a sealed container 12 on an outlet side of an accumulator 146 of a rotary compressor 10 in such a manner as to control flowing of a refrigerant into a second cylinder 40 of a second rotary compression element 34. In a second operation mode, the electromagnetic valve 200 may be closed to interrupt the flowing of the refrigerant into the second cylinder 40. It is to be noted that in FIG. 5, components denoted with the same reference numerals as those of FIGS. 1 to 13 produce similar effects.

In this case, when the refrigerant is inhibited from being passed into the second cylinder 40, a pressure in the second cylinder 40 is slightly higher than a suction-side pressure of both the rotary compression elements 32, 34 (the second roller 48 rotates, a high pressure in the sealed container 12 slightly flows from a gap of the second cylinder 40 or the like, and therefore the pressure in the second cylinder 40 becomes slightly higher than the suction-side pressure).

Therefore, the second vane 52 is pushed toward a back-pressure chamber 72A opposite to the second roller 48, and does not come into the second cylinder 40 by the pressure in the second cylinder 40. Therefore, in addition to the above-described effect of the pipe 375, it is possible to avoid more effectively a disadvantage that the second vane 52 collides with the second roller 48.

Embodiment 13

It has been described in Embodiments 11 and 12 that an HFC or HC-based refrigerant is used as a refrigerant, but a refrigerant having a large high/low pressure difference may be used such as carbon dioxide. For example, a combination of carbon dioxide and polyalkyl glycol (PAG) may be used as the refrigerant. In this case, since the refrigerant compressed by rotary compression elements 32 and 34 has a very high pressure, there is a possibility that a cup member 63 is broken by the high pressure in a case where a discharge muffling chamber 62 is formed into a shape to cover an upper support member 54 with the cup member 63 as in the respective embodiments.

Therefore, when the discharge muffling chamber is formed into a shape shown in FIG. 8, resistance to pressure can be secured. The chamber is above the upper support member 54 in which the refrigerants compressed by both the rotary compression elements 32, 34 flow together. That is, in a discharge muffling chamber 162 of FIG. 8, a concavely depressed portion is formed in an upper part of the upper support member 54, and the concavely depressed portion is closed by an upper cover 66 which is a cover to constitute the chamber. Consequently, the present invention is applicable even to a case where a refrigerant having a large high/low pressure difference is contained like carbon dioxide.

Embodiment 14

Figure 14:
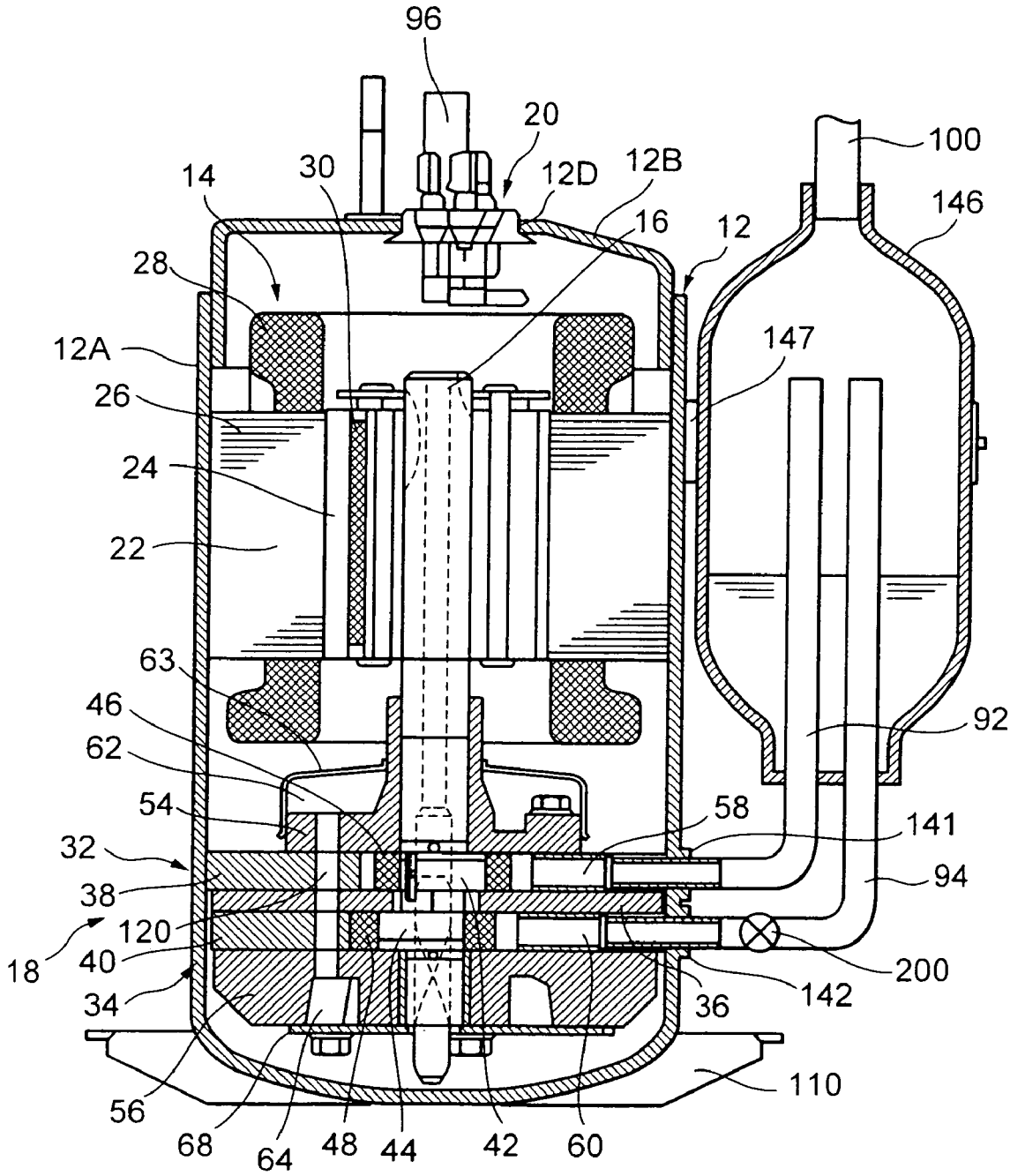
FIG. 14 is a vertically sectional side view of a multicylinder rotary compressor according to Embodiment 14 of the present invention.
Figure 15:
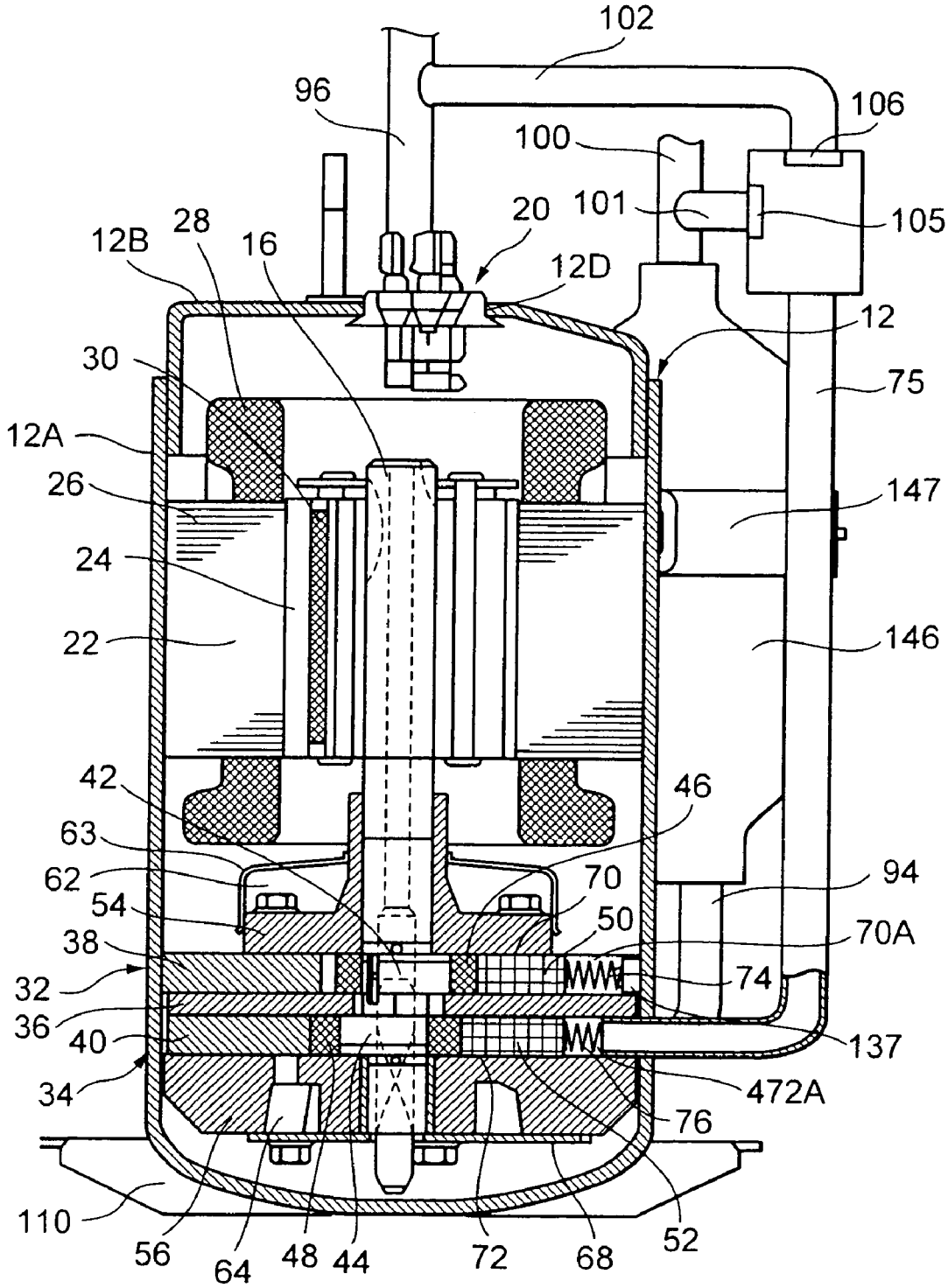
FIG. 15 is another vertically sectional side view of the multicylinder rotary compressor of FIG. 14.

Next, another embodiment of a compression system CS of the present invention will be described. FIG. 14 shows a vertically sectional side view of an inner high pressure type rotary compressor 10 comprising first and second rotary compression elements according to an embodiment of a multicylinder rotary compressor of the compression system CS of the present invention, and FIG. 15 shows a vertically sectional side view (showing a section different from that of FIG. 1) of the rotary compressor 10 of FIG. 1. It is to be noted that the compression system CS of the present embodiment constitutes a part of a refrigerant circuit of an air conditioner which is a refrigerating device for conditioning air in a room. It is to be noted that in FIGS. 14 and 15, components denoted with the same reference numerals as those of FIGS. 1 to 13 of the above-described embodiments produce the same or similar effects, and description thereof is omitted.

Figure 16:
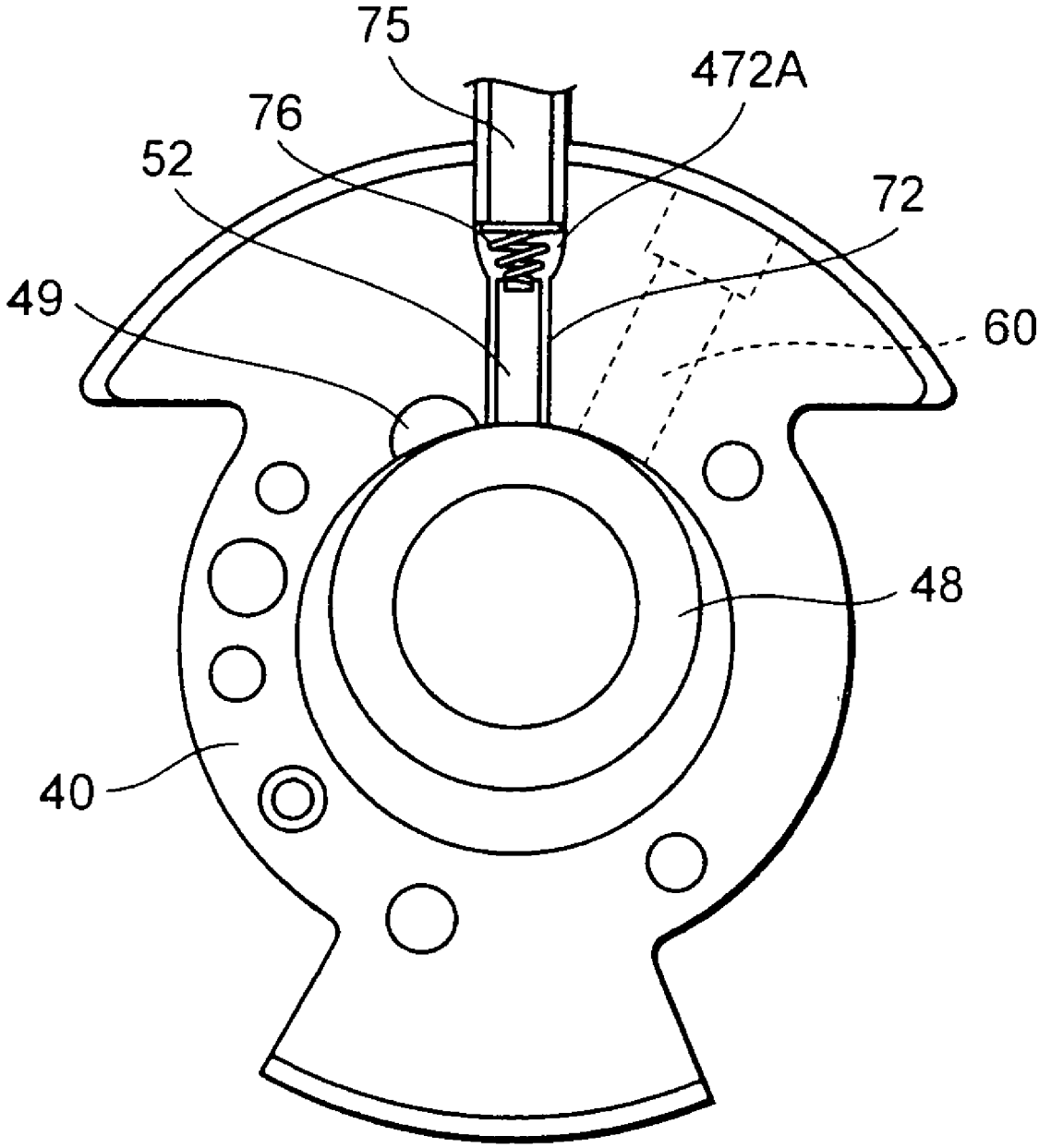
FIG. 16 is a flat sectional view of the second cylinder of a second rotary compression element of the multicylinder rotary compressor of FIG. 14.

Moreover, a guide groove 72 is formed in a second cylinder 40, and a housing section 472A is formed outside the guide groove 72, that is, on a back-surface side of the second vane 52. The guide groove houses the second vane 52, and the housing section houses a weak spring 76 which is urging means as shown in FIG. 16. The housing section 472A opens on the sides of the guide groove 72 and a sealed container 12, an opening on a sealed container 12 side communicates with/is connected to a pipe 75 described later, and the opening is sealed together with the inside the sealed container 12.

The above-described weak spring 76 urges the second vane 52 toward a second roller 48, one end of the spring abuts on a back surface side end portion of the second vane 52, and the other end of the spring is attached to/fixed to a tip of the pipe 75 communicating with/connected to a sealed container 12 side of the housing section 472A. An urging force of the weak spring 76 is set to be not more than an urging force in a case where a suction-side pressure of both rotary compression elements 32, 34 or the first rotary compression element 32 is applied as a back pressure of the second vane 52.

Moreover, an electromagnetic valve 200 is disposed in a middle portion of a refrigerant introducing tube 94 on an inlet side of the sealed container 12 on an outlet side of an accumulator 146. This electromagnetic valve 200 is a valve device for controlling flowing of a refrigerant into the second cylinder 40, and is controlled by a controller 210 described later which is a control device.

Here, the above-described controller 210 constitutes a part of the compression system CS of the present invention, and controls a rotation number of an electromotive element 14 of the rotary compressor 10. As described above, the controller controls opening/closing of the electromagnetic valve 200 of the refrigerant introducing tube 94, an electromagnetic valve 105 of a refrigerant pipe 101, and an electromagnetic valve 106 of a refrigerant pipe 102.

Figure 17:
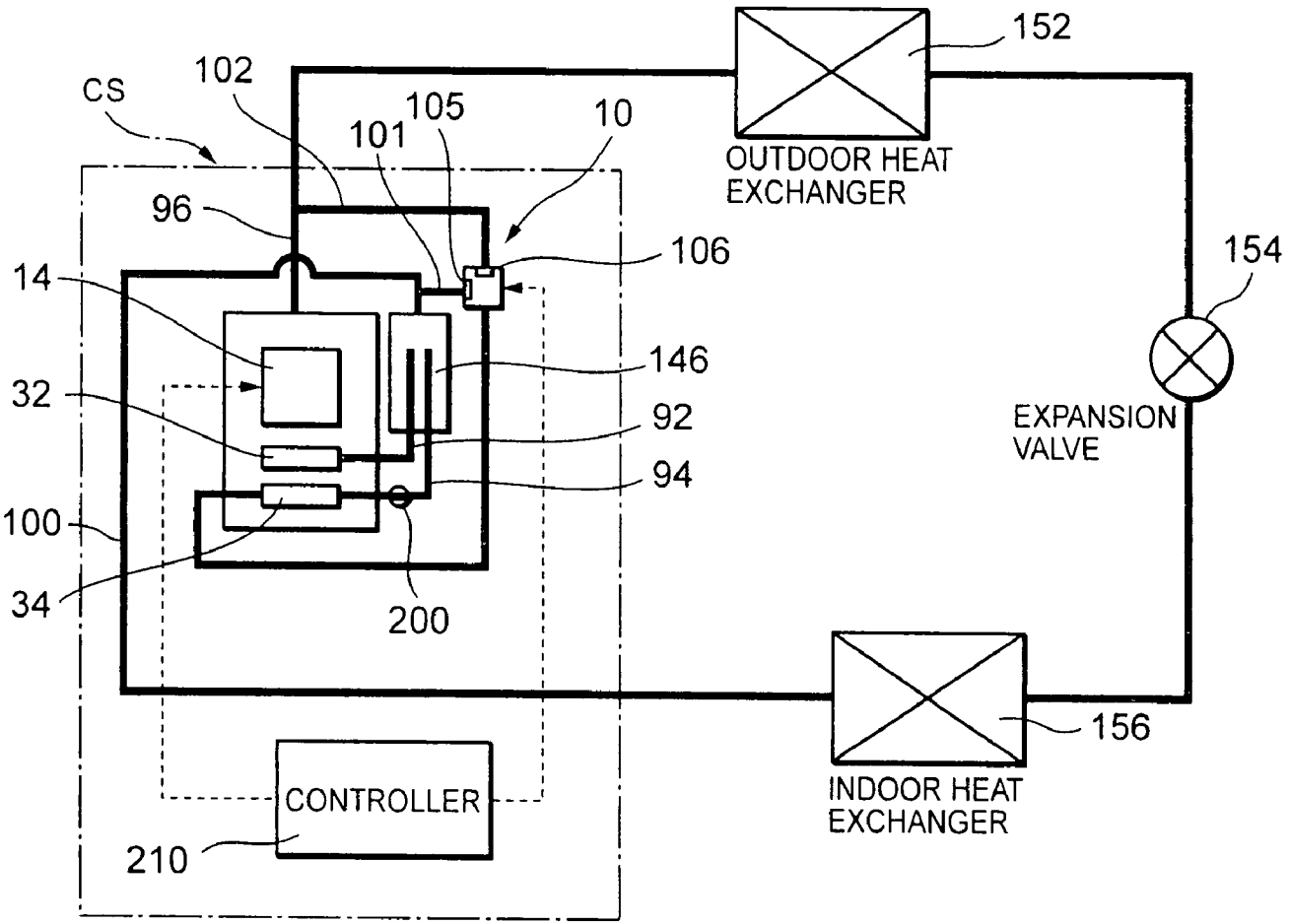
FIG. 17 is a refrigerant circuit diagram of an air conditioner using a compression system of Embodiment 14.

Next, FIG. 17 shows a refrigerant circuit diagram of the air conditioner constituted using the compression system CS. That is, the compression system CS of the embodiment constitutes a part of a refrigerant circuit of the air conditioner shown in FIG. 17, and comprises the rotary compressor 10, the controller 210 and the like. A refrigerant discharge tube 96 of the rotary compressor 10 is connected to an inlet of an outdoor heat exchanger 152. The controller 210, rotary compressor 10, and outdoor heat exchanger 152 are disposed in an outdoor unit (not shown) of the air conditioner. A pipe connected to an outlet of the outdoor heat exchanger 152 is connected to an expansion valve 154 which is pressure reducing means, and a pipe extending out of the expansion valve 154 is connected to an indoor heat exchanger 156. These expansion valve 154 and indoor heat exchanger 156 are disposed in an indoor unit (not shown) of the air conditioner. A refrigerant pipe 100 of the rotary compressor 10 is connected to an outlet side of the indoor heat exchanger 156.

It is to be noted that an HFC or HC-based refrigerant is used as the refrigerant. As oils which are lubricants, existing oils are used such as a mineral oil, an alkyl benzene oil, an ether oil, and an ester oil.

Next, an operation of the rotary compressor 10 constituted as described above will be described.

(1) First Operation Mode (Operation at Usual or High Load Time)

Figure 18:
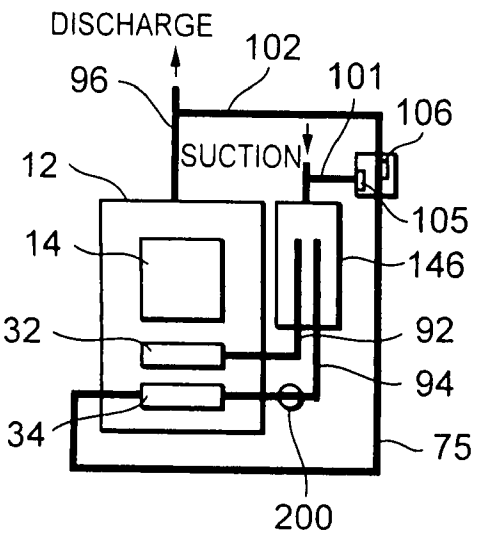
FIG. 18 is a diagram showing a flow of a refrigerant in a first operation mode of the multicylinder rotary compressor of Embodiment 14.

First, a first operation mode will be described in which both the rotary compression elements 32, 34 perform a compression work with reference to FIG. 18. It is to be noted that FIG. 18 is a diagram showing a flow of a refrigerant in the first operation mode of the rotary compressor 10 (a bold line in the figure shows the flow of the refrigerant).

The controller 210 energizes the electromotive element 14 of the rotary compressor 10 based on an operation instruction input of an indoor-unit-side controller (not shown) disposed in the indoor unit. At this time, simultaneously with the energization of the electromotive element 14, the controller 210 opens the electromagnetic valve 200 of the refrigerant introducing tube 94 and the electromagnetic valve 106 of the refrigerant pipe 102, and closes the electromagnetic valve 105 of the refrigerant pipe 101 (FIG. 18). Accordingly, the refrigerant pipe 102 communicates with the pipe 75, and the controller 210 controls a rotation number of the electromotive element 14 of the rotary compressor 10 to start the compressor in a state in which the discharge-side pressures of both the rotary compression elements 32, 34 are applied as the back pressure of the second vane 52. It is to be noted that simultaneously with the energization of the electromotive element 14, the controller 210 executes a control in such a manner as to open the electromagnetic valves 200 and 106, and close the electromagnetic valve 105. The electromagnetic valves 200, 105, 106 may be opened/closed before starting the rotary compressor 10. For example, the controller 210 may open the electromagnetic valves 200 and 106 and close the electromagnetic valve 105 before energizing the electromotive element 14.

Moreover, when the stator coil 28 of the electromotive element 14 is energized via a terminal 20 and wiring (not shown), the electromotive element 14 starts, and a rotor 24 rotates. By this rotation, first and second rollers 46, 48 are fitted into upper and lower eccentric portions 42, 44 integrally disposed in a rotation shaft 16, and eccentrically rotate in first and second cylinders 38, 40.

Accordingly, a refrigerant flows into the accumulator 146 from the refrigerant pipe 100 of the rotary compressor 10. Since the electromagnetic valve 105 of the refrigerant pipe 101 is closed as described above, the refrigerant on suction sides of both the rotary compression elements 32, 34 passes through the refrigerant pipe 100, and all flows into the accumulator 146 without flowing into the pipe 75.

The refrigerant which has flown into the accumulator 146 is separated into gas/liquid in the accumulator, and thereafter the only refrigerant gas enters the respective refrigerant discharge tubes 92, 94 which open in the accumulator 146. The refrigerant gas which has entered the refrigerant introducing tube 92 is sucked on the low-pressure chamber side of the first cylinder 38 of the first rotary compression element 32 via a suction passage 58.

The refrigerant gas sucked on the low-pressure chamber side of the first cylinder 38 is compressed by the operations of the first roller 46 and the first vane 50 to constitute a high-temperature/pressure refrigerant gas. The gas is passed through a discharge port (not shown) from the high-pressure chamber side of the first cylinder 38, and is discharged to a discharge muffling chamber 62.

On the other hand, the low-pressure refrigerant gas which has entered the refrigerant introducing tube 94 is passed through a suction passage 60, and sucked on the low-pressure chamber side of the second cylinder 40 of the second rotary compression element 34. The refrigerant gas sucked on the low-pressure chamber side of the second cylinder 40 is compressed by the operations of the second roller 48 and the second vane 52.

Here, there is an equilibrium pressure in the refrigerant circuit at the time of the starting of the rotary compressor 10. That is, after stopping the previous operation of the rotary compressor 10, the pressure is gradually equalized. After elapse of a predetermined time, the inside of the refrigerant circuit entirely has the equilibrium pressure. Therefore, when the rotary compressor 10 is started in a state in which the inside of the refrigerant circuit is entirely brought into the equilibrium pressure, immediately after starting the rotary compressor 10, the equilibrium pressure is substantially indicated by pressures of suction-side refrigerants of both the rotary compression elements 32, 34. The pressures are applied as a back pressure of the second vane 52. Similarly, the pressure inside the second cylinder 40 also indicates a substantially equilibrium pressure.

Therefore, in a constitution in which the second vane 52 is urged toward the second roller only by the back pressure, the second vane 52 cannot follow up the second roller 48 until the discharge-side pressures of both the rotary compression elements 32, 34 rise to certain degrees. Therefore, the compression work is not substantially performed in the second rotary compression element 34, and the compression work of the refrigerant is performed only by the first rotary compression element 32 provided with a spring 74.

Moreover, immediately after the starting, the state in the refrigerant circuit is unstable. Therefore, pulsations of the discharge-side pressures of both the rotary compression elements 32, 34 also remarkably increase. Therefore, when the compressor is started in a state in which the discharge-side pressures of both the rotary compression elements 32, 34 are applied without disposing any urging means in the second vane 52, disadvantages have occurred that a follow-up property of the second vane 52 is deteriorated by the pulsations of the discharge-side pressures of both the rotary compression elements 32, 34, the second vane 52 collides with the second roller 48, and a collision sound is generated.

However, since the weak spring 76 is disposed to urge the second vane 52 toward the second roller 48, the second vane 52 can follow up the second roller 48 by the urging force of the weak spring 76 even at a starting time when the inside of the second cylinder 40 has a pressure (equilibrium pressure) substantially equal to that of the housing section 472A. Consequently, the follow-up property of the second vane 52 can be improved at the starting time. Since the compression work can be performed even in the second rotary compression element 34 at the starting time, the performance of the air conditioner comprising the rotary compressor 10 can be enhanced.

It is to be noted that the refrigerant gas is compressed by the operations of the second roller 48 and second vane 52 to obtain a high-temperature/pressure. The gas is passed through the discharge port 49 from the high-pressure chamber side of the second cylinder 40, and is discharged to the discharge muffling chamber 64. The refrigerant gas discharged to the discharge muffling chamber 64 is discharged to the discharge muffling chamber 62 via the communication path 120, and flows together with the refrigerant gas compressed by the first rotary compression element 32. Moreover, the joined refrigerant gas is discharged into the sealed container 12 from a hole (not shown) extending through the cup member 63.

Thereafter, the refrigerant in the sealed container 12 is discharged to the outside from the refrigerant discharge tube 96 formed in the end cap 12B of the sealed container 12, and flows into the outdoor heat exchanger 152. On the other hand, since the electromagnetic valve 106 is opened by the controller 210 as described above, a part of the refrigerant passed through the refrigerant discharge tube 96 flows into the housing section 472A from the refrigerant pipe 102 via the pipe 75.

On the other hand, the refrigerant gas which has flown into the outdoor heat exchanger 152 emits heat, pressure of the gas is reduced by the expansion valve 154, and thereafter the gas flows into the indoor heat exchanger 156. In the indoor heat exchanger 156, the refrigerant evaporates, the heat is absorbed from air circulated in the room to thereby exert a cooling function, and the inside of the room is cooled. Moreover, the refrigerant emanates from the indoor heat exchanger 156 and is sucked by the rotary compressor 10. The refrigerant repeats this cycle.

(2) Switching from First Operation Mode to Second Operation Mode (Operation at Light Load Time)

Next, when the above-described usual or high load state turns to a light load state in the room, the controller 210 shifts to a second operation mode from the first operation mode. This second operation mode is a mode in which the only first rotary compression element 32 substantially performs a compression work. The operation mode is performed in a case where the inside of the room has a light load, and the electromotive element 14 rotates at a low speed in the first operation mode. When the only first rotary compression element 32 substantially performs the compression work in a small capacity region of the compression system CS, an amount of the refrigerant gas to be compressed can be reduced as compared with a case where both the first and second cylinders 38, 40 perform the compression work. Therefore, the rotation number of the electromotive element 14 can be raised also at a light load time by the corresponding amount, the operation efficiency of the electromotive element 14 is improved, and leak loss of the refrigerant can be reduced.

Here, at a mode switching time from the first operation mode to the second operation mode, the controller 210 rotates the electromotive element 14 at the low speed, a rotation number is set, for example, to 50 Hz or less, and a compression ratio of the rotary compression element 32 is controlled into 3.0 or less.

Figure 19:
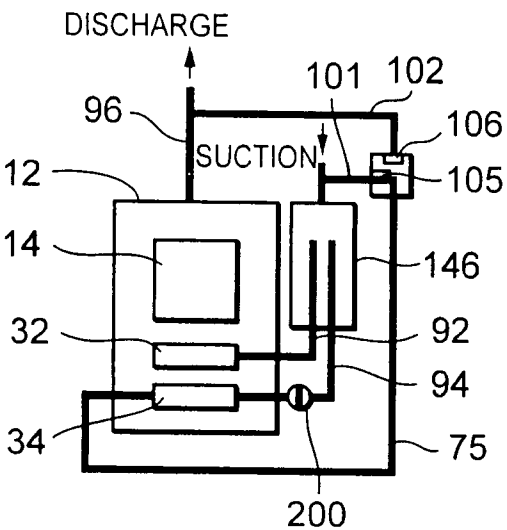
FIG. 19 is a diagram showing a flow of a refrigerant in a second operation mode of the multicylinder rotary compressor of Embodiment 14.

Furthermore, the controller 210 closes the above-described electromagnetic valve 200, and interrupts the flowing of the refrigerant into the second cylinder 40 as shown in FIG. 19. Accordingly, any compression work is not performed in the second rotary compression element 34. When the refrigerant is inhibited from being passed into the second cylinder 40, a pressure in the second cylinder 40 is slightly higher than a suction-side pressure of both the rotary compression elements 32, 34 (the second roller 48 rotates, a high pressure in the sealed container 12 slightly flows from a gap of the second cylinder 40 or the like, and therefore the pressure in the second cylinder 40 becomes slightly higher than the suction-side pressure).

Moreover, the controller 210 opens the electromagnetic valve 105 of the refrigerant pipe 101, and closes the electromagnetic valve 106 of the refrigerant pipe 102. Accordingly, the refrigerant pipe 101 communicates with the pipe 75, the suction-side refrigerant of the first rotary compression element 32 passes through the refrigerant pipe 100, and a part of the refrigerant flows into the back-pressure chamber 72A from the refrigerant pipe 101 via the pipe 75. Accordingly, the housing section 472A has a suction-side pressure of the first rotary compression element 32, and the suction-side pressure of the first rotary compression element 32 is applied as the back pressure of the second vane 52.

Here, since the urging force of the weak spring 76 onto the second roller 48 is set to be not more than the suction-side pressure of the first rotary compression element 32, the pressure in the second cylinder 40 is set to be higher than the suction-side pressure of the first rotary compression element 32 as described above, and the suction-side pressure of the first rotary compression element 32 is applied as the back pressure of the second vane 52. Accordingly, the pressure in the second cylinder 40 becomes higher than the pressure of the housing section 472A for urging the second vane 52 toward the second roller 48, and the urging force of the weak spring 76.

That is, the urging force for urging the second vane 52 on a back-pressure side (housing section 472A side) by the pressure in the second cylinder 40 is larger than the pressure of the housing section 472A for urging the second vane 52 toward the second roller 48 and the urging force of the weak spring 76. Therefore, the second vane 52 is pushed on the housing section 472A side opposite to the second roller 48, and housed in the guide groove 72. Accordingly, at the time of the switching to the second operation mode, the second vane 52 can be retracted from the second cylinder 40 in an early stage, and housed in the guide groove 72.

At this time, when the urging means is not disposed on the back-pressure side of the second vane 52, and when the second vane 52 is pushed by the pressure in the second cylinder 40, and retracted from the second cylinder 40 at the switching time, a problem occurs that the second vane 52 collides with a wall portion of the housing section 472A or a tip of the pipe 75 to generate a collision sound. However, when the weak spring 76 is disposed, and when the second vane 52 retreats from the second cylinder 40, impact can be absorbed by the weak spring 76. Therefore, it is possible to avoid beforehand a disadvantage that the second vane 52 collides with the second roller 48 to generate the collision sound, and the mode can shift to the second operation mode in which the only first rotary compression element 32 substantially performs the compression work.

(3) Second Operation Mode

Next, an operation of the rotary compressor 10 will be described in a second operation mode. It is to be noted that in the same manner as in the switching time from the first operation mode to the second operation mode, the electromagnetic valve 200 of the refrigerant introducing tube 94 is closed, the electromagnetic valve 105 of the refrigerant pipe 101 is opened, and the electromagnetic valve 106 of the refrigerant pipe 102 remains to be closed (FIG. 19). The low-pressure refrigerant flows into the accumulator 146 from the refrigerant pipe 100 of the rotary compressor 110. After the refrigerant is separated into the gas/liquid in the accumulator, the only refrigerant gas enters the refrigerant discharge tube 92 which opens in the accumulator 146. The low-pressure refrigerant gas which has entered the refrigerant introducing tube 92 flows through the suction passage 58, and is sucked on the low-pressure chamber side of the first cylinder 38 of the first rotary compression element 32.

Since the electromagnetic valve 105 of the refrigerant pipe 101 is opened by the controller 210, a part of the refrigerant passed through the refrigerant pipe 100 flows into the housing section 472A from the refrigerant pipe 101 via the pipe 75. Accordingly, the housing section 472A obtains the suction-side pressure of the first rotary compression element 32, and the suction-side pressure of the first rotary compression element 32 is applied as the back pressure of the second vane 52.

On the other hand, the refrigerant gas sucked on the low-pressure chamber side of the first cylinder 38 is compressed by the operations of the first roller 46 and the first vane 50 to constitute a high-temperature/pressure refrigerant gas. The gas is discharged to the discharge muffling chamber 62 from the high-pressure chamber side of the first cylinder 38 through a discharge port (not shown). The refrigerant gas discharged to the discharge muffling chamber 62 is discharged into the sealed container 12 from a hole (not shown) extending through the cup member 63.

Thereafter, the refrigerant in the sealed container 12 is discharged to the outside from the refrigerant discharge tube 96 formed in the end cap 12B of the sealed container 12, and flows into the outdoor heat exchanger 152. It is to be noted that since the electromagnetic valve 106 is closed as described above, the refrigerant flows through the refrigerant discharge tube 96 on the discharge side of the first rotary compression element 32, and all flows into the outdoor heat exchanger 152 without flowing through the pipe 75. Moreover, the refrigerant gas which has flown into the outdoor heat exchanger 152 emits heat. After the pressure of the gas is reduced by the expansion valve 154, the gas flows into the indoor heat exchanger 156. In the exchanger, the refrigerant evaporates. At this time, the heat is absorbed from air circulated in the room to exert a cooling function, and the inside of the room is cooled. Moreover, the refrigerant emanates from the indoor heat exchanger 156 and is sucked into the rotary compressor 110, and this cycle is repeated.

It is to be noted that in the second operation mode, the controller 210 closes the above-described electromagnetic valve 200. The operation is performed while stopping the flowing of the refrigerant into the second cylinder 40. Accordingly, in the second operation mode, the pressure in the second cylinder 40 is kept to be higher than the back pressure of the second vane 52. Therefore, the second vane 52 is pushed toward the housing section 472A (weak spring 76 side) opposite to the second roller 48 by the pressure in the second cylinder 40, and the vane does not come into the second cylinder 40. Consequently, it is possible to avoid beforehand a disadvantage that the second vane 52 comes into the second cylinder 40 during the operation in the second operation mode, collides with the second roller 48, and generates the collision sound.

(4) Switching from Second Operation Mode to First Operation Mode

On the other hand, when the above-described light load state turns to a usual or high load state in the room, the controller 210 shifts from the second operation mode to the first operation mode. Here, an operation will be described in switching the second operation mode to the first operation mode. In this case, the controller 210 rotates the electromotive element 14 at the low speed (rotation number of 50 Hz or less), and the compression ratio of both the rotary compression elements 32, 34 is controlled into 3.0 or less. The controller 210 opens the electromagnetic valve 200 and allows the refrigerant to flow into the second cylinder 40. Moreover, the controller closes the electromagnetic valve 105 of the refrigerant pipe 101, and opens the electromagnetic valve 106 of the refrigerant pipe 102.

Accordingly, the refrigerant pipe 102 communicates with the pipe 75, discharge-side refrigerants of both the rotary compression elements 32, 34 flow into the housing section 472A, and the discharge-side pressures of both the rotary compression elements 32, 34 are applied as the back pressure of the second vane 52.

When the discharge-side pressures of both the rotary compression elements 32, 34 are applied as the back pressure of the second vane 52, the housing section 472A of the second vane 52 has a pressure which is higher than that inside the second cylinder 40. Therefore, the second vane 52 is pushed toward the second roller 48 to follow up the roller by the high pressure of the housing section 472A and the weak spring 76. Accordingly, the second rotary compression element 34 restarts the compression work.

Since the weak spring 76 is disposed in this manner, the second vane 52 is sufficiently urged on the second roller 48 side, and can follow up the second roller 48 in an early stage at the switching time from the second operation mode to the first operation mode.

Consequently, at the switching time from the second operation mode to the first operation mode, the follow-up property of the second vane 52 is improved, the operation efficiency is improved, and it is possible to avoid the generation of the collision sound of the second vane 52.

As described above in detail, according to the present invention, the performance and reliability of the compression system CS can be enhanced. The system comprises the rotary compressor 10 which is usable by the switching of the first operation mode in which the first and second rotary compression elements 32, 34 perform the compression work and the second operation mode in which the only first rotary compression element 32 substantially performs the compression work.

Consequently, when the refrigerant circuit of the air conditioner is constituted using the compression system CS, the operation efficiency and performance of the air conditioner are enhanced, and power consumption can be reduced.

It is to be noted that in the present embodiment, in the first operation mode, and at the starting time, and the switching operation time from the second operation mode to the first operation mode, the controller 210 opens the electromagnetic valve 106 of the refrigerant pipe 102, and the refrigerant pipe 102 communicates with the pipe 75. The discharge-side refrigerants flow into the housing section 472A from both the rotary compression elements 32, 34, and the discharge-side pressures of both the rotary compression elements 32, 34 are applied as the back pressure of the second vane 52. However, the present invention is not limited to this embodiment, and an intermediate pressure may be applied as the back pressure of the second vane 52. The intermediate pressure is between the suction-side and discharge-side pressures of both the rotary compression elements 32, 34.

Figure 20:
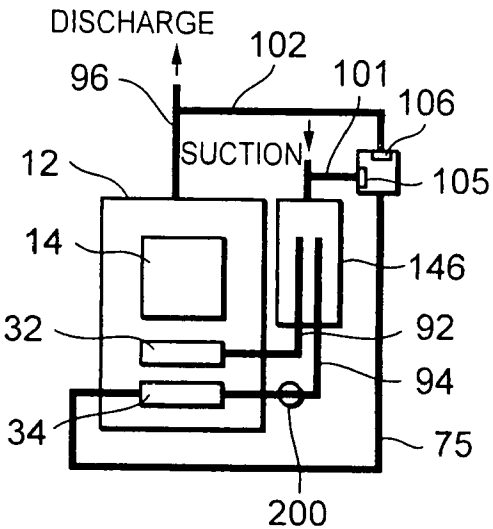
FIG. 20 is a diagram showing a flow of a refrigerant in the first operation mode of a multicylinder rotary compressor of another embodiment.

In this case, for example, as shown in FIG. 20, the controller 210 closes the electromagnetic valves 105 and 106 to form a closed space in the pipe 75 connected to the housing section 472A of the second vane 52. Then, not a little refrigerant in the second cylinder 40 flows into the housing section 472A between the second vane 52 and the housing section 70A. Therefore, the pressure in the housing section 472A of the second vane 52 is an intermediate pressure between the suction-side and discharge-side pressures of both the rotary compression elements 32, 34, and the intermediate pressure is applied as the back pressure of the second vane 52.

Even when the intermediate pressure is applied as the back pressure of the second vane 52 in this manner, the second vane 52 can be sufficiently urged toward the second roller 48 to follow up the roller in an early stage because the urging force of the weak spring 76 is applied in the same manner as in the above-described embodiments.

Embodiment 15

Figure 21:
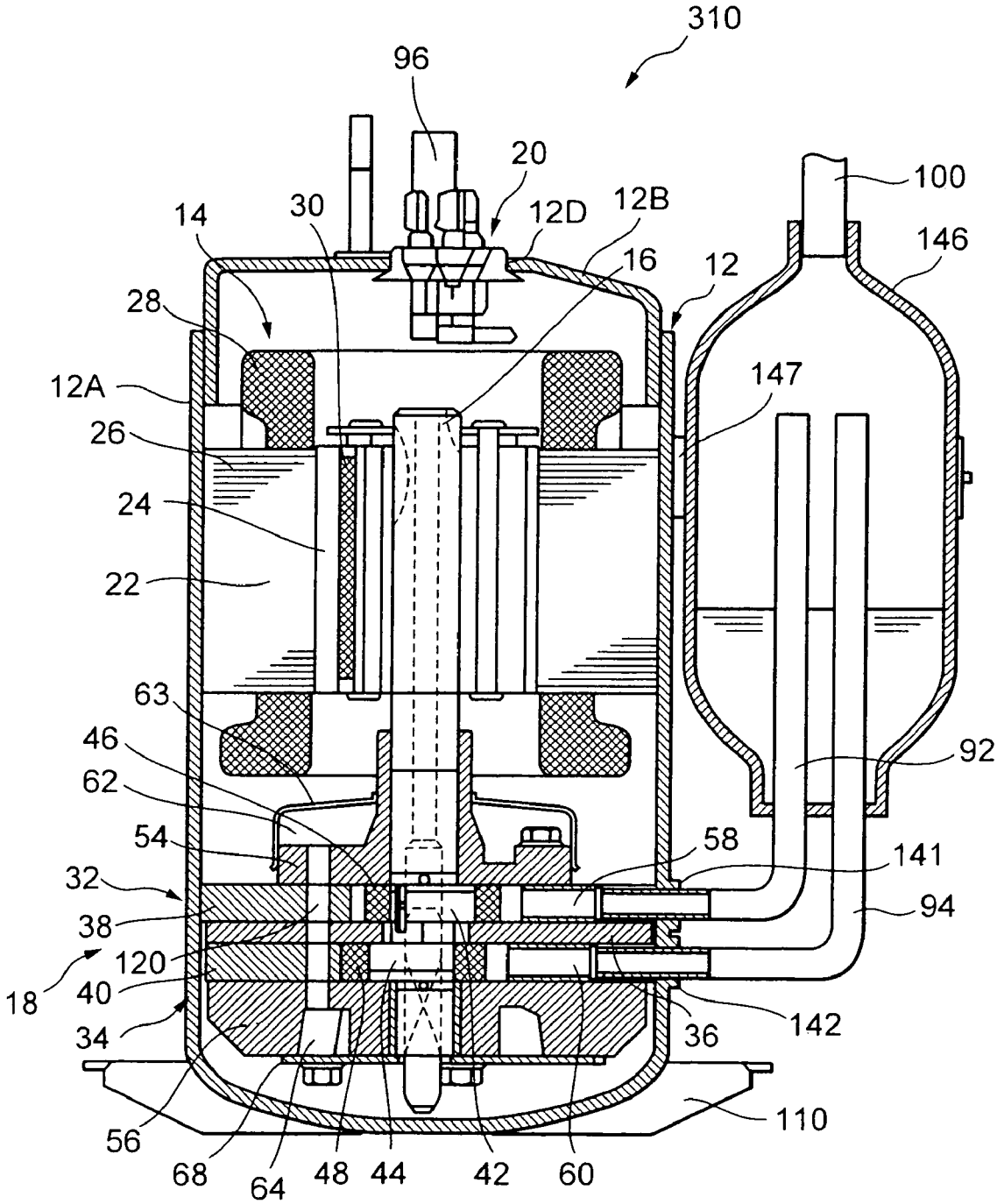
FIG. 21 is a vertically sectional side view of a multicylinder rotary compressor according to Embodiment 15 of the present invention.
Figure 22:
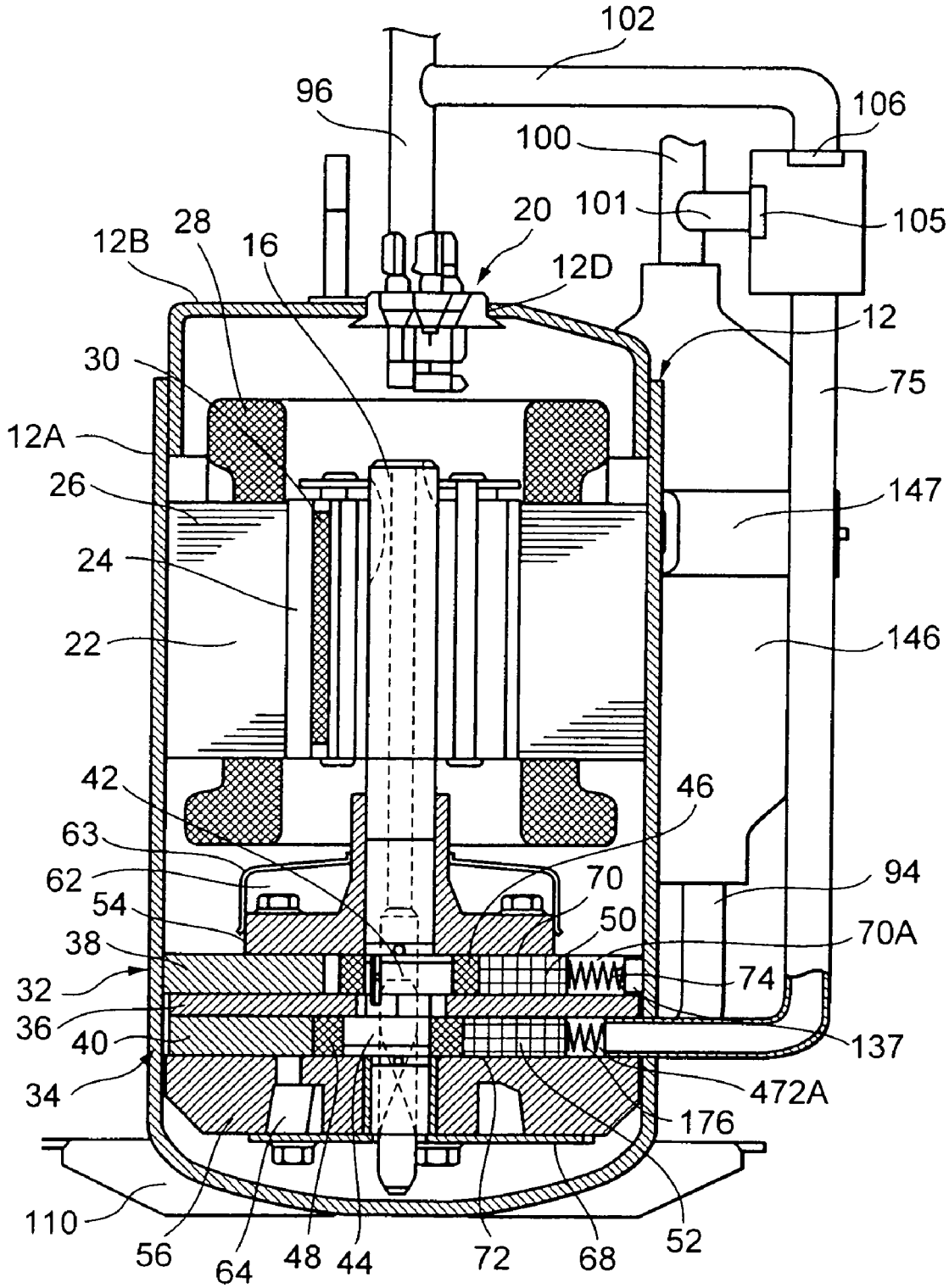
FIG. 22 is another vertically sectional side view of the multicylinder rotary compressor of FIG. 21.

Next, a multicylinder rotary compressor of a compression system will be described according to another embodiment of the present invention. FIGS. 21 and 22 are vertically sectional side views of a rotary compressor 310 according to the present embodiment, respectively. It is to be noted that in FIGS. 21 and 22, components denoted with the same reference numerals as those of FIGS. 1 to 20 produce the same or similar effects.

In FIG. 22, reference numeral 176 denotes a weak spring for a tensile load, and the spring is disposed outside a guide groove 72 which houses a second vane 52 of a second rotary compression element 34, that is, in a housing section 472A on a back-surface side of the second vane 52. This weak spring 176 pulls the second vane 52 on a side opposite to the second roller 48. One end of the spring is attached to a tip of the second vane 52, and the other end is attached to a pipe 75. The tensile force of the weak spring 176 is set to be not more than the urging force in a case where a suction-side pressure of both rotary compression elements 32, 34 or the first rotary compression element 32 is applied as a back pressure of the second vane 52.

Figure 25:
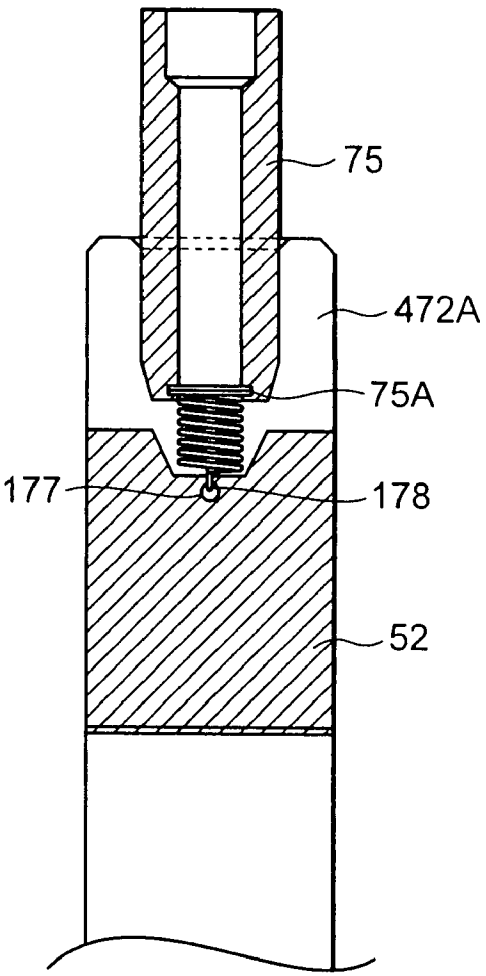
FIG. 25 is an enlarged view of a weak spring of a second rotary compression element according to another embodiment of the multicylinder rotary compressor of FIG. 23.
Figure 24:
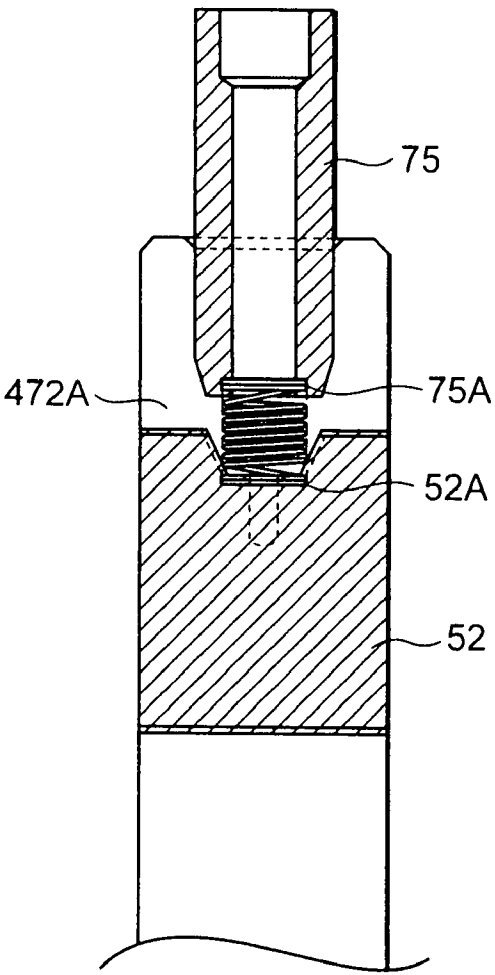
FIG. 24 is an enlarged view of a weak spring of a second rotary compression element according to another embodiment of the multicylinder rotary compressor of FIG. 23.
Figure 23:
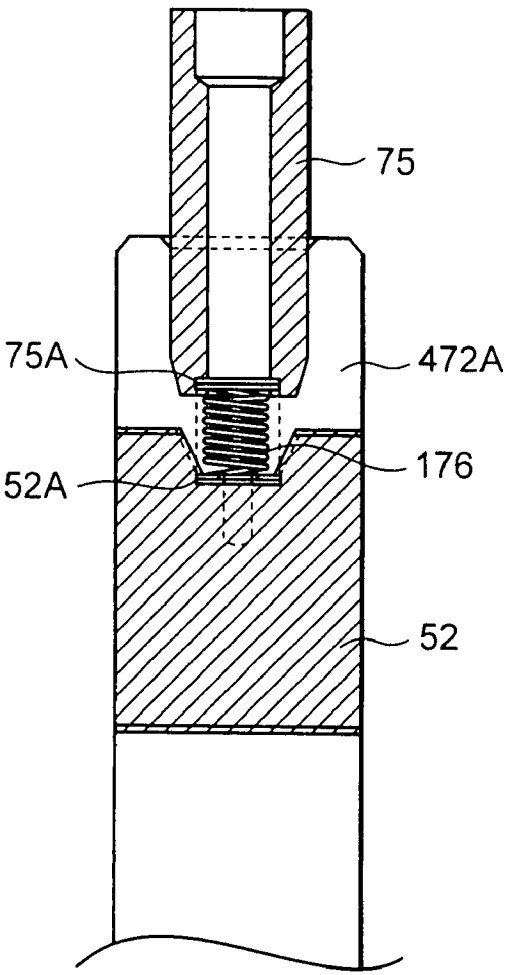
FIG. 23 is an enlarged view of a weak spring of a second rotary compression element in the multicylinder rotary compressor of FIG. 21.

Here, a method of attaching the weak spring 176 will be described with reference to FIG. 23. As to this weak spring 176, diameters of opposite ends are formed to be larger than other portions. Moreover, a groove 52A which matches one end of the weak spring 176 is formed in a center of an end portion on a side of the second vane 52 which does not abut on the second roller 48, and one end of the weak spring 176 is fitted into the groove 52A. Similarly, a groove 75A which matches the other end of the weak spring 176 is formed in an inner wall of the pipe 75 connected to the housing section 472A, and the other end of the weak spring 176 is fitted in the groove 75A. Accordingly, the weak spring 176 can be attached to the back surface of the second vane 52, and the second vane 52 can be pulled on a side opposite to the second roller 48. It is to be noted that not only in a case where the weak spring 176 is used having the large-diameter opposite ends and the other small portions but also in a case where a spring is used entirely having an equal diameter, for example, as shown in FIG. 24, the spring can be attached. In the latter case, when pitches of the opposite end portions of the spring are enlarged, the weak spring can be attached without abutting on the second vane 52. Moreover, as shown in FIG. 25, a hook 177 is disposed in one end of the weak spring, the hook 177 is attached to the second vane 52 (a hole 178 for attaching the hook 177 is formed in the second vane 52), and the second vane 52 may be pulled.

An operation of the rotary compressor 310 constituted as described above will be described.

(1) First Operation Mode (Operation at Usual or High Load Time)

First, a first operation mode will be described in which both the rotary compression elements 32, 34 perform a compression work. A controller 210 energizes an electromotive element 14 of a rotary compressor 310 based on an operation instruction input of an indoor-unit-side controller (not shown) disposed in the above-described indoor unit. At this time, simultaneously with the energization of the electromotive element 14, the controller 210 opens an electromagnetic valve 106 of a refrigerant pipe 102, and closes an electromagnetic valve 105 of a refrigerant pipe 101. Accordingly, the refrigerant pipe 102 communicates with the pipe 75. The controller 210 controls a rotation number of the electromotive element 14 of the rotary compressor 310 to start the compressor in a state in which discharge-side pressures of both the rotary compression elements 32, 34 are applied as a back pressure of the second vane 52. It is to be noted that simultaneously with the energization of the electromotive element 14, the controller 210 exerts a control in such a manner as to open the electromagnetic valve 105 and close the electromagnetic valve 106. The electromagnetic valves 105, 106 may be opened/closed before starting the rotary compressor 310. For example, the controller 210 may open the electromagnetic valve 106, and close the electromagnetic valve 105 before the energization of the electromotive element 14.

Moreover, when a stator coil 28 of the electromotive element 14 is energized via a terminal 20 and wiring (not shown), the electromotive element 14 starts, and a rotor 24 rotates. By this rotation, first and second rollers 46, 48 are fitted into upper and lower eccentric portions 42, 44 integrally disposed in a rotation shaft 16, and eccentrically rotate in first and second cylinders 38, 40.

Accordingly, a refrigerant flows into an accumulator 146 from a refrigerant pipe 100 of the rotary compressor 310. The electromagnetic valve 105 of the refrigerant pipe 101 is closed as described above. Therefore, when the refrigerant flows through the refrigerant pipe 100 on suction sides of both the rotary compression elements 32, 34, all the refrigerant flows into the accumulator 146 without flowing into the pipe 75.

The refrigerant which has flown into the accumulator 146 is separated into gas/liquid in the accumulator, and thereafter the only refrigerant gas enters refrigerant discharge tubes 92, 94 which open in the accumulator 146. The refrigerant gas which has entered the refrigerant introducing tube 92 is sucked on the low-pressure chamber side of the first cylinder 38 of the first rotary compression element 32 via a suction passage 58.

The refrigerant gas sucked on the low-pressure chamber side of the first cylinder 38 is compressed by the operations of the first roller 46 and a first vane 50 to constitute a high-temperature/pressure refrigerant gas. The gas is passed through a discharge port (not shown) from the high-pressure chamber side of the first cylinder 38, and is discharged to a discharge muffling chamber 62.

Here, there is an equilibrium pressure in a refrigerant circuit at a starting time of the rotary compressor 310. That is, after stopping the previous operation of the rotary compressor 310, the pressure is gradually equalized. After elapse of a predetermined time, the inside of the refrigerant circuit has the equilibrium pressure. Therefore, when the rotary compressor 310 is started in a situation in which the inside of the refrigerant circuit is entirely brought into the equilibrium pressure, immediately after starting the rotary compressor 310, the equilibrium pressure is substantially indicated by pressures of suction-side refrigerants of both the rotary compression elements 32, 34. The pressures are applied as a back pressure of the second vane 52. Similarly, the pressure inside the second cylinder 40 also indicates a substantially equilibrium pressure.

Therefore, the second vane 52 cannot follow up the second roller 48 until the discharge-side pressures of both the rotary compression elements 32, 34 rise to certain degrees. Therefore, the compression work is not substantially performed in the second rotary compression element 34, and the compression work of the refrigerant is performed only by the first rotary compression element 32 provided with a spring 74.

In this case, immediately after the starting, the state in the refrigerant circuit is unstable. Therefore, pulsations of the discharge-side pressures of both the rotary compression elements 32, 34 also remarkably increase. Therefore, when the compressor is started in a state in which the discharge-side pressures of both the rotary compression elements 32, 34 are applied, disadvantages occur that a follow-up property of the second vane 52 is deteriorated by the pulsations of the discharge-side pressures of both the rotary compression elements 32, 34, and the second vane 52 collides with the second roller 48 to generate a collision sound.

However, in the present embodiment, the weak spring 176 for the tensile load is disposed. The spring pulls the second vane 52 on a side opposite to the second roller 48. Accordingly, the second vane 52 does not come into the second cylinder 40 by the tensile force of the weak spring 76. Therefore, it is possible to avoid beforehand the disadvantage that the second vane 52 collides with the second roller 48 to generate the collision sound.

On the other hand, the refrigerant gas is compressed by the first rotary compression element 32, discharged to the discharge muffling chamber 62, and then discharged into the sealed container 12 via a hole (not shown) extending through the cup member 63.

Thereafter, the refrigerant in the sealed container 12 is discharged to the outside from a refrigerant discharge tube 96 formed in an end cap 12B of the sealed container 12, and flows into an outdoor heat exchanger 152. On the other hand, since the electromagnetic valve 106 is opened by the controller 210 as described above, a part of the refrigerant passed through the refrigerant discharge tube 96 flows into the housing section 472A from the refrigerant pipe 102 via the pipe 75.

On the other hand, the refrigerant gas which has flown into the outdoor heat exchanger 152 emits heat, pressure of the gas is reduced by an expansion valve 154, and thereafter the gas flows into an indoor heat exchanger 156. The refrigerant evaporates in the indoor heat exchanger 156, the heat is absorbed from air circulated in a room to thereby exert a cooling function, and the inside of the room is cooled. Moreover, the refrigerant emanates from the indoor heat exchanger 156 and is sucked by the rotary compressor 310. The refrigerant repeats this cycle.

On the other hand, when the rotary compressor 310 starts, and a predetermined time elapses, a high/low pressure difference is generated in the refrigerant circuit 10. That is, the suction-side pressure of the first rotary compression element 32 is a low pressure, and the discharge-side pressure is a high pressure. Accordingly, the second vane 52 follows up the second roller 48 by the discharge-side pressure, and the compression work is performed even in the second rotary compression element 34. Here, the tensile force of the weak spring 176 is set to be not more than an urging force in a case where the suction-side pressure of the first rotary compression element 32 (or both the rotary compression elements 32, 34) is applied as the back pressure of the second vane 52 as described above. Therefore, the second vane 52 can follow up the second roller 48 by the high pressure which is the discharge-side pressure without any trouble.

It is to be noted that the refrigerant gas is compressed by the operations of the second roller 48 and second vane 52 to obtain a high-temperature/pressure. The gas is passed through the discharge port 49 from the high-pressure chamber side of the second cylinder 40, and Is discharged to the discharge muffling chamber 64. The refrigerant gas is discharged to the discharge muffling chamber 64, discharged to the discharge muffling chamber 62 via the communication path 120, and flows together with the refrigerant gas compressed by the first rotary compression element 32. Moreover, the joined refrigerant gas is discharged into the sealed container 12 from a hole (not shown) extending through the cup member 63.

Thereafter, the refrigerant in the sealed container 12 is discharged to the outside from the refrigerant discharge tube 96 formed in the end cap 12B of the sealed container 12, and flows into the outdoor heat exchanger 152. On the other hand, since the electromagnetic valve 106 is opened by the controller 210 as described above, a part of the refrigerant passed through the refrigerant discharge tube 96 flows into the housing section 472A from the refrigerant pipe 102 via the pipe 75.

On the other hand, the refrigerant gas which has flown into the outdoor heat exchanger 152 emits heat, pressure of the gas is reduced by the expansion valve 154, and thereafter the gas flows into the indoor heat exchanger 156. In the indoor heat exchanger 156, the refrigerant evaporates, the heat is absorbed from air circulated in the room to thereby exert a cooling function, and the inside of the room is cooled. Moreover, the refrigerant emanates from the indoor heat exchanger 156 and is sucked by the rotary compressor 10. The refrigerant repeats this cycle.

(2) Switching from First Operation Mode to Second Operation Mode (Operation at Light Load Time)

Next, when the above-described usual or high load state turns to a light load state in the room, the controller 210 shifts to a second operation mode from the first operation mode. This second operation mode is a mode in which the only first rotary compression element 32 substantially performs a compression work. The operation mode is performed in a case where the inside of the room has a light load, and the electromotive element 14 rotates at a low speed in the first operation mode. When the only first rotary compression element 32 substantially performs the compression work in a small capacity region of the compression system CS, an amount of the refrigerant gas to be compressed can be reduced as compared with a case where both the first and second cylinders 38, 40 perform the compression work. Therefore, the rotation number of the electromotive element 14 can be raised also at a light load time by the corresponding amount, the operation efficiency of the electromotive element 14 is improved, and leak loss of the refrigerant can be reduced.

Here, at a mode switching time from the first operation mode to the second operation mode, the controller 210 rotates the electromotive element 14 at the low speed, a rotation number is set, for example, to 50 Hz or less, and a compression ratio of the rotary compression element 32 is controlled into 3.0 or less.

Furthermore, the controller 210 opens the electromagnetic valve 105 of the refrigerant pipe 101, and closes the electromagnetic valve 106 of the refrigerant pipe 102. Accordingly, the refrigerant pipe 101 communicates with the pipe 75, the refrigerant passes through the refrigerant pipe 100 on the suction sides of both the rotary compression elements 32, 34, and a part of the refrigerant flows into the housing section 472A from the refrigerant pipe 101 via the pipe 75. Consequently, the housing section 472A has the suction-side pressures of both the rotary compression elements 32, 34, and the suction-side pressures of both the rotary compression elements 32, 34 are applied as the back pressure of the second vane 52.

Here, the back pressures inside the second cylinder 40 and the second vane 52 correspond to equal suction-side pressures of both the rotary compression elements 32, 34. At this time, when the weak spring 176 is not disposed on the back-pressure side of the second vane 52, the pressure in the second cylinder 40 is equal to that of the second vane 52 as described above. Therefore, a problem has occurred that much time is required for the second vane 52 to retreat from the second cylinder 40, and during this time, the second vane 52 collides with the second roller 48 to generate the collision sound.

However, since the weak spring 176 for the tensile load is disposed, the second vane 52 is pulled on a housing section 472A side opposite to the second roller 48 by the tensile force of the weak spring 176, and the second vane 52 is housed in the guide groove 72. Consequently, at the switching time to the second operation mode, the second vane 52 is retracted from the second cylinder 40 in an early stage, and can be housed in the guide groove 72.

Consequently, it is possible to avoid beforehand the disadvantage that the second vane 52 collides with the second roller 48 to generate the collision sound. The mode can shift to the second operation mode in which the only first rotary compression element 32 substantially performs the compression work.

(3) Second Operation Mode

Next, an operation of the rotary compressor 310 will be described in a second operation mode. It is to be noted that in the same manner as in the switching time from the first operation mode to the second operation mode, the electromagnetic valve 105 of the refrigerant pipe 101 is opened, and the electromagnetic valve 106 of the refrigerant pipe 102 remains to be closed. The low-pressure refrigerant flows into the accumulator 146 from the refrigerant pipe 100 of the rotary compressor 310. After the refrigerant is separated into the gas/liquid in the accumulator, the only refrigerant gas enters the refrigerant discharge tube 92 which opens in the accumulator 146. The low-pressure refrigerant gas which has entered the refrigerant introducing tube 92 flows through the suction passage 58, and is sucked on the low-pressure chamber side of the first cylinder 38 of the first rotary compression element 32.

Since the electromagnetic valve 105 of the refrigerant pipe 101 is opened by the controller 210, a part of the refrigerant passed through the refrigerant pipe 100 flows into the housing section 472A from the refrigerant pipe 101 via the pipe 75. Accordingly, the housing section 472A obtains the suction-side pressure of the first rotary compression element 32, and the suction-side pressure of the first rotary compression element 32 is applied as the back pressure of the second vane 52.

On the other hand, the refrigerant gas sucked on the low-pressure chamber side of the first cylinder 38 is compressed by the operations of the first roller 46 and the first vane 50 to constitute a high-temperature/pressure refrigerant gas. The gas is discharged to the discharge muffling chamber 62 from the high-pressure chamber side of the first cylinder 38 through a discharge port (not shown). The refrigerant gas is discharged to the discharge muffling chamber 62, and discharged into the sealed container 12 from a hole (not shown) extending through the cup member 63.

Thereafter, the refrigerant in the sealed container 12 is discharged to the outside from the refrigerant discharge tube 96 formed in the end cap 12B of the sealed container 12, and flows into the outdoor heat exchanger 152. It is to be noted that since the electromagnetic valve 106 is closed as described above, the refrigerant flows through the refrigerant discharge tube 96 on the discharge side of the first rotary compression element 32, and all flows into the outdoor heat exchanger 152 without flowing through the pipe 75. Moreover, the refrigerant gas which has flown into the outdoor heat exchanger 152 emits heat. After the pressure of the gas is reduced by the expansion valve 154, the gas flows into the indoor heat exchanger 156. In the exchanger, the refrigerant evaporates. At this time, the heat is absorbed from air circulated in the room to exert a cooling function, and the inside of the room is cooled. Moreover, the refrigerant emanates from the indoor heat exchanger 156 and is sucked into the rotary compressor 310, and this cycle is repeated.

It is to be noted that in the second operation mode, the second vane 52 is pulled on the housing section 472A side (weak spring 176 side) opposite to the second roller 48 by the weak spring 176, and the second vane does not come into the second cylinder 40. Consequently, it is possible to avoid beforehand the disadvantage that the second vane 52 comes into the second cylinder 40 and collides with the second roller 48 to generate the collision sound during the operation in the second operation mode.

(4) Switching from Second Operation Mode to First Operation Mode

On the other hand, when the above-described light load state turns to a usual or high load state in the room, the controller 210 shifts from the second operation mode to the first operation mode. Here, an operation will be described in switching the second operation mode to the first operation mode. In this case, the controller 210 rotates the electromotive element 14 at the low speed (rotation number of 50 Hz or less), and the compression ratio of both the rotary compression elements 32, 34 is controlled into 3.0 or less. The controller 210 closes the electromagnetic valve 105 of the refrigerant pipe 101, and opens the electromagnetic valve 106 of the refrigerant pipe 102.

Accordingly, the refrigerant pipe 102 communicates with the pipe 75, discharge-side refrigerants of both the rotary compression elements 32, 34 flow into the housing section 472A, and the discharge-side pressures of both the rotary compression elements 32, 34 are applied as the back pressure of the second vane 52.

When the discharge-side pressures of both the rotary compression elements 32, 34 are applied as the back pressure of the second vane 52, the urging force for urging the second vane 52 toward the second roller 48 becomes larger than the tensile force of the weak spring 176. Therefore, the second vane 52 is pushed toward the second roller 48 to follow up the roller by the high pressure of the housing section 472A. Accordingly, the second rotary compression element 34 restarts the compression work.

As described above in detail, according to the present invention, the performance and reliability of the compression system CS can be enhanced. The system comprises the rotary compressor 310 which is usable by the switching of the first operation mode in which the first and second rotary compression elements 32, 34 perform the compression work and the second operation mode in which the only first rotary compression element 32 substantially performs the compression work.

Consequently, when the refrigerant circuit of the air conditioner is constituted using the compression system CS, the operation efficiency and performance of the air conditioner are enhanced, and power consumption can be reduced.

It is to be noted that in the present embodiment, in the first operation mode, and at the starting time, and the switching operation time from the second operation mode to the first operation mode, the controller 210 opens the electromagnetic valve 106 of the refrigerant pipe 102, and the refrigerant pipe 102 communicates with the pipe 75. The discharge-side refrigerants flow into the housing section 472A from both the rotary compression elements 32, 34, and the discharge-side pressures of both the rotary compression elements 32, 34 are applied as the back pressure of the second vane 52. However, the present invention is not limited to this embodiment, and an intermediate pressure may be applied as the back pressure of the second vane 52. The intermediate pressure is between the suction-side and discharge-side pressures of both the rotary compression elements 32, 34. Even in this case, the tensile force of the weak spring 176 is set to be not more than the urging force in the application of the suction-side pressure of both the rotary compression elements 32, 34 or the first rotary compression element 32 as the back pressure of the second vane 52. Therefore, the second vane 52 can follow up the second roller 48 without any trouble.

It is to be noted that in the above-described embodiments an HFC or HC-based refrigerant is used as a refrigerant, but a refrigerant having a large high/low pressure difference may be used such as carbon dioxide. For example, a combination of carbon dioxide and polyalkyl glycol (PAG) may be used as the refrigerant. In this case, since the refrigerant compressed by rotary compression elements 32 and 34 has a very high pressure, there is a possibility that the cup member 63 is broken by the high pressure in a case where the discharge muffling chamber 62 is formed into a shape to cover the upper support member 54 with the cup member 63 as in the respective embodiments.

Therefore, when the discharge muffling chamber is formed into a shape shown in FIG. 8, resistance to pressure can be secured. The chamber is above the upper support member 54 in which the refrigerants compressed by both the rotary compression elements 32, 34 flow together. That is, in a discharge muffling chamber 162 of FIG. 8, a concavely depressed portion is formed in an upper part of the upper support member 54, and the concavely depressed portion is closed by an upper cover 66 which is a cover having a predetermined thickness to constitute the chamber. Consequently, the present invention is applicable even to a case where a refrigerant having a large high/low pressure difference is contained like carbon dioxide.

It is to be noted that the above-described embodiments have been described using the rotary compressor in which the rotation shaft 16 is vertically laid, but needless to say, this invention is applicable to the use of the rotary compressor in which the rotation shaft is horizontally laid.

Furthermore, in the above-described embodiments, the two-air-cylinder rotary compressor has been used, but the present invention may be adapted to a compression system comprising a multicylinder rotary compressor comprising three air cylinders or more rotary compression elements.

The invention claimed is:

1. A multicylinder rotary compressor in which a sealed container stores a driving element and first and second rotary compression elements driven by a rotation shaft of the driving element, the first and second rotary compression elements comprising: first and second cylinders; first and second rollers which are fitted into eccentric portions formed in the rotation shaft and which eccentrically rotate in the respective cylinders: and first and second vanes which abut on the first and second rollers to partition the inside of each cylinder into low and high-pressure chamber sides, the first vane being urged toward the first roller by a spring member and the second vane being urged toward the second roller by a weak spring member, the compressor being switchable between a first operation mode in which both the rotary compression elements perform a compression work and a second operation mode in which the only first rotary compression element substantially performs the compression work, wherein an urging force of the weak spring member is set to be not more than that in a case where a suction-side pressure of both the rotary compression elements or the first rotary compression element is applied as a back pressure of the second vane, and further comprising: at least one valve device, wherein the valve device allows the refrigerant to flow into the second cylinder, and wherein the valve device is coupled to the back pressure passage to apply a discharge-side pressure, a suction-side pressure, and an intermediate pressure as a back pressure of the second vane, the intermediate pressure being between the suction-side and the discharge-side pressures of both the rotary compression elements, wherein the intermediate pressure is a pressure that, acting as the back pressure to the second vane, sufficiently urges the second vane toward the second roller, whereby pressure pulsation is reduced.

* * * * *